US010519395B2

(12) United States Patent
Saccomando et al.

(10) Patent No.: US 10,519,395 B2
(45) **Date of Patent: *Dec. 31, 2019**

(54) LUBRICANT COMPOSITION CONTAINING AN ANTIWEAR AGENT

(71) Applicant: The Lubrizol Corporation, Wickliffe, OH (US)

(72) Inventors: Daniel J. Saccomando, Sheffield (GB); William R. S. Barton, Belper (GB); Ewan E. Delbridge, Concord Township, OH (US); Shawn Dickess, Cincinnati, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/773,694

(22) PCT Filed: Nov. 4, 2016

(86) PCT No.: PCT/US2016/060566

§ 371 (c)(1),
(2) Date: May 4, 2018

(87) PCT Pub. No.: WO2017/079584

PCT Pub. Date: May 11, 2017

(65) Prior Publication Data

US 2018/0327686 A1 Nov. 15, 2018

Related U.S. Application Data

(60) Provisional application No. 62/251,710, filed on Nov. 6, 2015.

(51) Int. Cl.
*C10M 141/10* (2006.01)
*C10M 141/08* (2006.01)

(52) U.S. Cl.
CPC ..... *C10M 141/10* (2013.01); *C10M 141/08* (2013.01); *C10M 2203/1006* (2013.01); *C10M 2207/022* (2013.01); *C10M 2215/00* (2013.01); *C10M 2215/02* (2013.01); *C10M 2215/04* (2013.01); *C10M 2219/062* (2013.01); *C10M 2219/106* (2013.01); *C10M 2223/043* (2013.01); *C10M 2223/047* (2013.01); *C10N 2230/04* (2013.01); *C10N 2230/06* (2013.01); *C10N 2230/36* (2013.01); *C10N 2240/04* (2013.01); *C10N 2240/044* (2013.01)

(58) Field of Classification Search
CPC ..... C10M 2207/022; C10M 2215/00; C10M 2215/02; C10M 2215/04; C10M 2219/062; C10M 2219/106; C10M 2223/043; C10M 2223/047; C10M 2203/1006; C10N 2230/06; C10N 2230/36; C10N 2240/04; C10N 2240/044; C10N 2230/04
See application file for complete search history.

(56) References Cited

U.S. PATENT DOCUMENTS 4,002,569 A * 1/1977 Rubin ..... C07C 69/00 508/476
9,738,848 B2 * 8/2017 Takata ..... C10M 169/04

* cited by examiner

*Primary Examiner* — Vishal V Vasisth
(74) *Attorney, Agent, or Firm* — Iken Sans; Teresan Gilbert

(57) ABSTRACT

The invention provides a lubricant composition comprising an oil of lubricating viscosity and a (thio)phosphoric acid salt of an N-hydrocarbyl-substituted gamma- (γ-) or delta- (δ-)amino(thio)ester. The invention further relates to a method of lubricating a mechanical device with the lubricant composition.

22 Claims, No Drawings

LUBRICANT COMPOSITION CONTAINING AN ANTIWEAR AGENT

CROSS REFERENCE TO RELATED APPLICATION

This application claims priority from PCT Application Serial No. PCT/US2016/060566 filed on Nov. 4, 2016, which claims the benefit of U.S. Provisional Application No. 62/251,710 filed on Nov. 6, 2015, the entirety of both of which is hereby incorporated by reference.

FIELD OF INVENTION

The invention provides a lubricant composition comprising an oil of lubricating viscosity and 0.01 wt % to 15 wt % of a (thio)phosphoric acid salt of an N-hydrocarbyl-substituted gamma- (γ-) or delta- (δ-)amino(thio)ester. The invention further relates to a method of lubricating a mechanical device with the lubricant composition.

BACKGROUND OF THE INVENTION

Phosphorus chemistry such as zinc dialkyldithiophosphate (ZDDP), and amine phosphates, are known anti-wear agents in many lubricants. It is believed that phosphorus chemistry ZDDP antiwear additives protects metal surface of mechanical devices by forming a protective film on metal surfaces. However, many phosphorus antiwear agents have been identified as having some detrimental impact on either the mechanical devices being lubricated, or on the environment.

In lubrication ashless phosphorus chemistry such as amine phosphates is believed to in part result in increased corrosion, typically iron, lead and/or copper corrosion. Copper and lead corrosion may be from bearings and other metal components derived from alloys using copper or lead. Amine salts are also known to contribute to the degradation of fluorocarbon seals.

SUMMARY OF THE INVENTION

The objectives of the present invention include providing a lubricant composition having at least one of the following properties (i) improved or equivalent wear performance; (ii) reduced iron, lead or copper corrosion; (iii) break-in; (iv) decreased deposit formation; (v) improved operating efficiency and/or; (vi) improved seal compatibility in the operation of a mechanical device. In one embodiment the invention provides for a lubricant composition containing an amine salted protic acid that reduces/prevents wear without harming seals.

As used herein, the transitional term "comprising," which is synonymous with "including," "containing," or "characterized by," is inclusive or open-ended and does not exclude additional, un-recited elements or method steps. However, in each recitation of "comprising" herein, it is intended that the term also encompass, as alternative embodiments, the phrases "consisting essentially of" and "consisting of," where "consisting of" excludes any element or step not specified and "consisting essentially of" permits the inclusion of additional un-recited elements or steps that do not materially affect the basic and novel characteristics of the composition or method under consideration.

It is known to those skilled in the art that acid-base salts, such as those of the invention, need not be stoichiometric; that is, there may be an excess of acid over base or base over acid. In one embodiment, the amine salt of the invention contains up to 50% equivalent excess of acid (i.e. there are 1.5 equivalents of acid (or TAN) per 1 equivalent of amine base (or TBN)). In other embodiments, the ratio of acid to amine base is 1.5:1 to 1:1.5, or 1.3:1 to 1:1.3, or 1.1:1 to 1:1.1, all on an equivalent basis.

As used herein the expression "amino(thio)ester" is intended to include an aminothioester or an aminoester. Typically the amino(thio)ester may be an aminoester, or mixtures thereof.

As used herein the expression "(thio)phosphoric acid" is intended to include thiophosphoric acid, phosphoric acid (i.e., no sulphur present within the acid), mono- or dihydrocarbyl phosphate ester-acids, or mixtures thereof. Typically the (thio)phosphoric acid may be a phosphoric acid, or mixtures thereof.

Accordingly, in one embodiment, a lubricant composition comprising an oil of lubricating viscosity and a (thio) phosphoric acid salt of an N-hydrocarbyl-substituted gamma- (γ-) or delta- (δ-)amino(thio)ester is disclosed. The amino group of the amino(thio)ester is separated from the ester group by a chain of at least 3 carbon atoms. The lubricant composition may also have a thiadiazole.

In another embodiment, the amino(thio)ester may comprise an N-hydrocarbyl-substituted gamma-amino(thio)ester. In yet another embodiment, the amino(thio)ester may comprise an N-hydrocarbyl-substituted gamma-aminoester.

The chain separating the amino and ester groups may have a hydrocarbyl branch at the 1 or 2 position, provided that when the hydrocarbyl branch is at the 1 position, it is not a tertiary group. In another embodiment, the amino(thio) ester comprises a 2-((hydrocarbyl)aminomethyl) succinic acid dihydrocarbyl ester. The ester functionality may comprise an alcohol-derived group which is a hydrocarbyl group having 1 to about 30 carbon atoms. In another embodiment, the ester functionality may comprise an alcohol-derived group which is an ether-containing group. In yet another embodiment, the aminoester may be an ester and comprises a second ester functionality, wherein the two alcohol-derived groups of the ester functionalities are alkyl moieties which are the same or different and have 1 to about 18 carbon atoms.

In another embodiment, the lubricant composition may comprise an N-hydrocarbyl-substituted aminoester is represented by the formula

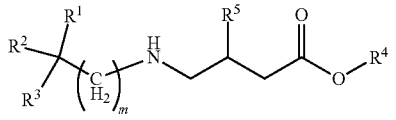

wherein m is 0 or 1, $R^1$ is hydrogen or a hydrocarbyl group, $R^2$ and $R^3$ are independently hydrocarbyl groups or together form a carbocyclic structure, $R^4$ is a hydrocarbyl group of 1 to about 30 carbon atoms, and $R^5$ is hydrogen, a hydrocarbyl group, or a group represented by $-C(=O)-R^6$ where $R^6$ is hydrogen, an alkyl group, or $-O-R^7$, where $R^7$ is a hydrocarbyl group of 1 to about 30 carbon atoms, provided that if $R^4$ is methyl, then m is 0, and further provided that if m is 0, $R^1$ is hydrogen.

Alternatively, the N-hydrocarbyl-substituted aminoester may be represented by the formula

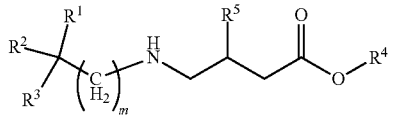

wherein m is 0 or 1, $R^1$ is hydrogen or a hydrocarbyl group, $R^2$ and $R^3$ are independently hydrocarbyl groups or together form a carbocyclic structure, $R^4$ is an ether-containing group or a polyether-containing group, having 2 to about 120 carbon atoms, and $R^5$ is hydrogen, a hydrocarbyl group, or a group represented by —C(=O)—$R^6$ where $R^6$ is hydrogen, an alkyl group, or —O—$R^7$, where $R^7$ is a hydrocarbyl group of 1 to about 30 carbon atoms, provided that if $R^4$ is methyl, then m is 0, and further provided that if m is 0, $R^1$ is hydrogen.

When $R^4$ is an ether-containing group, it may be represented by

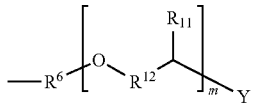

wherein $R^6$ is a hydrocarbyl group of 1 to about 30 carbon atoms; $R^{11}$ is H or a hydrocarbyl group of 1 to about 10 carbon atoms; $R^{12}$ is a straight or branched chain hydrocarbylene group of 1 to 6 carbon atoms; Y is —H, —OH, —$R^6$OH, —$NR^9R^{10}$, or —$R^6NR^9R^{10}$, where $R^9$ and $R^{10}$ are each independently H or a hydrocarbyl group of 1 to 50 carbon atoms, and m is an integer from 2 to 50.

In another embodiment, the lubricant composition may comprise an N-hydrocarbyl-substituted aminoester represented by the formula

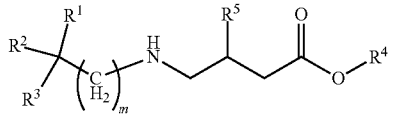

wherein m is 0 or 1, $R^1$ is hydrogen or a hydrocarbyl group, $R^2$ and $R^3$ are independently hydrocarbyl groups or together form a carbocyclic structure, $R^4$ is a hydroxy-containing or a polyhydroxy-containing alkyl group of 2 to about 12 carbon atoms, at least one hydroxy group being optionally reacted to form an ester or a thioester, and $R^5$ is hydrogen, a hydrocarbyl group, or a group represented by —C(=O)—$R^6$ where $R^6$ is hydrogen, an alkyl group, or —O—$R^7$, where $R^7$ is a hydrocarbyl group of 1 to about 30 carbon atoms, provided that if $R^4$ is methyl, then m is 0, and further provided that if m is 0, $R^1$ is hydrogen.

When $R^4$ is a hydroxy-containing or a polyhydroxy-containing alkyl group, the N-hydrocarbyl-substituted aminoester may represented by the formula

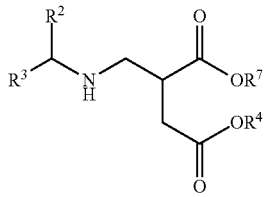

wherein $R^2$ and $R^3$ are independently alkyl groups of 1 to about 6 carbon atoms and $R^4$ and $R^7$ are independently alkyl groups of 1 to about 12 carbon atoms.

In another embodiment, the (thio)phosphoric acid salt of an N-hydrocarbyl-substituted amino(thio)ester may be obtained by reacting an N-hydrocarbyl-substituted amino (thio)ester with a (thio)phosphoric acid, ester, or a partial acid-ester thereof. The amino group of the amino(thio)ester is separated from the ester group by a chain of at least 3 carbon atoms. The chain separating the amino and ester groups may have a hydrocarbyl branch at the 1 or 2 position, provided that when the hydrocarbyl branch is at the 1 position, it is not a tertiary group.

In one embodiment, the (thio)phosphoric acid may comprise a mono- or di-hydrocarbyl (thio)phosphoric acid or mixtures thereof. Exemplary acids include, but are not limited to, alkyl (thio)phosphoric acid. In another embodiment, the alkyl of the mono- or di-hydrocarbyl (thio)phosphoric acid may comprise linear alkyl groups of 3 to 36 carbon atoms.

In other embodiments, the oil of lubricating viscosity may comprise at least one API Group I, II, III, IV, or V lubricant, or mixtures thereof. In another embodiment, the lubricant may further comprise at least one of a phosphorus-containing antiwear agent comprising a non-ionic phosphorus compound; an amine salt of a phosphorus compound; a dispersant; a detergent; an olefin sulphide; a calcium-containing detergent; a friction modifier; a sulphur-containing extreme pressure agent; a sulphur-containing corrosion inhibitor; or combinations thereof.

In yet other embodiments, the lubricant may further comprise 0.05 wt % to 3 wt % of a $C_2$-$C_{18}$ di- or tri-hydrocarbyl phosphite, based on a total weight of the lubricant. In other embodiments, the lubricant may further comprise an olefin sulphide. In yet other embodiments, the lubricant may further comprise less than 300 ppm zinc based on a total weight of said lubricant.

Methods of lubricating machine components with any of the lubricant compositions described above are also disclosed.

In one method embodiment, the method may comprise lubricating a manual transmission by supplying a lubricant composition as described above to the manual transmission. In another embodiment, the lubricant composition may comprise (a) an oil of lubricating viscosity; (b) 0.1 wt % to 6 wt % of a (thio)phosphoric acid salt; (c) 0.05 to 1 wt % of a thiadiazole; (d) 0.1 wt % to 5 wt % of a dispersant; and (e) 0.1 wt % to 4 wt % of a detergent. All weight percents (wt %) are based on a total weight of the lubricant composition.

In another method embodiment, the method may comprise lubricating a gear, gearbox, or axle gear by supplying a lubricant composition as described above to the gear, gearbox, or axle. In another embodiment, the lubricant composition may comprise (a) an oil of lubricating viscosity; (b) 0.1 wt % to 6 wt % of a (thio)phosphoric acid salt; (c) 0.05 to 1 wt % of a thiadiazole; (d) 0.1 wt % to 5 wt % of a dispersant; and (e) 2 wt % to 5 wt % of an olefin sulphide, wherein all weight percents (wt %) are based on a total weight of the lubricant composition.

In another embodiment, the method may comprise lubricating and automatic transmission by supplying a lubricant composition as described above to the automatic transmission. In another embodiment, the lubricant composition may comprise (a) an oil of lubricating viscosity; (b) 0.1 wt % to 6 wt % of a (thio)phosphoric acid salt; (c) 0.05 to 1 wt % of a thiadiazole; (d) 0.1 wt % to 5 wt % of a dispersant; and (e) 0.1 wt % to 4 wt % of a detergent, wherein all weight percents (wt %) are based on a total weight of the lubricant composition.

In yet another method embodiment, the method may comprise lubricating a farm tractor transmission by supplying a lubricant composition as described above to the farm tractor transmission. In another embodiment, the lubricant composition may comprise, (a) an oil of lubricating viscosity; (b) 0.1 wt % to 6 wt % of a (thio)phosphoric acid salt; (c) 0.05 to 1 wt % of a thiadiazole; (d) 0.1 wt % to 5 wt % of a dispersant; and (e) 0.1 wt % to 4 wt % of a detergent, wherein all weight percents (wt %) are based on a total weight of the lubricant composition.

In another embodiment, a method of improving seals compatibility of a lubricant composition is disclosed. The method may comprise adding to the lubricant composition a (thio)phosphoric acid salt of an N-hydrocarbyl-substituted gamma- (γ-) or delta- (δ-)amino(thio)ester, wherein the amino group is separated from the ester group by a chain of at least 3 carbon atoms.

A method of improving corrosion inhibition of a lubricant composition comprising adding to said lubricant composition a (thio)phosphoric acid salt of an N-hydrocarbyl-substituted gamma- (γ-) or delta- (δ-)amino(thio)ester, wherein the amino group is separated from the ester group by a chain of at least 3 carbon atoms.

A method of improving antiwear performance of a lubricant composition comprising adding to said lubricant composition a (thio)phosphoric acid salt of an N-hydrocarbyl-substituted gamma- (γ-) or delta- (δ-)amino(thio)ester, wherein the amino group is separated from the ester group by a chain of at least 3 carbon atoms.

DETAILED DESCRIPTION OF THE INVENTION

The present invention provides a lubricant composition, a method for lubricating a mechanical device and the use as disclosed above.

In one embodiment, the (thio)phosphoric acid salt comprises a (thio)phosphoric acid salt of an N-hydrocarbyl-substituted gamma-amino(thio)ester.

The (thio)phosphoric acid may comprise a mono- or di-hydrocarbyl (thio)phosphoric acid (typically alkyl (thio) phosphoric acid, or even alkyl phosphoric acid (sulphur-free)), alkyl pyrophosphoric acid, dihydrocarbyl pyrophosphoric acid, or mixtures thereof.

The alkyl of the mono- or di-hydrocarbyl (thio)phosphoric acid may comprise linear alkyl groups of 3 to 36 carbon atoms.

The alkyl of the mono- or di-hydrocarbyl (thio)phosphoric acid may comprise branched alkyl groups of 3 to 36 carbon atoms.

The hydrocarbyl group of the linear or branched hydrocarbyl (thio)phosphoric acid may contain 4 to 30, or 8 to 20, or 4 to 12 carbon atoms in the form of a linear chain. The hydrocarbyl group may be alkyl, or alkoxy, or mixtures thereof. Typically the alkoxy group may be present when the hydrocarbyl (thio)phosphoric acid also comprises alkyl group(s). The alkoxy group may contain 2 to 18 or 2 to 12, or 2 to 4 carbon atoms, and 1 to 3, or 1 to 2, or 1 hydroxy groups i.e., when 1 additional hydroxy group is present the parent compound is a diol. The hydroxyl groups are typically on adjacent carbon atoms i.e., a 1,2 diol. The alkoxy may be derived from a compound such as ethylene glycol, propylene glycol or butylene glycol. In one embodiment, the (thio)phosphoric acid contains hydrocarbyl groups that may be only alkyl. In one embodiment the (thio)phosphoric acid contains hydrocarbyl groups that may be a mixture of alkyl and alkoxy groups. The mixed alkyl alkoxy (thio)phosphoric acid may be obtained/obtainable by reacting material such as $P_2O_5$, $P_4O_{10}$, $P_2S_5$, $P_4S_{10}$, alkyl pyrophosphate, dihydrocarbyl pyrophosphate, or other compounds known in the art with mono-alcohol or diol. The mole ratio of mono-alcohol to diol may range from 3:1 to 10:1, or 3.5:1 to 10:1, or 4:1 to 10:1, or 5:1 to 7:1.

If improved operating efficiency is required, the hydrocarbyl (thio)phosphoric acid may contain a predominantly linear hydrocarbyl group of 3 to 36 4 to 30, or 8 to 20 carbon atoms.

Examples of a suitable hydrocarbyl group of the hydrocarbyl (thio)phosphoric acid may include isopropyl, n-butyl, sec-butyl, amyl, 4-methyl-2-pentyl (i.e. methyl amyl), n-hexyl, n-heptyl, n-octyl, iso-octyl, 2-ethylhexyl, nonyl, 2-propylheptyl, decyl, dodecyl, tetradecyl, hexadecyl, octadecyl, oleyl, or combinations thereof.

The substituted γ-aminoester may be generally depicted as a material represented by the formula N-hydrocarbyl-substituted aminoester. The amino group will typically be separated from the carbonyl carbon of the ester group by a chain of 3 or 4 carbon atoms (as shown in the structure below), which chain may optionally be further substituted. The aminoester may thus be generally depicted as a materials represented by the formula

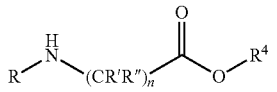

where R and $R^4$ are hydrocarbyl substituents ($R^4$ may be viewed as the residue of the alcohol from which the ester may be envisioned as having been prepared by condensation of an amino acid with an alcohol). In the formula, n is 3 or 4, representing the 3 or 4 carbon atoms separating the amino group from the ester group. The R' and R" groups may each independently be hydrogen, a hydrocarbyl group (of 1 to 30, or 1 to 6, or 1, or 2 carbon atoms), or an ester group —C(O)$OR^4$.

The group $R^4$, may have 1 to 30 or 2 to 18 or 4 to 15 or 4 to 8 carbon atoms. It may be a hydrocarbyl group or a hydrocarbon group. It may be aliphatic, cycloaliphatic, branched aliphatic, or aromatic. In certain embodiments, the $R^4$ group may be methyl, ethyl, propyl, isopropyl, n-butyl, iso-butyl, t-butyl, n-hexyl, cyclohexyl, iso-octyl, or 2-ethylhexyl. If $R^4$ is methyl, then the R group, the hydrocarbyl substituent on the nitrogen, will have a branch at the 1-position. The R group is more fully defined below.

In other embodiments, the $R^4$ group may be an ether-containing group. For instance, it may be an ether-containing group or a polyether-containing group which may contain, for instance 2 or 3 and up to, in some embodiments, 120 carbon atoms along with oxygen atoms representing the ether functionality. When $R^4$ is an ether-containing group, it may be represented by the general formula

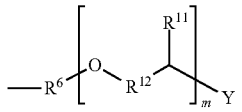

wherein $R^6$ is a straight- or branched-chain hydrocarbylene group of 1 to 30 or 2 to 8, or 2 to 4, or 2 carbon atoms; $R^{11}$ is H or a hydrocarbyl group of 1 to 10 carbon atoms, or 1 to 4 carbon atoms, or 1 to 2 carbon atoms; $R^{12}$ is a straight- or branched-chain hydrocarbylene group of 1 to 6 carbon atoms; Y is —H, hydrocarbyl group or a hydrocarbon group, which may have 1 to 30 or 2 to 18 or 4 to 15 or 4 to 8 carbon atoms. It may be aliphatic, cycloaliphatic, branched aliphatic, or aromatic. Y may alternatively be —OH or —$NR^9R^{10}$, where $R^9$ and $R^{10}$ are each independently H or a hydrocarbyl group of 1 to 30 or 2 to 18 or 4 to 15 or 4 to 8 carbon atoms, and m is an integer from 1 to 50, 1 to 14, or 15 to 40, or 2 to 8. An example of a mono-ether group would be —$CH_2$—O—$CH_3$. Polyether groups include groups based on poly(alkylene glycols) such as polyethylene glycols, polypropylene glycols, and poly(ethylene/propylene glycol) copolymers. Such polyalkylene glycols are commercially available under the trade names UCON® OSP base fluids, Synalox® fluids, and Brij® polyalkylene glycols. They may be terminated with an alkyl group (that is, Y is H) or with a hydroxy group or other such groups as mentioned above. If the terminal group is OH, then $R^4$ would also be considered a hydroxy-containing group, much as described in the paragraph below (albeit not specifically a hydroxy-containing alkyl group) and may be esterified as described in the paragraph below.

In another embodiment, $R^4$ can be a hydroxy-containing alkyl group or a polyhydroxy-containing alkyl group having 2 to 12 carbon atoms. Such materials may be based on a diol such as ethylene glycol or propylene glycol, one of the hydroxy groups of which may be reacted to form the ester linkage, leaving one unesterified hydroxy group. Another example of a material may be glycerin, which, after condensation, may leave one or two hydroxy groups. Other polyhydroxy materials include pentaerythritol and trimethylolpropane. Optionally, one or more of the hydroxy groups may be reacted to form an ester. In one embodiment, one or more of the hydroxy groups within $R^4$ may be condensed with or attached to an additional

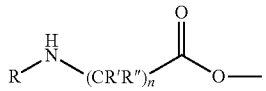

group so as to from a bridged species.

There may also be one or more additional substituents or groups within the $(CR'R'')_n$ group in the above molecule, as represented by R' or R". In one embodiment, there are no such substituents. In another embodiment, there may be a substituent leading to a group of materials such as those represented by the formulas

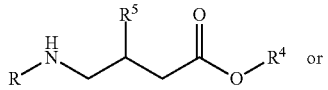

-continued

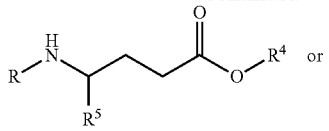

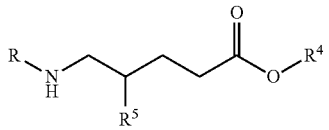

Here R and $R^4$ are as defined herein, and $R^5$ may be hydrogen, a hydrocarbyl group, a group represented by —C(═O)—$R^6$ where $R^6$ is hydrogen, an alkyl group containing 1-18, 1-8, or 1-2 hydrocarbyl groups, or —$OR^7$, and $R^7$ is a hydrocarbyl group of 1 to 30 carbon atoms). That is, a substituent at the β position of the chain may comprise an ester, carbonyl, or hydrocarbyl group. In yet other embodiments, $R^5$ may be defined as $R^4$ above.

When $R^5$ is —C(═O)—$R^6$ and n is 3, the structure may be represented by

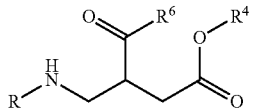

It will be evident that when $R^6$ is —$OR^7$ the material will be a substituted succinic acid ester. In one embodiment the material may be methyl succinic acid diester, with amine substitution on the methyl group. The $R^4$ and $R^6$ groups may be the same or different; in certain embodiments they may be as described above for $R^4$ (as when it is an ester). In certain embodiments, the material may be represented by the structure

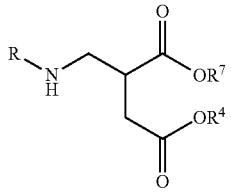

where $R^4$ and $R^7$ are as defined above and may be the same or different.

In certain embodiments, the material will be or will comprise a 2-((hydrocarbyl)-aminomethyl succinic acid dihydrocarbyl ester (which may also be referred to as a dihydrocarbyl 2-((hydrocarbyl)aminomethyl succinate). When $R^5$ is —C(═O)—$R^6$ and n is 4, the structure may be represented by

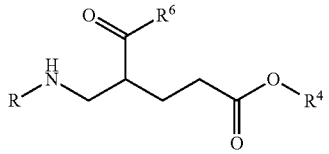

It will be evident that when $R^6$ is —O—$R^7$ the material will be a substituted pentanedioic acid ester. In particular, in one embodiment the material may be a 2-methyl pentanedioic acid diester, with amine substitution on the methyl group. The $R^4$ and $R^7$ groups may be the same or different; in certain embodiments they may independently have 1 to 30 or 2 to 18, or 4 to 15, or 4 to 8 carbon atoms, with other parameters as described above for $R^4$ and $R^7$ In certain embodiments, the material may be represented by the structure

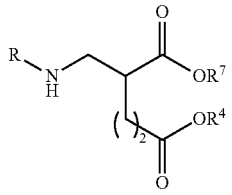

In certain embodiments, the material will be or will comprise a 2-((hydrocarbyl)-aminomethyl) pentanedioic acid dihydrocarbyl ester (which may also be referred to as a dihydrocarbyl 2-(((hydrocarbyl)aminomethyl) glutaric acid dihydrocarbyl ester). In certain embodiments, whenn=4, there may be substituents at both the 2 and 3 position as represented in the formula

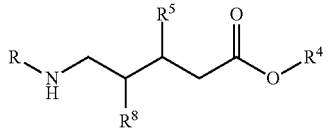

Here R, $R^4$, $R^5$ and are as defined above and $R^8$ may be a hydrocarbyl group or a group represented by —C(=O)—$R^6$ wherein $R^6$ is as defined above. The material may be represented by the structure

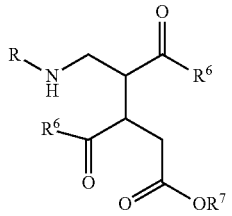

It will be evident that when $R^6$ is —O'—$R^7$ the material will be a substituted 1,2,3-tricarboxylic acid ester. In particular, in one embodiment the material may be a trihydrocarbyl 4-(hydrocarbylamino)butane-1,2,3-tricarboxylate.

The hydrocarbyl substituent R on the amine nitrogen will comprise a hydrocarbyl group of at least 3 carbon atoms with a branch at the 1 or 2 (that is, α or β) position of the hydrocarbyl chain R. The branched hydrocarbyl group R may be represented by the partial formula

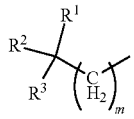

where the bond on the right represents the point of attachment to the nitrogen atom. In this partial structure, m may be 0 or 1, $R^1$ is hydrogen or a hydrocarbyl group, $R^2$ and $R^3$ are independently hydrocarbyl groups or together form a carbocyclic structure. The hydrocarbyl groups may be aliphatic, cycloaliphatic, or aromatic, or mixtures thereof. When m is 0, the branching is at the 1 or α position. When m is 1, the branching is at the 2 or β position. If $R^4$, above, is methyl, then m will be 0.

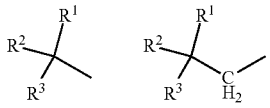

1- or α branching 2- or β branching

There may, of course, be branching both at the 1 position and the 2 position. Attachment to a cyclic structure is to be considered branching:

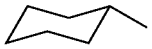

(a type of 1- or α branching)

The branched hydrocarbyl substituent R on the amine nitrogen may thus include such groups as isopropyl, cyclopropyl, sec-butyl, iso-butyl, t-butyl, 1-ethylpropyl, 1,2-dimethylpropyl, neopentyl, cyclohexyl, 4-heptyl, 2-ethyl-1-hexyl (commonly referred to as 2-ethylhexyl), t-octyl (for instance, 1,1-dimethyl-1-hexyl), 4-heptyl, 2-propylheptyl, adamantyl, and α-methylbenzyl.

The amine that may be seen as reacting to form the material of the present technology will be a primary amine, so that the resulting product will be a secondary amine, having a branched R substituent as described above and the nitrogen also being attached to the remainder of the molecule

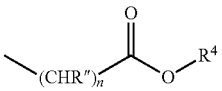

and substituted versions thereof as described above. The left-most (short) bond represents the attachment to the nitrogen atom.

The materials of the disclosed technology may therefore, in certain embodiments, be represented by the structure

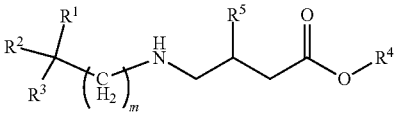

wherein m is 0 or 1, n is 1 or 2, $R^1$ is hydrogen or a hydrocarbyl group, $R^2$ and $R^3$ are independently hydrocarbyl groups or together form a carbocyclic structure, $R^4$ is a hydrocarbyl group of 1 to 30 carbon atoms as more fully described above, and $R^5$ is hydrogen, a hydrocarbyl group, or a group represented by —C(=O)—$R^6$ where $R^6$ is hydrogen, an alkyl group, or —O—$R^7$, and $R^7$ is a hydrocarbyl group of 1 to 30 carbon atoms. In certain embodiments, the materials may be represented by the structure

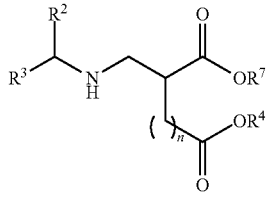

wherein n is 1 or 2, $R^2$ and $R^3$ are independently alkyl groups of 1 to 6 carbon atoms and $R^4$ and $R^7$ are independently alkyl groups of 1 to 12 carbon atoms. In other embodiments, the materials may be represented by the structure

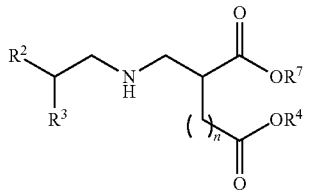

wherein $R^2$, $R^3$, $R^4$, $R^7$ and n are as defined above.

In certain embodiments, m may be 0, $R^1$ may be methyl, and $R^2$ may be an aromatic group. In certain embodiments, $R^4$ may be a butyl group. In certain embodiments $R^5$ may be an ester group. An example of a structure representing these selections is

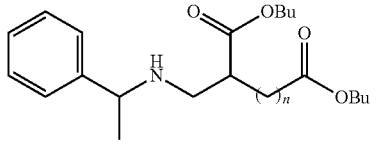

wherein n is 1 or 2 or in one embodiment n is 1.

In certain embodiments, the N-hydrocarbyl-substituted materials disclosed herein may be prepared by a Michael addition of a primary amine, having a branched hydrocarbyl group as described above, with an ethylenically unsaturated ester of the type described above. The ethylenic unsaturation would be between the carbon atoms of the ester as shown in the structure below. Thus, the reaction may occur generally as

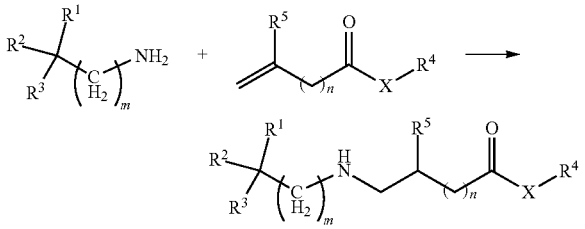

where the X and various R groups are as defined above, n=1 or 2 and m=0 or 1; in certain embodiments the $R^5$ group will be a group which activates the adjacent double bond to the addition reaction; e.g., $R^5$ may be an ester group. In one embodiment the ethylenically unsaturated ester may be an ester of itaconic acid, in which the reaction may be

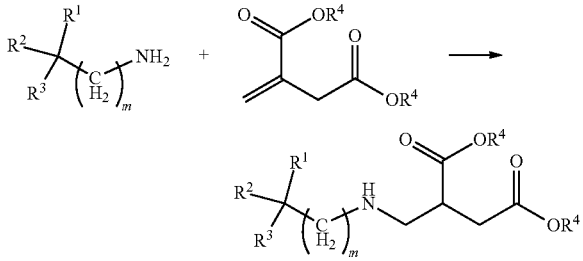

In one embodiment, the ethylenically unsaturated ester may be an ester of 2-methylene glutaric acid (the 2 indicating the position of the methylene group) in which the reaction may be

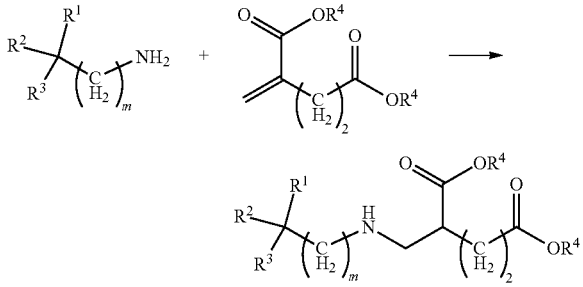

In one embodiment, the ethylenically unsaturated ester may be an ester of a 3-but-3-ene-1,2,3-tricarboxylic acid in which the reaction may be

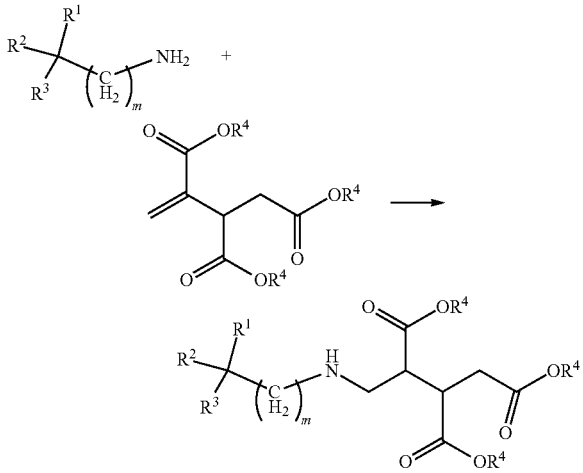

In other embodiments, the N-hydrocarbyl-substituted aminoester, materials disclosed herein may be prepared by reductive amination of the esters of 4- or 5-oxy substituted carboxylic acids.

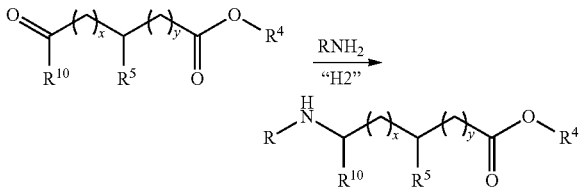

wherein x and y are 0 or 1 provided that x+y=1 or 2, and R, $R^4$, and $R^5$, are as defined above, and $R^{10}$ is H or an alkyl group having 1 to 4 carbon atoms. For example, reaction of α-methyl benzyl amine with butyl 5-oxopentanoate followed by selective hydrogenation of the resulting imine would yield butyl 5-(benzylamino)pentanoate.

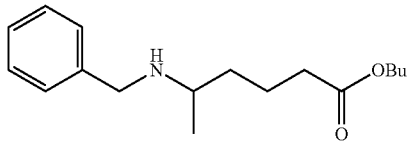

The N-hydrocarbyl-substituted aminoester materials disclosed herein may be prepared by amination of the esters of 4- or 5-halogen substituted carboxylic acids.

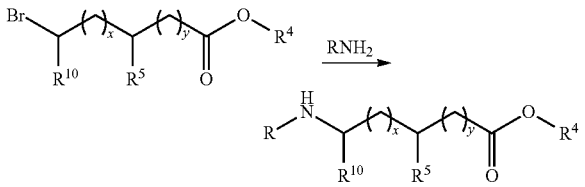

wherein x and y are 0 or 1 provided that x+y=1 or 2, and R, $R^4$, and $R^5$ are as defined above and $R^{10}$ is H or an alkyl group having 1 to 4 carbon atoms. For example reaction of α-methyl benzyl amine with 2-ethylhexyl 5-bromohexanoate would yield the hydro bromide salt of 2-ethylhexyl 5-(benzylamino)hexanoate.

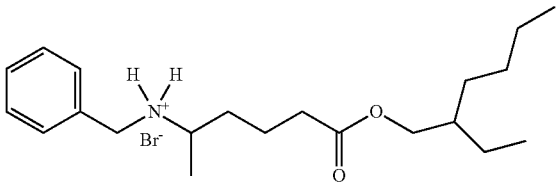

In such instances, when a hydrohalide is formed, the halide may be removed by known methods to obtain the amine.

The N-hydrocarbyl-substituted amino ester materials disclosed herein may be prepared by reductive amination of the esters of 2-amino substituted pentanedioic acids or 2-amino substituted hexanedioc acids.

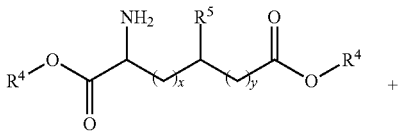

-continued

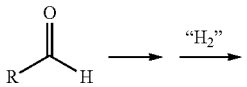

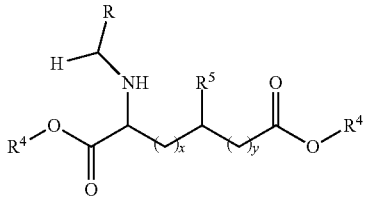

wherein x and y are 0 or 1 provided that x+y=1 or 2, and R, $R^4$, $R^5$ are as defined above. For example, the reaction of the dibutyl ester of glutamic acid with benzaldehyde followed by selective hydrogenation of the imine would yield dibutyl 2-(benzylamino)hexanedioate.

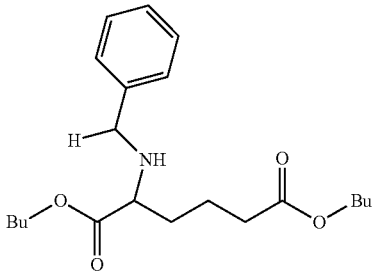

The N-hydrocarbyl-substituted aminoester materials disclosed herein may be prepared by alkylation of the esters of 2-amino substituted pentanedioic acids or 2-amino substituted hexanedioc acids.

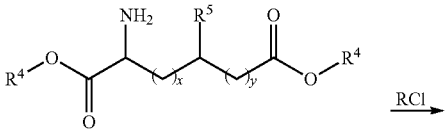

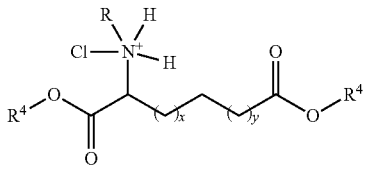

wherein x and y are 0 or 1 provided that x+y=1 or 2, and R, $R^4$, $R^5$ are as defined above. For example, the reaction of the dibutyl ester of glutamic acid with benzyl amine would yield N-benzyl-1,6-dibutoxy-1,6-dioxohexane-2-aminium chloride.

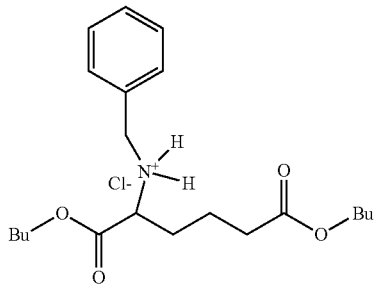

In one embodiment, the amine reactant is not a tertiary hydrocarbyl (e.g., t-alkyl) primary amine, that is, m is not zero while $R^1$, $R^2$, and $R^3$ are each hydrocarbyl groups.

The Michael addition reaction may be conducted in a solvent such as methanol and may employ a catalyst such as a zirconium (Zr)-based catalyst or may be conducted in the absence of catalyst. (A suitable Zr-based catalyst may be prepared by combining an aqueous solution of $ZrOCl_2$ with a substrate such as montmorillonite clay, with heating followed by drying.) Relative amounts of the reactants and the catalyst may be varied within bounds that will be apparent to the person skilled in the art. The ester and the amine may be used in approximately a 1:1 molar ratio, or alternatively with a slight molar excess of one reactant or the other, e.g., a ratio of ester:amine of 0.9:1 to 1.2:1, or 1:1 to 1.1:1, or 1.02:1 to 1.08:1. The amount of Zr catalyst, if used, (excluding support material) may be, for example, 0.5 to 5 g per 100 g of reactants (amine+ester), or 1 to 4 g, or 2 to 3 g, per 100 g of reactants. The Michael addition reaction may be conducted at a temperature of 10 to 33° C., or alternatively 15 to 30° C. or 18 to 27° C. or 20 to 25° C. or yet in other embodiments 10 to 80° C. or 15 to 70° C. or 18 to 60° C. or 20 to 55° C. or 25 to 50° C. or 30 to 50° C. or 45 to 55° C. Solvent may be used during the reaction if desired, and a suitable solvent may be an alcohol such as methanol or other protic solvent, which, in certain embodiments, is preferred. If such a solvent is present, it may be present in an amount of 5 to 80 wt % of the total reaction mixture (including the solvent), for instance, 10 to 70% or 12 to 60% or 15 to 50% or 18 to 40% or 20 to 30% or 18 to 25%, or about 20%. The presence of such a solvent may lead to an increased rate of reaction and may facilitate reaction at lower temperatures. In one embodiment 20% methanol is present with dibutyl itaconate and α-methylbenzylamine, and the reaction is conducted at 50° C. Specific optimum conditions may vary depending on the materials employed and can be determined by the person of ordinary skill. At the end of the reaction, the catalyst may be removed by filtration and the solvent, if any, may be removed by evaporation under vacuum. The solvent may be removed under vacuum at a temperature of up to 40° C. or up to 35° C. or up to 30° C. or up to 27° C. or up to 25° C.

In one embodiment, the (thio)phosphoric acid salt may be a (thio)phosphoric acid salt of N-hydrocarbyl-substituted delta- (δ-)amino(thio)ester. The delta- (δ-)amino(thio)ester may have a similar definition as presented above for the gamma-amino(thio)ester, except the N-hydrocarbyl substitution is at the delta- (δ-) position rather than the gamma position.

The (thio)phosphoric acid salt of the delta- (δ-)amino (thio)ester may be prepared by similar processes described above for the (thio)phosphoric acid salt of the gamma-amino (thio)ester.

Oils of Lubricating Viscosity

The lubricant composition of the present invention also contains an oil of lubricating viscosity. Such oils include natural and synthetic oils, oil derived from hydrocracking, hydrogenation, and hydrofinishing, unrefined, refined, re-refined oils or mixtures thereof. A more detailed description of unrefined, refined and re-refined oils is provided in International Publication WO2008/147704, paragraphs [0054] to [0056] (a similar disclosure is provided in US Patent Application 2010/197536, see [0072] to [0073]). A more detailed description of natural and synthetic lubricating oils is described in paragraphs [0058] to [0059] respectively of WO2008/147704 (a similar disclosure is provided in US Patent Application 2010/197536, see [0075] to [0076]). Synthetic oils may also be produced by Fischer-Tropsch reactions and typically may be hydroisomerised Fischer-Tropsch hydrocarbons or waxes. In one embodiment, oils may be prepared by a Fischer-Tropsch gas-to-liquid synthetic procedure as well as other gas-to-liquid oils.

Oils of lubricating viscosity may also be defined as specified in April 2008 version of "Appendix E—API Base Oil Interchangeability Guidelines for Passenger Car Motor Oils and Diesel Engine Oils", section 1.3 Sub-heading 1.3. "Base Stock Categories". The API Guidelines are also summarised in U.S. Pat. No. 7,285,516 (see column 11, line 64 to column 12, line 10). In one embodiment the oil of lubricating viscosity may be an API Group II, Group III, Group IV oil, or mixtures thereof.

The amount of the oil of lubricating viscosity present is typically the balance remaining after subtracting from 100 wt % the sum of the amount of the compound and the other performance additives.

The lubricant composition may be in the form of a concentrate and/or a fully formulated lubricant. If the lubricant composition (comprising the additives disclosed herein) is in the form of a concentrate which may be combined with additional oil to form, in whole or in part, a finished lubricant), the ratio of the of these additives to the oil of lubricating viscosity and/or to diluent oil include the ranges of 1:99 to 99:1 by weight, or 80:20 to 10:90 by weight.

Other Performance Additives

A lubricant composition may be prepared by adding the amine salt of the thiophosphate described herein above to an oil of lubricating viscosity, optionally in the presence of other performance additives (as described herein below).

The lubricant composition may further include other additives. In one embodiment, the invention provides a lubricant composition further comprising at least one of a dispersant, an antiwear agent (other than the (thio)phosphoric acid salt of the present invention), a dispersant viscosity modifier, a friction modifier, a viscosity modifier, an antioxidant, an overbased detergent, a foam inhibitor, a demulsifier, a pour point depressant or mixtures thereof. In one embodiment the invention provides a lubricant composition further comprising at least one of a polyisobutylene succinimide dispersant, an antiwear agent, a corrosion inhibitor, a dispersant viscosity modifier, a friction modifier, a viscosity modifier (typically a polymethacrylate having linear, comb or star architecture), an antioxidant (including phenolic and aminic antioxidants), an overbased detergent (including overbased sulphonates, phenates, and salicylates), or mixtures thereof.

The amount of each other performance additive and chemistry of the other performance additive will depend on type of driveline device being lubricated. When present common additives across each driveline lubricant includes viscosity modifiers, dispersants, foam inhibitors, corrosion inhibitors, pour point depressants, demulsifiers, and seal swell agents.

Viscosity may be included in the lubricant composition. Viscosity modifiers are usually polymers, including polyisobutenes, polymethacrylic acid esters, diene polymers, polyalkylstyrenes, esterified styrene-maleic anhydride copolymers, alkenylarene-conjugated diene copolymers, and polyolefins. Multifunctional viscosity improvers, which also have dispersant and/or antioxidancy properties are known and may optionally be used. The amount of viscosity modifier may range from 0.1 to 70 wt %, or 1 to 50 wt %, or 2 to 40 wt %. Typically, the viscosity modifier may be a polymethacrylate, or mixtures thereof.

The lubricant may comprise a dispersant, typically a nitrogen-containing dispersants, for example a hydrocarbyl substituted nitrogen containing additive. Suitable hydrocarbyl substituted nitrogen containing additives include ashless dispersants and polymeric dispersants. Ashless dispersants are so-named because, as supplied, they do not contain metal and thus do not normally contribute to sulfated ash when added to a lubricant. However they may, of course, interact with ambient metals once they are added to a lubricant which includes metal-containing species. Ashless dispersants are characterized by a polar group attached to a relatively high molecular weight hydrocarbon chain. Examples of such materials include succinimide dispersants, Mannich dispersants.

The dispersant may be post-treated with other reagents, or not post-treated. The dispersant may be post-treated with urea, thiourea, dimercaptothiadiazoles, carbon disulphide, aldehydes, ketones, carboxylic acids, hydrocarbon-substituted succinic anhydrides, maleic anhydride, nitriles, epoxides, and phosphorus compounds. Typically a succinimide dispersant may be borated or non-borated, and may optionally be post-treated by conventional methods by a reaction with any of a variety of other agents.

The borated dispersant or non-borated dispersant may be a succinimide dispersant, a Mannich dispersant, a polyolefin succinic acid ester, amide, or ester-amide, or mixtures thereof. In one embodiment, the non-borated dispersant may be a borated succinimide dispersant.

The borated dispersant may be based upon a borated polyisobutylene succinimide dispersant, wherein the polyisobutylene of the borated polyisobutylene succinimide has a number average molecular weight of 750 to 2200, or 750 to 1350, or 750 to 1150.

The non-borated may be a polyisobutylene succinimide, wherein the polyisobutylene of the borated polyisobutylene succinimide has a number average molecular weight of 750 to 2200, or 750 to 1350, or 750 to 1150.

The borated and non-borated polyisobutylene succinimide are known in the art and may be prepared with a polyisobutylene having a number average molecular weight of 950.

The borated and non-borated dispersant may be formed by reaction of a substituted acylating agent with a polyamine (typically having two or more reactive sites). For example, the substituted acylating agent may be a polyisobutylene succinic anhydride and the polyamine.

The polyamine may be an alkylenepolyamine. The alkylenepolyamine may include an ethylenepolyamine, a propylenepolyamine, a butylenepolyamine, or mixtures thereof. Examples of propylenepolyamine include propylenediamine, dipropylenetriamine and mixtures thereof.

In one embodiment, the polyamine is chosen from ethylenediamine, diethylenetriamine, triethylenetetramine, tetraethylenepentamine, pentaethylene-hexamine, polyamine still bottoms and mixtures thereof.

The borated and non-borated dispersant may be obtained/obtainable from reaction of succinic anhydride by an "ene" or "thermal" reaction, by what is referred to as a "direct alkylation process." The "ene" reaction mechanism and general reaction conditions are summarized in "Maleic Anhydride", pages, 147-149, Edited by B. C. Trivedi and B. C. Culbertson and Published by Plenum Press in 1982. The non-borated dispersant prepared by a process that includes an "ene" reaction may be a polyisobutylene succinimide having a carbocyclic ring present on less than 50 mole %, or 0 to less than 30 mole %, or 0 to less than 20 mole %, or 0 mole % of the dispersant molecules. The "ene" reaction may have a reaction temperature of 180° C. to less than 300° C., or 200° C. to 250° C., or 200° C. to 220° C.

The borated and non-borated dispersant may also be obtained/obtainable from a chlorine-assisted process, often involving Diels-Alder chemistry, leading to formation of carbocyclic linkages. The process is known to a person skilled in the art. The chlorine-assisted process may produce a non-borated dispersant that is a polyisobutylene succinimide having a carbocyclic ring present on 50 mole % or more, or 60 to 100 mole % (typically 100 mole %) of the dispersant molecules. Both the thermal and chlorine-assisted processes are described in greater detail in U.S. Pat. No. 7,615,521, columns 4-5 and preparative examples A and B.

The borated dispersant(s) of the present invention may be prepared in such a way to have an N:CO ratio of 0.9:1 to 1.6:1, or 0.95:1 to 1.5:1, or 1:1 to 1:4.

The non-borated dispersant may have a carbonyl to nitrogen ratio (CO:N ratio) of 5:1 to 1:10, 2:1 to 1:10, or 1:1 to 1:10, or 1:1 to 1:5, or 1:1 to 1:2. In one embodiment, the non-borated dispersant may have a CO:N ratio of 1:1 to 1:10, or 1:1 to 1:5, or 1:1 to 1:2.

The borated and non-borated dispersant may also be post-treated by conventional methods by a reaction with any of a variety of agents. Among these are urea, thiourea, dimercaptothiadiazoles, carbon disulphide, aldehydes, ketones, carboxylic acids, hydrocarbon-substituted succinic anhydrides, maleic anhydride, nitriles, epoxides, and phosphorus compounds.

The dispersant may be a reaction product prepared by heating together: (a) a dispersant (such as a polyisobutylene succinimide) and (b) 2,5-dimercapto-1,3,4-thiadiazole or a hydrocarbyl-substituted 2,5-dimercapto-1,3,4-thiadiazole which is substantially insoluble in a hydrocarbon oil of lubricating viscosity at 25° C., and further either (c) a borating agent or (d) an inorganic phosphorus compound, or both (c) and (d), said heating being sufficient to provide a reaction product of (a), (b), and (c) or (d) which is soluble in said hydrocarbon oil at 25° C.

The reaction product may typically contain 0.5 to 2.5 weight percent sulfur derived from component (b), or 1 to 2 weight percent, or 1.25 to 1.5 weight percent sulfur. It may likewise contain 0.2 to 0.6 weight percent boron from component (c), or 0.3 to 1.1 percent phosphorus from component (d), or such amounts from both components (c) and (d).

Borated dispersants may be prepared by borating using a variety of agents chosen from the various forms of boric acid (including metaboric acid, $HBO_2$, orthoboric acid, $H_3B_3$, and tetraboric acid, $H_2B_4O_7$), boric oxide, boron trioxide, and alkyl borates. These agents are described in more detail above. In one embodiment, the borating agent is boric acid which may be used alone or in combination with other borating agents.

The borated dispersant may be prepared by blending the boron compound and an N-substituted long chain alkenyl succinimide and heating them at a suitable temperature, typically 80° C. to 250° C., 90° C. to 230° C., or 100° C. to 210° C., until the desired reaction has occurred. An inert liquid may be used in performing the reaction. The liquid may include but are not limited to toluene, xylene, chlorobenzene, dimethylformamide and mixtures thereof.

The borated dispersant may also be a product prepared by heating together:

(i) a dispersant substrate;

(ii) 2,5-dimercapto-1,3,4-thiadiazole or a hydrocarbyl-substituted 2,5-di-mercapto-1,3,4-thiadiazole, or oligomers thereof;

(iii) a borating agent; and (iv) optionally a dicarboxylic acid of an aromatic compound chosen from 1,3 diacids and 1,4 diacids; or (v) optionally a compound, said heating being sufficient to provide a product of (i), (ii), (iii) and optionally (iv) or (v), which is soluble in an oil of lubricating viscosity.

The mixture of dispersant substrate, dicarboxylic acid of an aromatic compound and the mercaptothiadiazole is treated with a borating agent and optionally also with a phosphorus acid or anhydride. The components may be combined and reacted in any order. In particular, the borating agent may be a pre-treatment process or a post-treatment process. Thus, for instance, boric acid (and optionally also phosphoric acid) may be reacted with a dispersant substrate in one step, and thereafter the intermediate borated dispersant may be reacted with the mercaptothiadiazole and the dicarboxylic acid of an aromatic compound. Alternatively, the dispersant substrate, dicarboxylic acid of an aromatic compound and mercaptothiadiazole may be first reacted, and then the product treated with a borating agent (and optionally with phosphoric acid, a phosphorus acid). In yet another variation, a phosphorylated succinimide dispersant may be prepared by reacting a phosphorus acid with a hydrocarbyl-substituted succinic anhydride to prepare a mixed anhydride-acid precursor, and then reacting the precursor with a polyamine to form a phosphorus-containing dispersant. The phosphorus-containing dispersant may thereafter be reacted with the dicarboxylic acid of an aromatic compound and mercaptothiadiazole; and with the borating agent.

The components are typically reacted by heating the borating agent and optionally the phosphorus acid compound (together or sequentially) with the remaining components, that is, with the dispersant substrate, dicarboxylic acid of an aromatic compound and the dimercaptothiadiazole, although other orders of reaction are possible, as described above. The heating will be at a sufficient time and temperature to assure solubility of resulting product, typically 80-200° C., or 90-180° C., or 120-170° C., or 150-170° C. The time of reaction is typically at least 0.5 hours, for instance, 1-24 hours, 2-12 hours, 4-10 hours, or 6-8 hours. The length of time required for the reaction is determined in part by the temperature of the reaction, as will be apparent to one skilled in the art. Progress of the reaction is generally evidenced by the evolution of $H_2S$ or water from the reaction mixture. Typically, the $H_2S$ is derived from one or more of the sulphur atoms in the dimercaptothiadiazole.

The reaction product may typically contain 0.5 to 2.5 weight percent sulphur derived from component (iii), or 1 to 2 weight percent, or 1.25 to 1.5 weight percent sulphur. It may likewise contain 0.2 to 0.6 weight percent boron from component (iv), or 0.3 to 1.1 percent phosphorus from component (e), or such amounts from both components (iv) and (v).

The reaction may be conducted in a hydrophobic medium such as an oil of lubricating viscosity which may, if desired, be retained in the final product. The oil, however, should typically be an oil which does not itself react or decompose under conditions of the reaction. Thus, oils containing reactive ester functionality are typically not used as diluent. Oils of lubricating viscosity are described in greater detail above.

In the absence of the dicarboxylic acid, the relative amounts of the components which are reacted are, expressed as parts by weight prior to reaction are typically 100 parts of (i) the dispersant, per 0.75 to 6 parts of (ii) the dimercaptothiadiazole or substituted dimercaptothiadiazole, and 0 or 0.01 to 7.5 parts of (iii) the borating agent, and 0.01 to 7.5 parts of (v) the phosphorus acid compound, provided that the relative amount of (iii)+(v) is at least 0.075 parts. In one embodiment the relative amounts are 100 parts of (i), 1.5 to 3 parts of (ii), 0 to 4.5 parts of (iii), and 0 to 4.5 parts of (v), provided that (iii)+(v) is at least 1.5 parts. In another embodiment, the relative amounts are 100 parts (i): 1.5 to 2.2 parts (ii): 3.7 to 4.4 parts (iii): 1.5 to 4.4 parts (v). The amounts and ranges of the various components, in particular, (iii) and (v), may be independently combined so that there may be, for instance, 3.7 to 4.4 parts of (iii) whether or not any of (v) is present, and likewise there may be 1.5 to 4.4 parts (v) whether or not any of (iii) is present.

When the dicarboxylic acid is present, relative amounts of the components which are reacted are, expressed as parts by weight prior to reaction are typically 100 parts of (i) the dispersant, per 5-5000 parts per million of (ii) the dicarboxylic acid of an aromatic compound, 0.75 to 6 parts of (iii) the dimercaptothiadiazole or substituted dimercaptothiadiazole, and 0 to 7.5 parts of (iv) the borating agent and 0 to 7.5 parts of (v) the phosphorus acid compound, provided that the relative amount of (ii)+(iii)+(iv)+(v) is at least 1.5 parts. In a one embodiment, the relative amounts are 100 parts of (i), 1.5 to 6 parts of (ii), 5-1000 parts per million of (iii), 0 or 0.01 to 4.5 parts of (iv), and 0 to 4.5 parts of (v), provided that (iii)+(iv)+(v) is at least 1.5 parts. In another embodiment, the relative amounts are 100 parts (i): 1.5 to 5.0 parts (ii): 25-500 parts per million (iii): 3.7 to 4.4 parts (iv): 0 to 4.4 parts (v). The amounts and ranges of the various components, in particular, (iv) and (v), may be independently combined so that there may be, for instance, 3.7 to 4.4 parts of (iv) whether or not any of (v) is present, and likewise there may be 1.5 to 4.4 parts (v) whether or not any of (iv) is present.

In another embodiment, the lubricating composition may have an antiwear additive comprising a phosphate amine salt. The phosphate amine salt is a substantially sulfur-free alkyl phosphate amine salt. In this salt composition, at least 30 mole percent of the phosphorus atoms are in an alkyl pyrophosphate structure, as opposed to an orthophosphate (or monomeric phosphate) structure. The percentage of phosphorus atoms in the pyrophosphate structure may be 30 to 100 mole %, or 40 to 90% or 50 to 80% or 55 to 65%. The remaining amount of the phosphorus atoms may be in an orthophosphate structure or may consist, in part, in unreacted phosphorus acid or other phosphorus species. In one embodiment, up to 60 or up to 50 mole percent of the phosphorus atoms are in mono- or di-alkyl-orthophosphate salt structure.

The amount of the substantially sulfur-free alkyl phosphate amine salt in the lubricant composition may be 0.1 to 5 percent by weight. This amount refers to the total amount of the phosphate amine salt or salts, of whatever structure, both ortho-phosphate and pyrophosphate (with the understanding that at least 30 mole percent of the phosphorus atoms are in an alkyl pyrophosphate salt structure). The amounts of the phosphate amine salts in the pyrophosphate structure may be readily calculated therefrom. Alternative amounts of the alky phosphate amine salt may be 0.2 to 3 percent, or 0.5 to 2 percent, or 0.6 to 1.5 percent, or 0.7 to 1.2 percent by weight. The amount may be suitable to provide phosphorus to the lubricant formulation in an amount of 200 to 3000 parts per million by weight (ppm) or 400 to 2000 ppm or 600 to 1500 ppm or 700 to 1100 ppm.

The Dispersant Substrate

The product prepared by heating comprises a dispersant substrate. The dispersant is well known and include a succinimide dispersant (for example, N-substituted long chain alkenyl succinimides), a Mannich dispersant, an ester-containing dispersant, a condensation product of a fatty hydrocarbyl monocarboxylic acylating agent with an amine or ammonia, an alkyl amino phenol dispersant, a hydrocarbyl-amine dispersant, a polyether dispersant, a polyether-amine dispersant, a viscosity modifier containing dispersant functionality (for example polymeric viscosity index modifiers (VMs) containing dispersant functionality), or mixtures thereof. Typically, the dispersant substrate is a succinimide, or mixtures thereof. The dispersant substrate may be a polyisobutylene succinimide.

In one embodiment, the borated dispersant is prepared by reaction in the presence of a 1,3-dicarboxylic acid or 1,4-dicarboxylic acid of an aromatic compound, or reactive equivalents thereof, or mixtures thereof, which is reacted or complexed with the dispersant. The term "reactive equivalents thereof" include acid halides, esters, amides or mixtures thereof. The "aromatic component" is typically a benzene (phenylene) ring or a substituted benzene ring, although other aromatic materials such as fused ring compounds or heterocyclic compounds are also contemplated. It is believed (without intending to be bound by any theory) that the dicarboxylic acid aromatic compound may be bound to the dispersant by salt formation or complexation, rather than formation of covalently bonded structures such as amides, which may also be formed but may play a less important role. Typically, the presence of the dicarboxylic acid aromatic compound within the present invention is believed to impart corrosion inhibition properties to the composition. Examples of suitable dicarboxylic acids include 1,3-dicarboxylic acids such as isophthalic acid and alkyl homologues such as 2-methyl isophthalic acid, 4-methyl isophthalic acid or 5-methyl isophthalic acid; and 1,4-dicarboxylic acids such as terephthalic acid and alkyl homologues such as 2-methyl terephthalic acid. Other ring substituents such as hydroxy or alkoxy (e.g., methoxy) groups may also be present in certain embodiments. In one embodiment, the aromatic compound is terephthalic acid.

In one embodiment, the borated dispersant is prepared by reaction in the presence of a dimercaptothiadiazole which is reacted as a part of the "product prepared by heating." This is in addition to any dimercaptothiadiazole which may be present within a lubricant composition as a separate corrosion inhibitor. Examples include 2,5-dimercapto-1,3-4-thiadiazole or a hydrocarbyl-substituted 2,5-dimercapto-1,3-4-thiadiazole, or oligomers thereof. The oligomers of hydrocarbyl-substituted 2,5-dimercapto-1,3-4-thiadiazole typically form by forming a sulphur-sulphur bond between 2,5-dimercapto-1,3-4-thiadiazole units to form oligomers of two or more of said thiadiazole units.

In one embodiment, the borated dispersant is prepared by reaction in the presence of a phosphorus acid compound. The phosphorus acid compound may contain an oxygen atom and/or a sulphur atom as its constituent elements, and is typically a phosphorus acid or anhydride. This component includes the following examples: phosphorous acid, phosphoric acid, hypophosphoric acid, polyphosphoric acid, phosphorus trioxide, phosphorus tetroxide, phosphorous pentoxide ($P_2O_5$), phosphorotetrathionic acid ($H_3PS_4$), phosphoromonothionic acid ($H_3PO_3S$), phosphorodithionic acid ($H_3PO_2S_2$), phosphorotrithionic acid ($H_3PO_2S_3$), and $P_2S_5$. Among these, phosphorous acid and phosphoric acid or their anhydrides are typically used. A salt, such as an amine salt of a phosphorus acid compound may also be used. It is also possible to use a plurality of these phosphorus acid compounds together. The phosphorus acid compound is often phosphoric acid or phosphorous acid or their anhydride.

The phosphorus acid compound may also include phosphorus compounds with a phosphorus oxidation of +3 or +5, such as, phosphates, phosphonates, phosphinates, or phosphine oxides. A more detailed description for these suitable phosphorus acid compounds is described in U.S. Pat. No. 6,103,673, column 9, line 64 to column 11, line 8.

In one embodiment, the phosphorus acid compound is an inorganic phosphorus compound.

In one embodiment, the dispersant package may comprise (i) a non-borated dispersant that comprises a polyisobutylene succinimide, wherein the polyisobutylene used to prepare the non-borated dispersant has a number average molecular weight of 550 to 1150, or 750 to 1150, or 900 to 1000 (often commercially available with a number average molecular weight of about 950); and (ii) a borated dispersant that comprises a polyisobutylene succinimide, wherein the polyisobutylene used to prepare the non-borated dispersant has a number average molecular weight of 550 to 1150, or 750 to 1150, or 900 to 1000 (often commercially available with a number average molecular weight of about 950).

Foam inhibitors that may be useful in the compositions include polysiloxanes, copolymers of ethyl acrylate and 2-ethylhexylacrylate and optionally vinyl acetate; demulsifiers including fluorinated polysiloxanes, trialkyl phosphates, polyethylene glycols, polyethylene oxides, polypropylene oxides and (ethylene oxide-propylene oxide) polymers.

Pour point depressants that may be useful in the compositions include polyalphaolefins, esters of maleic anhydride-styrene copolymers, poly(meth)acrylates, polyacrylates or polyacrylamides.

Demulsifiers include trialkyl phosphates, and various polymers and copolymers of ethylene glycol, ethylene oxide, propylene oxide, or mixtures thereof different from the non-hydroxy terminated acylated polyether of the invention.

Seal swell agents include sulpholene derivatives Exxon Necton-37™ (FN 1380) and Exxon Mineral Seal Oil™ (FN 3200).

The lubricant may also include a derivative of a hydroxy-carboxylic acid. Suitable acids may include from 1 to 5 or 2 carboxy groups or from 1 to 5 or 2 hydroxy groups. In some embodiments the friction modifier may be derivable from a hydroxy-carboxylic acid represented by the formula:

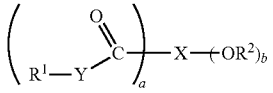

wherein: a and b may be independently integers of 1 to 5, or 1 to 2; X may be an aliphatic or alicyclic group, or an aliphatic or alicyclic group containing an oxygen atom in the carbon chain, or a substituted group of the foregoing types, said group containing up to 6 carbon atoms and having a+b available points of attachment; each Y may be independently —O—, >NH, or >$NR^3$ or two Y's together representing the nitrogen of an imide structure $R^4$—N< formed between two carbonyl groups; and each $R^3$ and $R^4$ may be independently hydrogen or a hydrocarbyl group, provided that at least one $R^1$ and $R^3$ group may be a hydrocarbyl group; each $R^2$ may be independently hydrogen, a hydrocarbyl group or an acyl group, further provided that at least one —$OR^2$ group is located on a carbon atom within X that is α or β to at least one of the —C(O)—Y—$R^1$ groups, and further provided that at least on $R^2$ is hydrogen. The hydroxy-carboxylic acid is reacted with an alcohol and/or an amine, via a condensation reaction, forming the derivative of a hydroxy-carboxylic acid, which may also be referred to herein as a friction modifier additive. In one embodiment, the hydroxy-carboxylic acid used in the preparation of the derivative of a hydroxy-carboxylic acid is represented by the formula:

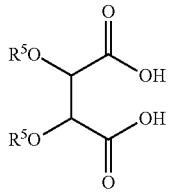

wherein each $R^5$ may independently be H or a hydrocarbyl group, or wherein the $R^5$ groups together form a ring. In one embodiment, where $R^5$ is H, the condensation product is optionally further functionalized by acylation or reaction with a boron compound. In another embodiment, the friction modifier is not borated. In any of the embodiments above, the hydroxy-carboxylic acid may be tartaric acid, citric acid, or combinations thereof, and may also be a reactive equivalent of such acids (including esters, acid halides, or anhydrides).

The resulting hydroxyl-carboxylic acid derivative may include imide, di-ester, di-amide, or ester-amide derivatives of tartaric acid, citric acid, or mixtures thereof. In one embodiment, the derivative of hydroxycarboxylic acid includes an imide, a di-ester, a di-amide, an imide amide, an imide ester or an ester-amide derivative of tartaric acid or citric acid. In one embodiment, the derivative of hydroxy-carboxylic acid includes an imide, a di-ester, a di-amide, an imide amide, an imide ester or an ester-amide derivative of tartaric acid. In one embodiment, the derivative of hydroxy-carboxylic acid includes an ester derivative of tartaric acid. In one embodiment, the derivative of hydroxycarboxylic acid includes an imide and/or amide derivative of tartaric acid. The amines used in the preparation of the friction modifier may have the formula RR'NH wherein R and R' each independently represent H, a hydrocarbon-based radical of 1 or 8 to 30 or 150 carbon atoms, that is, 1 to 150 or 8 to 30 or 1 to 30 or 8 to 150 atoms. Amines having a range of carbon atoms with a lower limit of 2, 3, 4, 6, 10, or 12 carbon atoms and an upper limit of 120, 80, 48, 24, 20, 18, or 16 carbon atoms may also be used. In one embodiment, each of the groups R and R' has 8 or 6 to 30 or 12 carbon atoms. In one embodiment, the sum of carbon atoms in R and R' is at least 8. R and R' may be linear or branched. The alcohols useful for preparing the friction modifier will similarly contain 1 or 8 to 30 or 150 carbon atoms. Alcohols having a range of carbon atoms from a lower limit of 2, 3, 4, 6, 10, or 12 carbon atoms and an upper limit of 120, 80, 48, 24, 20, 18, or 16 carbon atoms may also be used. In certain embodiments, the number of carbon atoms in the alcohol-derived group may be 8 to 24, 10 to 18, 12 to 16, or 13 carbon atoms. The alcohols and amines may be linear or branched, and, if branched, the branching may occur at any point in the chain and the branching may be of any length. In some embodiments, the alcohols and/or amines used include branched compounds, and in still other embodiments, the alcohols and amines used are at least 50%, 75% or even 80% branched. In other embodiments, the alcohols are linear. In some embodiments, the alcohol and/or amine have at least 6 carbon atoms. Accordingly, certain embodiments the product prepared from branched alcohols and/or amines of at least 6 carbon atoms, for instance, branched $C_{6-18}$ or $C_{8-18}$ alcohols or branched $C_{12-16}$ alcohols, either as single materials or as mixtures. Specific examples include 2-ethylhexanol and isotridecyl alcohol, the latter of which may represent a commercial grade mixture of various isomers. Also, certain embodiments the product prepared from linear alcohols of at least 6 carbon atoms, for instance, linear $C_{6-18}$ or $C_{8-18}$ alcohols or linear $C_{12-16}$ alcohols, either as single materials or as mixtures. The tartaric acid used for preparing the tartrates, tartrimides, or tartramides may be the commercially available type (obtained from Sargent Welch), and it exists in one or more isomeric forms such as d-tartaric acid, l-tartaric acid, d,l-tartaric acid or meso-tartaric acid, often depending on the source (natural) or method of synthesis (e.g. from maleic acid). These derivatives may also be prepared from functional equivalents to the diacid readily apparent to those skilled in the art, such as esters, acid chlorides, or anhydrides.

The derivative of hydroxycarboxylic acid may function in a driveline lubricant composition as either a friction modifier or a secondary antiwear agent. The derivative of hydroxy-carboxylic acid may be present at 0 to 5 wt %, or 0 to 3 wt %, or 0.05 wt % to 2.5 wt %, or 0.1 to 2 wt %.

Manual Transmission Lubricant

In one embodiment, the invention provides a lubricant composition comprising:

an oil of lubricating viscosity, 0.1 wt % to 6 wt % (or 0.1 to 3 wt %, or 0.2 to 1.5 wt %, or 1.6 to 3 wt %) of a (thio)phosphoric acid salt of an N-hydrocarbyl-substituted gamma- (γ-) or delta- (δ-) amino (thio)ester, a thiadiazole (typically present at 0.05 to 1 wt %, or 0.07 to 0.7 wt %, or 0.1 to 0.3 wt %, or 0.15 to 0.25 wt %), a dispersant (typically present at 0.1 to 5 wt %, or 0.3 to 4 wt %, or 1 to 3 wt %, or 0.1 to 3 wt %), a detergent (typically present at 0.1 to 4 wt %, or 0.2 to 3.5 wt %, or 0.5 to 3 wt %, or 0.5 to 2 wt %), and a $C_2$-$C_{18}$ di- or tri-hydrocarbyl phosphite (typically present at 0.05 to 3 wt %, or 0.2 to 2 wt %, or 0.2 to 1.5 wt %, or 0.2 to 1 wt %).

The manual transmission may have synchromesh, or in another embodiment the manual transmission does not have a synchromesh. The synchromesh may be composed of aluminum, steel, bronze, molybdenum, brass (sintered or non-sintered), carbon in the form of fibers, graphitic material (optionally in combination with a cellulosic material), or a cellulosic material, or a phenolic resin.

In one embodiment, the (thio)phosphoric acid salt of an N-hydrocarbyl-substituted gamma- (γ-) or delta- (δ-)amino (thio)ester is a phosphoric acid salt of an N-hydrocarbyl-substituted gamma- (γ-) or delta- (δ-)aminoester i.e., free of sulphur.

In one embodiment, the lubricant may comprise 0.03 to 1.0 wt %, or 0.1 to 0.6 wt %, or 0.2 to 0.5 wt % of calcium.

The detergent may be calcium or magnesium based, and the detergent may have at least 200 TBN, or 250 to 1000, or 450 to 900 or 650 to 800 mg KOH/g on an oil free basis. Typically the detergent is a calcium based detergent.

The lubricant may have 100 to 2000 ppm, 150 to 1500 ppm, 200 to 1000, or 250 to 800 ppm, or 500 to 875 ppm of phosphorus delivered by an antiwear agent i.e., delivered by the salt of the present invention, and/or an additional phosphorus-containing antiwear agent.

In one embodiment, the invention provides a method of lubricating a manual transmission comprising supplying to the manual transmission a lubricant composition comprising:

an oil of lubricating viscosity, 0.01 wt % to 15 wt % (or 0.05 to 10 wt %, or 0.1 wt % to 5 wt %, or 0.2 to 1 wt %) of a (thio)phosphoric acid salt of an N-hydrocarbyl-substituted gamma- (γ-) or delta- (δ-) amino(thio)ester.

a thiadiazole (typically present at 0.05 to 1 wt %, or 0.07 to 0.7 wt %, or 0.1 to 0.3 wt %, or 0.15 to 0.25 wt %), a dispersant (typically present at 0.1 to 5 wt %, or 0.3 to 4 wt %, or 1 to 3 wt %, or 0.1 to 3 wt %), a detergent (typically present at 0.1 to 4 wt %, or 0.2 to 3.5 wt %, or 0.5 to 3 wt %, or 0.5 to 2 wt %), and a $C_2$-$C_{18}$ (such as $C_2$-$C_8$, or $C_{16}$-$C_{18}$) di- or tri-hydrocarbyl phosphite (typically present at 0.05 to 3 wt %, or 0.2 to 2 wt %, or 0.2 to 1.5 wt %, or 0.2 to 1 wt %).

The thiadiazole compound may include mono- or di-hydrocarbyl substituted 2,5-dimercapto-1,3,4-thiadiazole compounds. Examples of a thiadiazole include 2,5-dimercapto-1,3,4-thiadiazole, or oligomers thereof, a hydrocarbyl-substituted 2,5-dimercapto-1,3,4-thiadiazole, a hydrocarbylthio-substituted 2,5-dimercapto-1,3,4-thiadiazole, or oligomers thereof. The oligomers of hydrocarbyl-substituted 2,5-dimercapto-1,3,4-thiadiazole typically form by forming a sulphur-sulphur bond between 2,5-dimercapto-1,3,4-thiadiazole units to form oligomers of two or more of said thiadiazole units. These thiadiazole compounds may also be used in the post treatment of dispersants as mentioned below in the formation of a dimercaptothiadiazole derivative of a polyisobutylene succinimide.

Examples of a suitable thiadiazole compound include at least one of a dimercaptothiadiazole, 2,5-dimercapto-[1,3,4]-thiadiazole, 3,5-dimercapto-[1,2,4]-thiadiazole, 3,4-dimercapto-[1,2,5]-thiadiazole, or 4-5-dimercapto-[1,2,3]-thiadiazole. Typically, readily available materials such as 2,5-dimercapto-1,3,4-thiadiazole or a hydrocarbyl-substituted 2,5-dimercapto-1,3,4-thiadiazole or a hydrocarbylthio-substituted 2,5-dimercapto-1,3,4-thiadiazole are commonly utilized.

The lubricant may contain a succinimide dispersant, typically a borated or non-borated succinimide.

As described above, the non-borated may be a polyisobutylene succinimide, wherein the polyisobutylene of the borated polyisobutylene succinimide has a number average molecular weight of 750 to 2200, or 750 to 1350, or 750 to 1150.

As described above, the borated and non-borated polyisobutylene succinimide are known in the art and may be prepared with a polyisobutylene having a number average molecular weight of 950.

In one embodiment, the lubricant may contain both the borated and non-borated polyisobutylene succinimide.

The C2-C18 (or C2 to C8 or C16-C18) di- or tri-hydrocarbyl phosphite, or mixtures thereof may be represented by the formula:

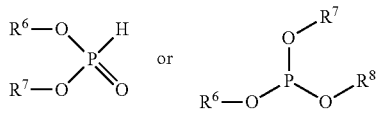

wherein at least one of $R^6$, $R^7$ and $R^8$ may be a hydrocarbyl group containing at least 4 carbon atoms and the other may be hydrogen or a hydrocarbyl group. In one embodiment, $R^6$, $R^7$ and $R^8$ are all hydrocarbyl groups. The hydrocarbyl groups may be alkyl, cycloalkyl, aryl, acyclic or mixtures thereof. In the formula with all three groups $R^6$, $R^7$ and $R^8$, the compound may be a tri-hydrocarbyl substituted phosphite i.e., $R^6$, $R^7$ and $R^8$ are all hydrocarbyl groups and in some embodiments may be alkyl groups. Typically, the di- or tri-hydrocarbyl phosphite comprises dibutyl phosphite or oleyl phosphite.

The lubricant may contain a detergent. The detergent may be neutral or overbased, typically overbased. The detergent may be calcium or magnesium containing, typically calcium containing.

Another component of the disclosed lubricant is an overbased, carbonated calcium or magnesium arylsulphonate detergent having a total base number (TBN) of at least 640 as calculated on an oil-free basis, or a mixture of such detergents. Detergents in general are typically overbased materials, otherwise referred to as over-based or superbased salts, which are generally homogeneous Newtonian systems having by a metal content in excess of that which would be present for neutralization according to the stoichiometry of the metal and the detergent anion. The amount of excess metal is commonly expressed in terms of metal ratio, that is, the ratio of the total equivalents of the metal to the equivalents of the acidic organic compound. Overbased materials are prepared by reacting an acidic material (such as carbon dioxide) with an acidic organic compound, an inert reaction medium (e.g., mineral oil), a stoichiometric excess of a metal base, and a promoter such as a phenol or alcohol. The acidic organic material will normally have a sufficient number of carbon atoms, to provide oil-solubility.

Overbased detergents may be characterized by Total Base Number (TBN), the amount of strong acid needed to neutralize all of the material's basicity, expressed as mg KOH per gram of sample. TBN is a very well-known parameter that is described in ASTM D 4739. Since overbased detergents are commonly provided in a form which contains diluent oil, for the purpose of this document, TBN is to be recalculated to an oil-free basis. Various detergents may have a TBN of 100 to 1000, or 150 to 800, or, 400 to 700. The detergents may have a TBN of at least 640, for instance, 650 to 1000, or even 680 to 800. In each case, the units are mg KOH/g.

Typically, the detergent is an overbased calcium sulphonate detergent, but other metals may also be present, whether in a sulphonate detergent (for example, an overbased magnesium arylsulphonate detergent) or a different detergent substrate (for example, an overbased calcium phenate detergent). The metal compounds generally useful in making the basic metal salts are generally any Group 1 or Group 2 metal compounds (CAS version of the Periodic Table of the Elements). Examples include alkali metals such as sodium, potassium, lithium, copper, magnesium, calcium, barium, zinc, and cadmium. In one embodiment, the metals are sodium, magnesium, or calcium. The anionic portion of the salt may be hydroxide, oxide, carbonate, borate, or nitrate. The detergents may be calcium or magnesium detergents, typically prepared using calcium or magnesium oxide or calcium or magnesium hydroxide. Since the detergents of particular interest are carbonated detergents, they will be materials that have been treated with carbon dioxide. Such treatment leads to more efficient incorporation of basic metal into the composition. Formation of high TBN detergents involving reaction with carbon dioxide is disclosed, for instance, in U.S. Pat. No. 7,238,651, Kocsis et al., Jul. 3, 2007, see, for instance, examples 10-13 and the claims. Other detergents, however, may also optionally be present, which need not be carbonated or need not be so highly overbased (i.e., of lower TBN). However, if multiple detergents are present, it is desirable that the overbased calcium or magnesium arylsulphonate detergent is present as the predominant amount by weight of the metal detergents, that is, at least 50 weight percent or at least 60 or 70 or 80 or 90 weight percent of the metal-containing detergents, on an oil free basis.

The lubricants may contain an overbased sulphonate detergent. Suitable sulphonic acids include sulphonic and thiosulphonic acids, including mono- or poly-nuclear aromatic or cycloaliphatic compounds. Certain oil-soluble sulphonates may be represented by R2-T-(SO3-)a or R3-(SO3-)b, where a and b are each at least one; T is a cyclic nucleus such as benzene or toluene; R2 is an aliphatic group such as alkyl, alkenyl, alkoxy, or alkoxyalkyl; (R2)-T typically contains a total of at least 15 carbon atoms; and R3 is an aliphatic hydrocarbyl group typically containing at least 15 carbon atoms. The groups T, R2, and R3 may also contain other inorganic or organic substituents; they may also be described as hydrocarbyl groups. In one embodiment the sulphonate detergent may be a predominantly linear alkylbenzenesulphonate detergent as described in paragraphs [0026] to [0037] of US Patent Application 2005-065045. In some embodiments, the linear alkyl (or hydrocarbyl) group may be attached to the benzene ring anywhere along the linear chain of the alkyl group, but often in the 2, 3, or 4 position of the linear chain, and in some instances predominantly in the 2 position. In other embodiments, the alkyl (or hydrocarbyl) group may be branched, that is, formed from a branched olefin such as propylene or 1-butene or isobutene. Sulphonate detergents having a mixture of linear and branched alkyl groups may also be used.

In certain embodiments, the carbonated calcium or magnesium arylsulphonate detergent may be based on an alkylated and sulphonated benzene; in another embodiment, it may be based on an alkylated and sulphonated toluene. In either case, there may be one or two or three, and in certain embodiments one, alkyl (or hydrocarbyl) group attached to the aromatic ring, in addition to the methyl group if toluene is used as the starting aromatic compound. In one embodiment, the detergent is a monoalkylbenzenemonosulphonate, and in another embodiment it is a monoalkyltoluenemonosulphonate. If there is one alkyl group, it may contain a sufficient number of carbon atoms to impart oil-solubility to the detergent, such as at least 8 carbon atoms, or 10 to 100 carbon atoms, or 10 to 50 carbon atoms, or 12 to 36 carbon atoms, or 14 to 24 or 16 to 20 or alternatively about 18 carbon atoms. If more than one alkyl group (other than methyl) is present, each alkyl group may have the afore-described number of carbon atoms, or all the alkyl groups together may have in total the afore-described number of carbon atoms, (e.g., two C12 alkyl groups for a total of 24 carbon atoms in the alkyl groups). Another type of overbased material that may additionally be present (that is, in addition to the arylsulphonate detergent) in certain embodiments of the present invention is an overbased phenate detergent. Certain commercial grades of calcium or magnesium sulphonate detergents contain minor amounts of calcium or magnesium phenate detergents to aid in their processing or for other reasons and may contain, for instance, 4% phenate substrate content and 96% sulphonate substrate content. The phenols useful in making phenate detergents may be represented by (R1)a-Ar—(OH)b, where R1 is an aliphatic hydrocarbyl group of 4 to 400 or 6 to 80 or 6 to 30 or 8 to 25 or 8 to 15 carbon atoms; Ar is an aromatic group such as benzene, toluene or naphthalene; a and b are each at least one, the sum of a and b being up to the number of displaceable hydrogens on the aromatic nucleus of Ar, such as 1 to 4 or 1 to 2. There is typically an average of at least 7 or 8 aliphatic carbon atoms provided by the R1 groups for each phenol compound, and in some instances about 12 carbon atoms. Phenate detergents are also sometimes provided as sulphur-bridged species or as methylene-bridged species. Sulphur-bridged species may be prepared by reacting a hydrocarbyl phenol with sulphur. Methylene-bridged species may be prepared by reacting a hydrocarbyl phenol with formaldehyde (or a reactive equivalent such as paraformaldehyde). Examples include sulphur-bridged dodecylphenol (overbased Ca salt) and methylene-coupled heptylphenol.

In another embodiment, an optional, additional overbased material is an overbased saligenin detergent. Overbased saligenin detergents are commonly overbased magnesium salts which are based on saligenin derivatives. A general example of such a saligenin derivative may be represented by the formula:

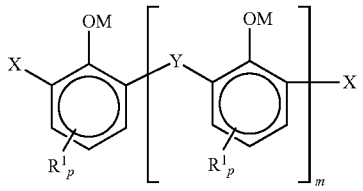

where X is —CHO or —$CH_2OH$, Y is —$CH_2$— or —$CH_2OCH_2$—, and the —CHO groups typically comprise at least 10 mole percent of the X and Y groups; M is hydrogen, ammonium, or a valence of a metal ion (that is, if M is multivalent, one of the valences is satisfied by the illustrated structure and other valences are satisfied by other species such as anions or by another instance of the same structure), $R_1$ is a hydrocarbyl group of 1 to 60 carbon atoms, m is 0 to typically 10, and each p is independently 0, 1, 2, or 3, provided that at least one aromatic ring contains an $R^1$ substituent and that the total number of carbon atoms in all $R^1$ groups is at least 7. When m is 1 or greater, one of the X groups may be hydrogen. In one embodiment, M is a valence (or equivalent) of an Mg ion or a mixture of Mg and hydrogen. Saligenin detergents are disclosed in greater detail in U.S. Pat. No. 6,310,009, with special reference to their methods of synthesis (Column 8 and Example 1) and preferred amounts of the various species of X and Y (Column 6).

Other optional detergents include salixarate detergents. Salixarate detergents are overbased materials that may be represented by a compound comprising at least one unit of formula (I) or formula (II):

(I)

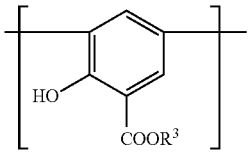

(II)

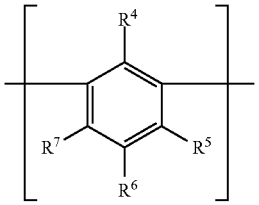

each end of the compound having a terminal group of formula (III) or (IV):

(III)

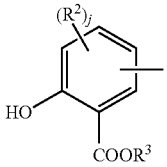

(IV)

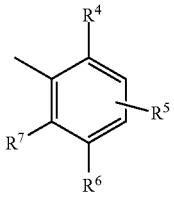

such groups being linked by divalent bridging groups A, which may be the same or different. In formulas (I)-(IV) $R^3$ is hydrogen, a hydrocarbyl group, or a valence of a metal ion; $R^2$ is hydroxyl or a hydrocarbyl group, and j is 0, 1, or 2; $R^6$ is hydrogen, a hydrocarbyl group, or a hetero-substituted hydrocarbyl group; either $R^4$ is hydroxyl and $R^5$ and $R^7$ are independently either hydrogen, a hydrocarbyl group, or hetero-substituted hydrocarbyl group, or else $R^5$ and $R^7$ are both hydroxyl and $R^4$ is hydrogen, a hydrocarbyl group, or a hetero-substituted hydrocarbyl group; provided that at least one of $R^4$, $R^5$, $R^6$ and $R^7$ is hydrocarbyl containing at least 8 carbon atoms; and wherein the molecules on average contain at least one of unit (I) or (III) and at least one of unit (II) or (IV) and the ratio of the total number of units (I) and (III) to the total number of units of (II) and (IV) in the composition is 0.1:1 to 2:1. The divalent bridging group "A," which may be the same or different in each occurrence, includes —$CH_2$— and —$CH_2OCH_2$—, either of which may be derived from formaldehyde or a formaldehyde equivalent (e.g., paraform, formalin).

Salixarate derivatives and methods of their preparation are described in greater detail in U.S. Pat. No. 6,200,936 and PCT Publication WO 01/56968. It is believed that the salixarate derivatives have a predominantly linear, rather than macrocyclic, structure, although both structures are intended to be encompassed by the term "salixarate." In one embodiment, a salixarate detergent may contain a portion of molecules represented (prior to neutralization) by the structure:

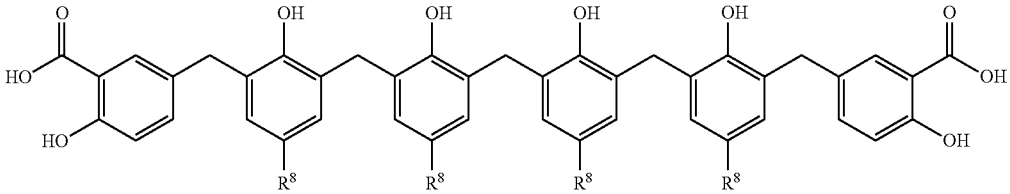

where the $R^8$ groups are independently hydrocarbyl groups containing at least 8 carbon atoms.

Glyoxylate detergents are also optional overbased materials. They are based on an anionic group which, in one embodiment, may have the structure:

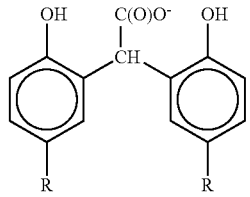

wherein each R is independently an alkyl group containing at least 4 or 8 carbon atoms, provided that the total number of carbon atoms in all such R groups is at least 12 or 16 or 24. Alternatively, each R may be an olefin polymer substituent. The acidic material upon from which the overbased glyoxylate detergent is prepared is the condensation product of a hydroxyaromatic material such as a hydrocarbyl-substituted phenol with a carboxylic reactant such as glyoxylic acid or another omega-oxoalkanoic acid. Overbased glyoxylic detergents and their methods of preparation are disclosed in greater detail in U.S. Pat. No. 6,310,011 and references cited therein.

Another optional overbased detergent is an overbased salicylate, e.g., an alkali metal or alkaline earth metal salt of a substituted salicylic acid. The salicylic acids may be hydrocarbyl-substituted wherein each substituent contains an average of at least 8 carbon atoms per substituent and 1 to 3 substituents per molecule. The substituents may be polyalkene substituents. In one embodiment, the hydrocarbyl substituent group contains 7 to 300 carbon atoms and may be an alkyl group having a molecular weight of 150 to 2000. Overbased salicylate detergents and their methods of preparation are disclosed in U.S. Pat. Nos. 4,719,023 and 3,372,116.

Other optional overbased detergents may include overbased detergents having a Mannich base structure, as disclosed in U.S. Pat. No. 6,569,818.

In certain embodiments, the hydrocarbyl substituents on hydroxy-substituted aromatic rings in the above detergents (e.g., phenate, saligenin, salixarate, glyoxylate, or salicylate) are free of or substantially free of C12 aliphatic hydrocarbyl groups (e.g., less than 1%, 0.1%, or 0.01% by weight of the substituents are C12 aliphatic hydrocarbyl groups). In some embodiments such hydrocarbyl substituents contain at least 14 or at least 18 carbon atoms.

Optionally, the lubricant may further include an additional phosphorus containing material and may include a metal salt of a phosphorus acid. Metal salts may have the formula:

$$[(R^8O)(R^9O)P(=S)-S]_n-M$$

where $R^8$ and $R^9$ are independently hydrocarbyl groups containing 3 to 30 carbon atoms, are readily obtainable by heating phosphorus pentasulfide ($P_2S_5$) and an alcohol or phenol to form an O,O-dihydrocarbyl phosphorodithioic acid. The alcohol which reacts to provide the $R^8$ and $R^9$ groups may be a mixture of alcohols, for instance, a mixture of isopropanol and 4-methyl-2-pentanol, and in some embodiments a mixture of a secondary alcohol and a primary alcohol, such as isopropanol and 2-ethylhexanol. The resulting acid may be reacted with a basic metal compound to form the salt. The metal M, having a valence n, generally is aluminum, tin, manganese, cobalt, nickel, zinc, or copper, and in many cases, zinc, to form zinc dialkyldithiophosphates. Such materials are well known and readily available to those skilled in the art of lubricant formulation. Suitable variations to provide low phosphorus volatility are disclosed, for instance, in US published application 2008-0015129, see, e.g., claims.

Alternatively, the lubricant may further include an additional phosphorus containing material and may include an amine or metal salt of a phosphorus compound (different from the salt of the present invention) may be amine salt of a phosphorus-containing acid or ester, or either (i) a hydroxy-substituted di-ester of (thio)phosphoric acid, or (ii) a phosphorylated hydroxy-substituted di- or tri-ester of (thio)phosphoric acid.

In one embodiment, the oil soluble phosphorus amine salt comprises partial amine salt-partial metal salt compounds or mixtures thereof. In one embodiment, the phosphorus compound further comprises a sulfur atom in the molecule. In one embodiment, the amine salt of the phosphorus compound is ashless, i.e., metal-free (prior to being mixed with other components).

The amines which may be suitable for use as the amine salt include primary amines, secondary amines, tertiary amines, and mixtures thereof. The amines include those with at least one hydrocarbyl group, or, in certain embodiments, two or three hydrocarbyl groups. The hydrocarbyl groups may contain about 2 to about 30 carbon atoms, or in another embodiment about 8 to about 26 or about 10 to about 20 or about 13 to about 19 carbon atoms.

Primary amines include ethylamine, propylamine, butylamine, 2-ethylhexylamine, octylamine, and dodecylamine, as well as such fatty amines as n-octylamine, n-decylamine, n-dodecylamine, n-tetradecylamine, n-hexadecylamine, n-octadecylamine and oleyamine. Other useful fatty amines include commercially available fatty amines such as "Armeen®" amines (products available from Akzo Chemicals, Chicago, Ill.), such as Armeen C, Armeen O, Armeen OL, Armeen T, Armeen HT, Armeen S and Armeen SD, wherein the letter designation relates to the fatty group, such as coco, oleyl, tallow, or stearyl groups.

Examples of suitable secondary amines include dimethylamine, diethylamine, dipropylamine, dibutylamine, diamylamine, dihexylamine, diheptylamine, methylethylamine, ethylbutylamine and ethylamylamine. The secondary amines may be cyclic amines such as piperidine, piperazine and morpholine.

The amine may also be a tertiary-aliphatic primary amine. The aliphatic group in this case may be an alkyl group containing about 2 to about 30, or about 6 to about 26, or about 8 to about 24 carbon atoms. Tertiary alkyl amines include monoamines such as tert-butylamine, tert-hexylamine, 1-methyl-1-amino-cyclohexane, tert-octylamine, tert-decylamine, tertdodecylamine, tert-tetradecylamine, tert-hexadecyl amine, tert-octadecylamine, tert-tetracosanylamine, and tert-octacosanylamine.

In one embodiment, the phosphorus acid amine salt comprises an amine with C11 to C14 tertiary alkyl primary groups or mixtures thereof. In one embodiment, the phosphorus acid amine salt comprises an amine with C14 to C18 tertiary alkyl primary amines or mixtures thereof. In one embodiment, the phosphorus acid amine salt comprises an amine with C18 to C22 tertiary alkyl primary amines or mixtures thereof.

Mixtures of amines may also be used in the invention. In one embodiment a useful mixture of amines is "Primene® 81R" and "Primene® JMT." Primene® 81R and Primene® JMT (both produced and sold by Rohm & Haas) are mixtures of C11 to C14 tertiary alkyl primary amines and C18 to C22 tertiary alkyl primary amines respectively.

In one embodiment, the hydrocarbyl amine salt of an alkylphosphoric acid ester is the reaction product of a C14 to C18 alkylated phosphoric acid with Primene 81R™ (produced and sold by Rohm & Haas) which is a mixture of C11 to C14 tertiary alkyl primary amines.

Examples of hydrocarbyl amine salts of dialkyldithiophosphoric acid esters include the reaction product(s) of isopropyl, methyl-amyl (4-methyl-2-pentyl or mixtures thereof), 2-ethylhexyl, heptyl, octyl or nonyl dithiophosphoric acids with ethylene diamine, morpholine, or Primene 81R™, and mixtures thereof.

In one embodiment, the dithiophosphoric acid may be reacted with an epoxide or a glycol. This reaction product is further reacted with a phosphorus acid, anhydride, or lower ester. The epoxide includes an aliphatic epoxide or a styrene oxide. Examples of useful epoxides include ethylene oxide, propylene oxide, butene oxide, octene oxide, dodecene oxide, styrene oxide and the like. In one embodiment, the epoxide is Propylene oxide. The glycols may be aliphatic glycols having from 1 to about 12, or from about 2 to about 6, or about 2 to about 3 carbon atoms. The dithiophosphoric acids, glycols, epoxides, inorganic phosphorus reagents and methods of reacting the same are described in U.S. Pat. Nos. 3,197,405 and 3,544,465. The resulting acids may then be salted with amines. An example of suitable dithiophosphoric acid is prepared by adding phosphorus pentoxide (about 64 grams) at about 58° C. over a period of about 45 minutes to about 514 grams of hydroxypropyl O,O-di(4-methyl-2-pentyl)phosphorodithioate (prepared by reacting di(4-methyl-2-pentyl)-phosphorodithioic acid with about 1.3 moles of propylene oxide at about 25° C.). The mixture is heated at about 75° C. for about 2.5 hours, mixed with a diatomaceous earth and filtered at about 70° C. The filtrate contains about 11.8% by weight phosphorus, about 15.2% by weight sulfur, and an acid number of 87 (bromophenol blue).

If the additional phosphorus containing material is present it may provide 1% to 90%, or 10 to 80%, or 20 to 70% of the total amount of phosphorus to the lubricant. In one embodiment, the additional phosphorus containing material is present, and in one embodiment the additional phosphorus containing material is present is absent.

The lubricant may further include an antioxidant, or mixtures thereof. The antioxidant may include molybdenum compounds such as molybdenum dithiocarbamates, sulphurised olefins, hindered phenols, aminic compounds such as alkylated diphenylamines (typically di-nonyl diphenylamine, octyl diphenylamine, or di-octyl diphenylamine). When present, the antioxidant may be present at 0 to 3 wt %, or 0.1 to 2.5 wt %, or 0.2 to 1.5 wt %.

Lubricant for Hypoid Gear Break-In

Hypoid gears are a type of spiral bevel gear in which the axes of the mating gears do not intersect, i.e. they transmit motion between two non-intersecting shafts. Hypoid gears are used in torque-demanding, low speed and heavy load transmission applications. In the main, they are used in automotive drive applications such as in differential gears and, for example, are common in truck drive differentials. Hypoid gears are commonly found in a rear drive axle. Hypoid gear break-in is an important factor in the operational longevity of a hypoid gear set; inadequate break-in can contribute to early failures. The aim of breaking in new gears is to establish highly polished rubbing faces in the gears without failure of the gears or damage due to excessive wear or to seizure, scuffing scoring, and the like during the break-in period. However, material generated during break-in can cause etching, scoring or pitting to the contact surfaces (rubbing faces). The presence of this material is undesirable in gear oil. The contaminated gear oil may have to be discarded and replaced by fresh gear oil. This is a problem for hypoid gears in particular. Objects of the invention include the provision of an additive and/or lubricating composition that aids the break-in process for lubricated gears, in particular hypoid gears. The aiding of the break-in process can be, for example, by way of reducing the amount of material collected in the oil during the break-in period and/or reducing wear of the gears during the break-in period and/or lengthening the lifetime of the break-in gear oil and/or obviating the need to change gear oil after the break-in period.

In one embodiment, the invention is directed towards additives and/or lubricating compositions that are useful in achieving one or more of these aims. It has been found that the (thio)phosphoric acid salts as described herein are effective at reducing wear during the break-in period for hypoid gears. These benefits can be observed during the first stage of a 2 stage steady state test typical of hypoid gear durability testing (for instance ASTM D6121). The first stage is a 65 minute break in stage run at high speed, low load to allow break-in of the gears before the durability stage is run.

Thus the invention provides for a method of breaking-in gears comprising lubricating them with a lubricant comprising an oil of lubricating viscosity and a (thio)phosphoric acid salt of an N-hydrocarbyl-substituted gamma- (γ-) or delta- (δ-) amino(thio)ester, wherein the amino group is separated from the ester group by a chain of at least 3 carbon atoms during a break-in period. Thus the invention provides for the use of a (thio)phosphoric acid salt of an N-hydrocarbyl-substituted gamma- (γ-) or delta- (δ-)amino(thio) ester, wherein the amino group is separated from the ester group by a chain of at least 3 carbon atoms as an antiwear agent in a lubricant during the break-in of gears. The lubricant can be a gear lubricant as described above.

The gears can be new in that they have not yet been operated sufficiently so that they are worn in or broken-in in the sense of having developed mutually interfitting smooth highly polished rubbing surfaces. The gears can be used but may require further break-in in order to be able to operate in a heavier load regime. The break-in period is the time it takes to obtain smooth highly polished rubbing surfaces under the break-in conditions (e.g., load conditions). The gears are lubricated gears and these include hypoid gears.

In certain embodiments, the N-hydrocarbyl-substituted aminoester is a methyl succinic acid diester, with amine substitution on the methyl group and is represented by the structure:

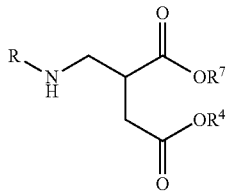

where R, $R^4$ and $R^7$ are as defined above; and $R^4$ and $R^7$ may be the same or different. Thus the amino(thio)ester comprises a 2-((hydrocarbyl)aminomethyl) succinic acid dihydrocarbyl ester. It has been found that (thio)phosphoric acid salts of these amino(thio)esters are particularly effective in reducing wear of hypoid gears during the break-in period. This can be evidenced by monitoring the levels of Fe present in the gear oil during the break-in period. It has been found that the (thio)phosphoric acid salt of a 2-((hydrocarbyl) aminomethyl) succinic acid dihydrocarbyl ester is particularly effective at keeping the Fe levels low in the gear oil during break-in. In one embodiment, R is chosen from the group consisting of isopropyl, cyclopropyl, sec-butyl, isobutyl, t-butyl, 1-ethylpropyl, 1,2-dimethylpropyl, neopentyl, cyclohexyl, 4-heptyl, 2-ethyl-1-hexyl (commonly referred to as 2-ethylhexyl), t-octyl (for instance, 1,1-dimethyl-1-hexyl), 4-heptyl, 2-propylheptyl, adamantyl, and α-methylbenzyl. In one embodiment, m is 0 and R on the amine nitrogen is chosen from the group consisting of t-butyl, 2-ethyl-1-hexyl (commonly referred to as 2-ethylhexyl) and α-methylbenzyl.

In certain embodiments, the N-hydrocarbyl-substituted aminoester may be represented by the structure:

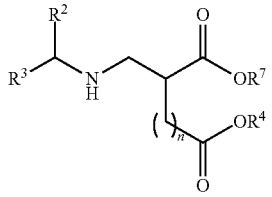

wherein n is 1, $R^2$ and $R^3$ are independently hydrocarbyl groups or together form a carbocyclic structure, $R^4$ and $R^7$ are independently hydrocarbyl groups of 1 to 30 or 1 to 12 carbon atoms. For example one of $R^2$ and $R^3$ can be an aromatic ring such as benzene ring and one of $R^2$ and $R^3$ can be an alkyl group. In certain embodiments, n is 1, $R^2$ and $R^3$ are independently alkyl groups of 1 to 6 carbon atoms and $R^4$ and $R^7$ are independently alkyl groups of 1 to 12 carbon atoms.

In other embodiments, the N-hydrocarbyl-substituted aminoester may be represented by the structure:

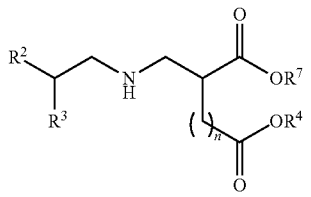

wherein n is 1, $R^2$, $R^3$, $R^4$ and $R^7$ are as defined aboved.

In certain embodiments N-hydrocarbyl-substituted aminoester may be represented by the structure:

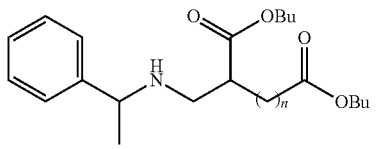

wherein n is 1.

The (thio)phosphoric acid is as described above. In certain embodiments, the (thio)phosphoric acid is a mono- or di-hydrocarbyl (thio)phosphoric acid. In one embodiment, the (thio)phosphoric acid is a mixed alkyl alkoxy (thio) phosphoric acid obtained/obtainable by reacting material such as $P_2O_5$, $P_4O_{10}$, $P_2S_5$, $P_4S_{10}$ or other compounds known in the art with mono-alcohol and/or diol. The mole ratio of mono-alcohol to diol may range from 3:1 to 10:1, or 3.5:1 to 10:1, or 4:1 to 10:1, or 5:1 to 7:1. In one embodiment, the ratio of mono-alcohol to diol is in the range of 5:1 to 7:1. It has been found that when the (thio)phosphoric acid is a mixed alkyl alkoxy (thio)phosphoric acid obtained/obtainable by reacting material such as $P_2O_5$, $P_4O_{10}$, $P_2S_5$, $P_4S_{10}$, or other compounds known in the art with a mono-alcohol and diol mixture, it is particularly effective in reducing wear of hypoid gears during the break-in period. Further, it has been found that the (thio)phosphoric acid salt of a 2-((hydrocarbyl)-aminomethyl) succinic acid dihydrocarbyl ester is particularly effective at keeping the Fe levels low when the (thio)phosphoric acid is a mixed alkyl alkoxy (thio)phosphoric acid obtained/obtainable by reacting material such as $P_2O_5$, $P_4O_{10}$, $P_2S_5$, $P_4S_{10}$, or other compounds known in the art with a mono-alcohol and diol mixture.

Gear Lubricant

In one embodiment, the invention provides a lubricant composition comprising:

an oil of lubricating viscosity, 0.1 wt % to 6 wt % (or 0.1 to 3 wt %, or 0.2 to 2 wt %, or 0.5 to 1.9 wt %) of a (thio)phosphoric acid salt of an N-hydrocarbyl-substituted gamma- (γ-) or delta- (δ-) amino (thio)ester, an olefin sulphide (typically present at (0.1 to 5 wt %, or 0.2 to 4.5 wt %, or 0.5 to 4 wt %, or 1 to 3 wt %, a dispersant typically present at 0.1 to 2 wt %, or 0.2 to 1.7 wt %, or 0.5 to 1.5 wt %, or 0.75 to 1.5 wt %, and a thiadiazole, typically present at 0.1 to 0.5 wt %, or 0.2 to 0.4 wt %, or 0.25 to 0.35 wt %.

In one embodiment, the (thio)phosphoric acid salt of an N-hydrocarbyl-substituted gamma- (γ-) or delta- (δ-)amino (thio)ester is a phosphoric acid salt of an N-hydrocarbyl-substituted gamma- (γ-) or delta- (δ-)aminoester i.e., free of sulphur.

The lubricant may have 100 to 2000 ppm, or 200 to 1800 ppm, 500 to 1500 ppm, or 600 to 950 ppm of phosphorus delivered by an antiwear agent i.e., delivered by the salt of the present invention, and/or an additional phosphorus-containing antiwear agent.

The lubricant may have a sulphur content of 0.3 to 5 wt %, 0.5 to 4 wt %, 1 wt 3.5 wt %, 1.5 to 3 wt %.

In one embodiment, the invention provides a method of lubricating a gear or gearbox or axle gear comprising supplying to the gear or gearbox, a differential, a limited slip differential a lubricant composition comprising:

an oil of lubricating viscosity, 0.01 wt % to 15 wt % (or 0.05 to 10 wt %, or 0.1 wt % to 5 wt %, or 0.2 to 1 wt %) of a (thio)phosphoric acid salt of an N-hydrocarbyl-substituted gamma- (γ-) or delta- (δ-) amino(thio)ester, an olefin sulphide (typically present at (0.1 to 5 wt %, or 0.2 to 4.5 wt %, or 0.5 to 4 wt %, or 1 to 3 wt %, a dispersant typically present at 0.1 to 2 wt %, or 0.2 to 1.7 wt %, or 0.5 to 1.5 wt %, or 0.75 to 1.5 wt %, a thiadiazole, typically present at 0.1 to 0.5 wt %, or 0.2 to 0.4 wt %, or 0.25 to 0.35 wt %.

The lubricant may contain a succinimide dispersant, typically a borated or non-borated succinimide.

As described above, the non-borated may be a polyisobutylene succinimide, wherein the polyisobutylene of the borated polyisobutylene succinimide has a number average molecular weight of 750 to 2200, or 750 to 1350, or 750 to 1150.

As described above, the borated and non-borated polyisobutylene succinimide are known in the art and may be prepared with a polyisobutylene having a number average molecular weight of 950.

The dispersant may also include a succinimide dispersant that is functionalized with a dimercaptothiadiazole as is described for example in U.S. Pat. No. 4,136,043 and their methods of preparation. The dimercaptothiadiazole may be 2,5-bis(tert-octyldithio)-1,3,4-thiadiazole, 2,5-bis(tert-nonyldithio)-1,3,4-thiadiazole, or 2,5-bis(tert-decyldithio)-1,3,4-thiadiazole.

In one embodiment, the lubricant may contain both the borated and non-borated polyisobutylene succinimide.

In one embodiment, the lubricant may contain both the non-borated polyisobutylene succinimide and the succinimide dispersant that is functionalized with a dimercaptothiadiazole.

The olefin sulphide may include a polysulphide or a sulphurised olefin such as sulphurised isobutylene, or mixtures thereof.

In one embodiment, the olefin sulphide includes a polysulphide.

In one embodiment, the olefin sulphide includes sulphurized isobutylene.

In one embodiment, the olefin sulphide includes a mixture of a sulphurised isobutylene and a polysulphide.

In one embodiment, at least 50 wt % of the polysulphide molecules are a mixture of tri- or tetra-sulphides. In other embodiments, at least 55 wt %, or at least 60 wt % of the polysulphide molecules are a mixture of tri- or tetra-sulphides.

The polysulphide includes a sulphurized organic polysulphide from oils, fatty acids or ester, olefins or polyolefins.

Oils which may be sulfurized include natural or synthetic oils such as mineral oils, lard oil, carboxylate esters derived from aliphatic alcohols and fatty acids or aliphatic carboxylic acids (e.g., myristyl oleate and oleyl oleate), and synthetic unsaturated esters or glycerides.

Fatty acids include those that contain 8 to 30, or 12 to 24 carbon atoms. Examples of fatty acids include oleic, linoleic, linolenic, and tall oil. Sulphurised fatty acid esters prepared from mixed unsaturated fatty acid esters such as are obtained from animal fats and vegetable oils, including tall oil, linseed oil, soybean oil, rapeseed oil, and fish oil.

The polysulphide includes olefins derived from a wide range of alkenes. The alkenes typically have one or more double bonds. The olefins in one embodiment contain 3 to 30 carbon atoms. In other embodiments, olefins contain 3 to 16, or 3 to 9 carbon atoms. In one embodiment the sulphurised olefin includes an olefin derived from propylene, isobutylene, pentene or mixtures thereof.

In one embodiment, the polysulphide comprises a polyolefin derived from polymerizing by known techniques, an olefin as described above.

In one embodiment, the polysulphide includes dibutyl tetrasulphide, sulphurised methyl ester of oleic acid, sulphurised alkylphenol, sulphurised dipentene, sulphurised dicyclopentadiene, sulphurised terpene, and sulphurised Diels-Alder adducts.

The lubricant may also include a thiadiazole compound, or mixtures thereof. The thiadiazole compound may include mono- or di-hydrocarbyl substituted 2,5-dimercapto-1,3,4-thiadiazole compounds. Examples of a thiadiazole include 2,5-dimercapto-1,3,4-thiadiazole, or oligomers thereof, a hydrocarbyl-substituted 2,5-dimercapto-1,3,4-thiadiazole, a hydrocarbylthio-substituted 2,5-dimercapto-1,3,4-thiadiazole, or oligomers thereof. The oligomers of hydrocarbyl-substituted 2,5-dimercapto-1,3,4-thiadiazole typically form by forming a sulphur-sulphur bond between 2,5-dimercapto-1,3,4-thiadiazole units to form oligomers of two or more of said thiadiazole units. These thiadiazole compounds may also be used in the post treatment of dispersants as mentioned below in the formation of a dimercaptothiadiazole derivative of a polyisobutylene succinimide.

Examples of a suitable thiadiazole compound include at least one of a dimercaptothiadiazole, 2,5-dimercapto-[1,3,4]-thiadiazole, 3,5-dimercapto-[1,2,4]-thiadiazole, 3,4-dimercapto-[1,2,5]-thiadiazole, or 4-5-dimercapto-[1,2,3]-thiadiazole. Typically readily available materials such as 2,5-dimercapto-1,3,4-thiadiazole or a hydrocarbyl-substituted 2,5-dimercapto-1,3,4-thiadiazole or a hydrocarbylthio-substituted 2,5-dimercapto-1,3,4-thiadiazole are commonly utilized.

The lubricant may optionally include an antioxidant such as molybdenum compounds such as molybdenum dithiocarbamates, sulphurised olefins, hindered phenols, aminic compounds such as alkylated diphenylamines (typically di-nonyl diphenylamine, octyl diphenylamine, or di-octyl diphenylamine).

The lubricant may optionally include a detergent that may include neutral or overbased detergents, Newtonian or non-Newtonian, basic salts of alkali, alkaline earth or transition metals with one or more of a phenate, a sulphurised phenate, a sulphonate, a carboxylic acid, a phosphorus acid, a mono- and/or a di-thiophosphoric acid, a saligenin, an alkylsalicylate, and a salixarate.

The lubricant may optionally include a viscosity modifier described above.

In one embodiment, the lubricant composition contains a phosphorus compound that may be an amine salt of a phosphorus acid (i.e., an amine salt of a hydrocarbon ester of phosphoric acid different from the salt of the present invention). The amine salt of a phosphorus acid may be derived from an amine salt of a phosphate. The amine salt of the phosphate hydrocarbon ester may be represented by the formula:

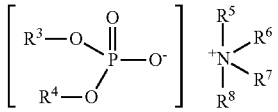

wherein $R^3$ and $R^4$ may be independently hydrogen or hydrocarbon typically containing 4 to 40, or 6 to 30, or 6 to 18, or 8 to 18 carbon atoms, with the proviso that at least one is a hydrocarbon group; and $R^5$, $R^6$, $R^7$ and $R^8$ may be independently hydrogen or a hydrocarbyl group, with the proviso that at least one is a hydrocarbyl group.

The hydrocarbon groups of $R^3$ and/or $R^4$ may be linear, branched, or cyclic.

Examples of a hydrocarbon group for $R^3$ and/or $R^4$ include straight-chain or branched alkyl groups include methyl, ethyl, propyl, butyl, pentyl, hexyl, heptyl, octyl, nonyl, decyl, undecyl, dodecyl, tridecyl, tetradecyl, pentadecyl, hexadecyl, heptadecyl and octadecyl.

Examples of a cyclic hydrocarbon group for $R^3$ and/or $R^4$ include cyclopentyl, cyclohexyl, cycloheptyl, methylcyclopentyl, dimethylcyclopentyl, methylcyclopentyl, dimethylcyclopentyl, methylethylcyclopentyl, diethylcyclopentyl, methylcyclohexyl, dimethylcyclohexyl, methylethylcyclohexyl, diethylcyclohexyl, methylcycloheptyl, dimethylcycloheptyl, methylethylcycloheptyl, and diethylcycloheptyl.

In one embodiment, the phosphate may be an amine salt of a mixture of monoalkyl and dialkyl phosphoric acid esters. The monoalkyl and dialkyl groups may be linear or branched.

The amine salt of a phosphorus acid may be derived from an amine such as a primary amine, a secondary amine, a tertiary amine, or mixtures thereof. The amine may be aliphatic, or cyclic, aromatic or non-aromatic, typically aliphatic. In one embodiment, the amine includes an aliphatic amine such as a tertiary-aliphatic primary amine.

Examples of suitable primary amines include ethylamine, propylamine, butylamine, 2-ethylhexylamine, bis-(2-ethylhexyl)amine, octylamine, and dodecyl-amine, as well as such fatty amines as n-octylamine, n-decylamine, n-dodecylamine, n-tetradecylamine, n-hexadecylamine, n-octadecylamine and oleyamine. Other useful fatty amines include commercially available fatty amines such as "Armeen®" amines (products available from Akzo Chemicals, Chicago, Ill.), such as Armeen C, Armeen O, Armeen OL, Armeen T, Armeen HT, Armeen S and Armeen SD, wherein the letter designation relates to the fatty group, such as coco, oleyl, tallow, or stearyl groups.

Examples of suitable secondary amines include dimethylamine, diethylamine, dipropylamine, dibutylamine, diamylamine, dihexylamine, diheptylamine, methylethylamine, ethylbutylamine, N-methyl-1-amino-cyclohexane, Armeen® 2C and ethylamylamine. The secondary amines may be cyclic amines such as piperidine, piperazine and morpholine.

Examples of tertiary amines include tri-n-butylamine, tri-n-octylamine, tri-decylamine, tri-laurylamine, tri-hexadecylamine, and dimethyloleylamine (Armeen® DMOD).

In one embodiment, the amines are in the form of a mixture. Examples of suitable mixtures of amines include (i) a tertiary alkyl primary amine with 11 to 14 carbon atoms, (ii) a tertiary alkyl primary amine with 14 to 18 carbon atoms, or (iii) a tertiary alkyl primary amine with 18 to 22 carbon atoms. Other examples of tertiary alkyl primary amines include tert-butylamine, tert-hexylamine, tert-octylamine (such as 1,1-dimethylhexylamine), tert-decylamine (such as 1,1-dimethyloctylamine), tertdodecylamine, tert-tetradecylamine, tert-hexadecylamine, tert-octadecylamine, tert-tetracosanylamine, and tert-octacosanylamine.

In one embodiment, a useful mixture of amines is "Primene® 81R" or "Primene® JMT." Primene® 81R and Primene® JMT (both produced and sold by Rohm & Haas) are mixtures of C11 to C14 tertiary alkyl primary amines and C18 to C22 tertiary alkyl primary amines respectively.

The amine salt of a phosphorus acid may be prepared as is described in U.S. Pat. No. 6,468,946. Column 10, lines 15 to 63 describes phosphoric acid esters formed by reaction of phosphorus compounds, followed by reaction with an amine to form an amine salt of a phosphate hydrocarbon ester. Column 10, line 64, to column 12, line 23, describes preparative examples of reactions between phosphorus pentoxide with an alcohol (having 4 to 13 carbon atoms), followed by a reaction with an amine (typically Primene®81-R) to form an amine salt of a phosphorus acid ester.

In one embodiment, the lubricant composition contains a phosphite having at least one hydrocarbyl group with 4 or more carbon atoms. In one embodiment, the lubricant composition contains a phosphite having at least one hydrocarbyl group with 8 or more, or 12 or more carbon atoms. Typical ranges for the number of carbon atoms on the hydrocarbyl group include 4 to 30, or 10 to 24, or 12 to 22, or 14 to 20, or 16 to 18. The phosphite may be a monohydrocarbyl substituted phosphite, a di-hydrocarbyl substituted phosphite, or a tri-hydrocarbyl substituted phosphite.

The phosphite having at least one hydrocarbyl group with 4 or more carbon atoms may be represented by the formulae:

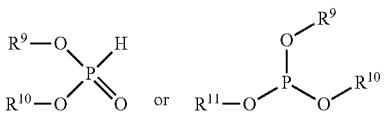

wherein at least one or two of $R^9$, $R^{10}$ and $R^{11}$ may be a hydrocarbyl group containing at least 4 carbon atoms and the other may be hydrogen or a hydrocarbyl group. In one embodiment two or more of $R^9$, $R^{10}$ and $R^{11}$ are hydrocarbyl groups. The hydrocarbyl groups may be alkyl, cycloalkyl, aryl, acyclic or mixtures thereof. In the formula with all these groups $R^9$, $R^{10}$ and $R^{11}$, the compound may be a tri-hydrocarbyl substituted phosphite i.e., $R^9$, $R^{10}$ and $R^{11}$ are all hydrocarbyl groups.

Alkyl groups may be linear or branched, typically linear, and saturated or unsaturated, typically saturated. Examples of alkyl groups for $R^9$, $R^{10}$ and $R^{11}$ include butyl, hexyl, octyl, 2-ethylhexyl, nonyl, decyl, undecyl, dodecyl, tridecyl, tetradecyl, pentadecyl, hexadecyl, heptadecyl, octadecyl, octadecenyl, nonodecyl, eicosyl or mixtures thereof.

Alkyl groups may be linear or branched, typically linear, and saturated or unsaturated, typically saturated. Examples of alkyl groups for $R^9$, $R^{10}$ and $R^{11}$ include butyl, hexyl, octyl, 2-ethylhexyl, nonyl, decyl, undecyl, dodecyl, tridecyl, tetradecyl, pentadecyl, hexadecyl, heptadecyl, octadecyl, octadecenyl, nonodecyl, eicosyl or mixtures thereof. In one embodiment, the alkyl groups $R^9$ and $R^{10}$ have 4 carbon atoms (typically n-butyl).

The amine salt of a phosphorus acid and/or, a phosphite having at least one hydrocarbyl group with 4 or more carbon atoms may in one embodiment be in a mixture with one or more of phosphorus acid, phosphoric acid, polyphosphoric acid, a trialkyl phosphate or trialkyl thiophosphate. For instance, the amine salt of a phosphorus acid and/or, a phosphite having at least one hydrocarbyl group with 4 or more carbon atoms may in one embodiment be in a mixture with phosphoric acid.

Automatic Transmission Lubricants

In one embodiment, the invention provides a lubricant composition comprising:

an oil of lubricating viscosity, 0.01 wt % to 15 wt % (or 0.05 to 10 wt %, or 0.1 wt % to 5 wt %, or 0.2 to 1 wt %, or 0.1 to 6 wt %, or 0.1 to 3 wt %, or 0.2 to 2 wt %, or 0.5 to 1.9 wt %, or 0.1 to 1.5 wt %, or 1.6 wt % to 3 wt %) of a (thio)phosphoric acid salt of an N-hydrocarbyl-substituted gamma- (γ-) or delta- (δ-)amino (thio)ester, a dispersant typically present at 0.01 to 5 wt %, or 0.05 to 3 wt %, or 0.1 to 3 wt %, or 0.1 to 2 wt %, a phosphorus-containing antiwear agent chosen from (i) a non-ionic phosphorus compound, which may be a hydrocarbyl phosphite; or (ii) an amine salt of a phosphorus compound, a calcium-containing detergent, typically present in an amount to deliver 110 to 700 ppm, 130 to 600 ppm, 150 to 500 ppm or 160 to 400 ppm calcium, and a friction modifier typically present at 0 to 4 wt %, or 0.1 to 4 wt %, 0.2 to 3 wt %, 0.3 to 3 wt %, 0.25 to 2.5 wt %. In one embodiment, the friction modifier is present, and in an alternative embodiment the friction modifier is not present.

In one embodiment, the invention provides a method of lubricating an automatic transmission comprising supplying to the automatic transmission a lubricant composition comprising:

an oil of lubricating viscosity, 0.01 wt % to 15 wt % (or 0.05 to 10 wt %, or 0.1 wt % to 5 wt %, or 0.2 to 1 wt %) of a (thio)phosphoric acid salt of an N-hydrocarbyl-substituted gamma- (γ-) or delta- (δ-) amino(thio)ester, a dispersant typically present at 0.5 to 5 wt %, or 1 to 4 wt %, or 1.5 to 4 wt %, or 1.5 to 3 wt %, a phosphorus-containing antiwear agent chosen from (i) a non-ionic phosphorus compound, which may be a hydrocarbyl phosphite; or (ii) an amine salt of a phosphorus compound, a calcium-containing detergent, typically present in an amount to deliver 110 to 700 ppm, 130 to 600 ppm, 150 to 500 ppm or 160 to 400 ppm calcium, and a friction modifier typically present at 0 to 4 wt %, 0.1 to 4 wt %, 0.2 to 3 wt %, 0.3 to 3 wt %, 0.25 to 2.5 wt %.

The automatic transmission includes continuously variable transmissions (CVT), infinitely variable transmissions (IVT), Toroidal transmissions, continuously slipping torque converted clutches (CSTCC), stepped automatic transmissions or dual clutch transmissions (DCT).

The calcium-containing detergent may be an overbased detergent, a non-overbased detergent, or mixtures thereof. Typically the detergent may be overbased.

The preparation of the calcium-containing detergent is known in the art. Patents describing the preparation of overbased calcium-containing detergents include U.S. Pat. Nos. 2,501,731; 2,616,905; 2,616,911; 2,616,925; 2,777,874; 3,256,186; 3,384,585; 3,365,396; 3,320,162; 3,318,809; 3,488,284; and 3,629,109.

As used herein, the TBN values quoted and associated range of TBN is on "an as is basis," i.e., containing conventional amounts of diluent oil. Conventional amounts of diluent oil typically range from 30 wt % to 60 wt % (often 40 wt % to 55 wt %) of the detergent component.

A more detailed description of the expressions "metal ratio", TBN and "soap content" are known to a person skilled in the art and explained in standard textbook entitled "Chemistry and Technology of Lubricants", Third Edition, Edited by R. M. Mortier and S. T. Orszulik, Copyright 2010, pages 219 to 220 under the sub-heading 7.2.5. Detergent Classification.

The calcium-containing detergent may be a non-overbased detergent (may also be referred to as a neutral detergent). The TBN of a non-overbased may be 20 to less than 200, or 30 to 100, or 35 to 50 mg KOH/g. The TBN of a non-overbased calcium-containing detergent may also be 20 to 175, or 30 to 100 mg KOH/g. When a non-overbased calcium-containing detergent is prepared from a strong acid such as a hydrocarbyl-substituted sulphonic acid, the TBN may be lower (for example, 0 to 50 mg KOH/g, or 10 to 20 mg KOH/g).

The calcium-containing detergent may be an overbased detergent, which may have a TBN of greater than 200 mg KOH/g (typically 250 to 600, or 300 to 500 mg KOH/g).

The calcium-containing detergent may be formed by the reaction of a basic calcium compound and an acidic detergent substrate. The acidic detergent substrate may include an alkyl phenol, an aldehyde-coupled alkyl phenol, a sulphurised alkyl phenol, an alkyl aromatic sulphonic acid (such as, alkyl naphthalene sulphonic acid, alkyl toluene sulphonic acid or alkyl benzene sulphonic acid), an aliphatic carboxylic acid, a calixarene, a salixarene, an alkyl salicylic acid, or mixtures thereof.

The metal basic compound is used to supply basicity to the detergent. The basic calcium compound is a compound of a hydroxide or oxide of the metal.

The oxides and/or hydroxides may be used alone or in combination. The oxides or hydroxides may be hydrated or dehydrated, although hydrated is typical. In one embodiment, the basic calcium compound may be calcium hydroxide, which may be used alone or mixtures thereof with other metal basic compounds. Calcium hydroxide is often referred to as lime. In one embodiment, the metal basic compound may be calcium oxide which may be used alone or mixtures thereof with other metal basic compounds.

Collectively, when the alkyl phenol, the aldehyde-coupled alkyl phenol, and the sulphurised alkyl phenol are used to prepare a calcium-containing detergent, the detergent may be referred to as a calcium phenate. The calcium phenate may be an alkyl phenate, an aldehyde-coupled alkyl phenate, a sulphurised alkyl phenate, or mixtures thereof.

The TBN of a calcium phenate may vary from less 200, or 30 to 175 typically 150 to 175) mg KOH/g for a neutral phenate to 200 or more to 500, or 210 to 400 (typically 230 to 270) mg KOH/g for an overbased phenate.

The alkyl group of a phenate (i.e., an alkyl phenate) may contain 4 to 80, or 6 to 45, or 8 to 20, or 9 to 15 carbon atoms.

In one embodiment, the calcium-containing detergent may be a sulphonate, or mixtures thereof. The sulphonate may be prepared from a mono- or di-hydrocarbyl-substituted benzene (or naphthalene, indenyl, indanyl, or bicyclopentadienyl) sulphonic acid, wherein the hydrocarbyl group may contain 6 to 40, or 8 to 35 or 9 to 30 carbon atoms.

The hydrocarbyl group may be derived from polypropylene or a linear or branched alkyl group containing at least 10 carbon atoms. Examples of a suitable alkyl group include branched and/or linear decyl, undecyl, dodecyl, tridecyl, tetradecyl, pentadecyl, hexadecyl, heptadecyl, octadecyl, octadecenyl, nonodecyl, eicosyl, un-eicosyl, do-eicosyl, tri-eicosyl, tetra-eicosyl, penta-eicosyl, hexa-eicosyl or mixtures thereof.

In one embodiment, the hydrocarbyl-substituted sulphonic acid may include polypropene benzenesulphonic acid and/or $C_{16}$-$C_{24}$ alkyl benzenesulphonic acid, or mixtures thereof.

In one embodiment, a calcium sulphonate detergent may be a predominantly linear alkylbenzene sulphonate detergent having a metal ratio of at least 8 as is described in paragraphs [0026] to [0037] of US Patent Application 2005065045 (and granted as U.S. Pat. No. 7,407,919). In some embodiments, the linear alkyl group may be attached to the benzene ring anywhere along the linear chain of the alkyl group, but often in the 2, 3 or 4 position of the linear chain, and in some instances predominantly in the 2 position.

When neutral or slightly basic, a calcium sulphonate detergent may have TBN of less than 100, or less than 75, typically 20 to 50 mg KOH/g, or 0 to 20 mg KOH/g.

When overbased, a calcium sulphonate detergent may have a TBN greater than 200, or 300 to 550, or 350 to 450 mg KOH/g.

The detergent may be borated or non-borated.

Chemical structures for sulphonates, and phenates detergents are known to a person skilled in the art. The standard textbook entitled "Chemistry and Technology of Lubricants", Third Edition, Edited by R. M. Mortier and S. T. Orszulik, Copyright 2010, pages 220 to 223 under the sub-heading 7.2.6 provide general disclosures of said detergents and their structures.

In one embodiment, the calcium-containing detergent may be an overbased calcium sulphonate, an overbased calcium phenate, or mixtures thereof. Typically the detergent may be an overbased calcium sulphonate.

In one embodiment, the calcium-containing detergent may be in a mixture with a having zinc-, barium-, sodium-, or magnesium-containing detergent. The zinc-, barium-, sodium-, or magnesium-containing detergent is also well known in the art and described in the same references describing a calcium-containing detergent. The TBN and metal ratios may however, differ slightly. The zinc-, barium-, sodium-, or magnesium-containing detergent may be a phenate, a sulphur-containing phenate, sulphonate, salixarate or salicylate. Typically a zinc-, barium-, sodium-, or magnesium-containing detergent may be a magnesium phenate, a magnesium sulphur-containing phenate, or a magnesium sulphonate.

The dispersant is described above.

In one embodiment, the dispersant may be a mixture comprising:

(i) a non-borated dispersant that comprises a polyisobutylene succinimide, wherein the polyisobutylene used to prepare the non-borated dispersant has a number average molecular weight of 550 to 1150, or 750 to 1150, or 900 to 1000 (often commercially available with a number average molecular weight of about 950); and (ii) a borated dispersant that comprises a polyisobutylene succinimide, wherein the polyisobutylene used to prepare the non-borated dispersant has a number average molecular weight of 550 to 1150, or 750 to 1150, or 900 to 1000 (often commercially available with a number average molecular weight of about 950).

In one embodiment, the dispersant may be a mixture comprising:

(a) a non-borated dispersant that comprises a polyisobutylene succinimide, wherein the polyisobutylene used to prepare the non-borated dispersant has a number average molecular weight of 550 to 1150, or 750 to 1150, or 900 to 1000 (often commercially available with a number average molecular weight of about 950); and (b) a borated dispersant may also be a product prepared by heating together:

(i) a dispersant substrate;

(ii) 2,5-dimercapto-1,3,4-thiadiazole or a hydrocarbyl-substituted 2,5-di-mercapto-1,3,4-thiadiazole, or oligomers thereof;

(iii) a borating agent; and (iv) optionally a dicarboxylic acid of an aromatic compound chosen from 1,3 diacids and 1,4 diacids; or (v) optionally a phosphorus acid compound, said heating being sufficient to provide a product of (i), (ii), (iii) and optionally (iv) or (v), which is soluble in an oil of lubricating viscosity.

The lubricant composition may include a friction modifier, typically at least two friction modifiers. Useful friction modifiers are described below.

In one embodiment, the friction modifier may be formed by the condensation of the hydroxyalkyl compound with an acylating agent or an amine. A more detailed description of the hydroxyalkyl compound is described in U.S. Patent Application 60/725,360 (filed on Oct. 11, 2005, inventors Bartley, Lahiri, Baker and Tipton) in paragraphs 8, 19-21. The friction modifier disclosed in U.S. Patent Application 60/725,360 may be an amide represented by the formula $R^1R^2N—C(O)R^3$, wherein $R^1$ and $R^2$ are each independently hydrocarbyl groups of at least 6 carbon atoms and $R^3$ is a hydroxyalkyl group of 1 to 6 carbon atoms or a group formed by the condensation of said hydroxyalkyl group, through a hydroxyl group thereof, with an acylating agent. Preparative Examples are disclosed in Examples 1 and 2 (paragraphs 68 and 69). In one embodiment, the amide of a hydroxylalkyl compound is prepared by reacting glycolic acid, that is, hydroxyacetic acid, $HO—CH_2—COOH$ with an amine.

In one embodiment, the friction modifier may be a secondary or tertiary amine being represented by the formula $R^4R^5NR^6$, wherein $R^4$ and $R^5$ are each independently an alkyl group of at least 6 carbon atoms and $R^6$ is hydrogen, a hydrocarbyl group, a hydroxyl-containing alkyl group, or an amine-containing alkyl group. A more detailed description of the friction modifier is described in U.S. patent application Ser. No. 05/037,897 in paragraphs 8 and 19 to 22.

In one embodiment, the friction modifier may be derived from the reaction of a carboxylic acid or a reactive equivalent thereof with an aminoalcohol, wherein the friction modifier contains at least two hydrocarbyl groups, each containing at least 6 carbon atoms. An example of such a friction modifier includes the reaction product of isostearic acid or an alkyl succinic anhydride with tris-hydroxymethylaminomethane. A more detailed description of such a friction modifier is disclosed in International Publication WO04/007652) in paragraphs 8 and 9 to 14.

The friction modifier includes fatty amines, borated glycerol esters, fatty acid amides, non-borated fatty epoxides, borated fatty epoxides, alkoxylated fatty amines, borated alkoxylated fatty amines, metal salts of fatty acids, fatty imidazolines, metal salts of alkyl salicylates (may also be referred to as a detergent), metal salts of sulphonates (may also be referred to as a detergent), condensation products of carboxylic acids or polyalkylene-polyamines, or amides of hydroxyalkyl compounds.

In one embodiment, the friction modifier includes a fatty acid ester of glycerol. The final product may be in the form of a metal salt, an amide, an imidazoline, or mixtures thereof. The fatty acids may contain 6 to 24, or 8 to 18 carbon atoms. The fatty acids may branched or straight-chain, saturated or unsaturated. Suitable acids include 2-ethylhexanoic, decanoic, oleic, stearic, isostearic, palmitic, myristic, palmitoleic, linoleic, lauric, and linolenic acids, and the acids from the natural products tallow, palm oil, olive oil, peanut oil, corn oil, and Neat's foot oil. In one embodiment the fatty acid is oleic acid. When in the form of a metal salt, typically the metal includes zinc or calcium; and the products include overbased and non-overbased products. Examples are overbased calcium salts and basic oleic acid-zinc salt complexes which may be represented by the general formula $Zn_4Oleate_6O$. When in the form of an amide, the condensation product includes those prepared with ammonia, or with primary or secondary amines such as diethylamine and diethanolamine. When in the form of an imidazoline, the condensation product of an acid with a diamine or polyamine such as a polyethylenepolyamine. In one embodiment, the friction modifier is the condensation product of a fatty acid with C8 to C24 atoms, and a polyalkylene polyamine, and in particular, the product of isostearic acid with tetraethylenepentamine.

In one embodiment, the friction modifier includes those formed by the condensation of the hydroxyalkyl compound with an acylating agent or an amine. A more detailed description of the hydroxyalkyl compound is described in WO 2007/0044820 paragraphs 9, and 20-22. The friction modifier disclosed in WO2007/044820 includes an amide represented by the formula $R^{12}R^{13}N—C(O)R^{14}$, wherein $R^{12}$ and $R^{13}$ are each independently hydrocarbyl groups of at least 6 carbon atoms and $R^{14}$ is a hydroxyalkyl group of 1 to 6 carbon atoms or a group formed by the condensation of said hydroxyalkyl group, through a hydroxyl group thereof, with an acylating agent. Preparative Examples are disclosed in Examples 1 and 2 (paragraphs 72 and 73 of WO2007/044820). In one embodiment, the amide of a hydroxylalkyl compound is prepared by reacting glycolic acid, that is, hydroxyacetic acid, $HO—CH_2—COOH$ with an amine.

In one embodiment, the friction modifier includes a secondary or tertiary amine being represented by the formula $R^{15}R^{16}NR^{17}$, wherein $R^{15}$ and $R^{16}$ are each independently an alkyl group of at least 6 carbon atoms and $R^{17}$ is hydrogen, a hydrocarbyl group, a hydroxyl-containing alkyl group, or an amine-containing alkyl group. A more detailed description of the friction modifier is described in US Patent Application 2005/037897 in paragraphs 8 and 19 to 22.

In one embodiment, the friction modifier includes a reaction product of a di-cocoalkyl amine (or di-cocoamine) with glycolic acid. The friction modifier includes compounds prepared in Preparative Examples 1 and 2 of WO 2008/014319.

In one embodiment, the friction modifier includes an alkoxylated alcohol. A detailed description of suitable alkoxylated alcohols is described in paragraphs 19 and 20 of US Patent Application 2005/0101497. The alkoxylated amines are also described in U.S. Pat. No. 5,641,732 in column 7, line 15 to column 9, line 25.

In one embodiment, the friction modifier includes a hydroxyl amine compound as defined in column 37, line 19, to column 39, line 38 of U.S. Pat. No. 5,534,170. Optionally, the hydroxyl amine includes borated as such products are described in column 39, line 39 to column 40 line 8 of U.S. Pat. No. 5,534,170.

In one embodiment, the friction modifier includes an alkoxylated amine e.g., an ethoxylated amine derived from 1.8% Ethomeen™ T-12 and 0.90% Tomah™ PA-1 as described in Example E of U.S. Pat. No. 5,703,023, column 28, lines 30 to 46. Other suitable alkoxylated amine compounds include commercial alkoxylated fatty amines known by the trademark "ETHOMEEN" and available from Akzo Nobel. Representative examples of these ETHOMEEN™ materials is ETHOMEEN™ C/12 (bis[2-hydroxyethyl]-coco-amine); ETHOMEEN™ C/20 (polyoxyethylene-[10] cocoamine); ETHOMEEN™ S/12 (bis[2-hydroxyethyl] soyamine); ETHOMEEN™ T/12 (bis[2-hydroxyethyl]-tallow-amine); ETHOMEEN™ T/15 (polyoxyethylene-[5] tallowamine); ETHOMEEN™ 0/12 (bis[2-hydroxyethyl] oleyl-amine); ETHOMEEN™ 18/12 (bis[2-hydroxyethyl] octadecylamine); and ETHOMEEN™ 18/25 (polyoxyethylene[15]octadecylamine). Fatty amines and ethoxylated fatty amines are also described in U.S. Pat. No. 4,741,848.

In one embodiment, the friction modifier includes a polyol ester as described in U.S. Pat. No. 5,750,476 column 8, line 40 to column 9, line 28.

In one embodiment, the friction modifier includes a low potency friction modifier as described in U.S. Pat. No. 5,840,662 in column 2, line 28 to column 3, line 26. U.S. Pat. No. 5,840,662 further discloses in column 3, line 48 to column 6, line 25 specific materials and methods of preparing the low potency friction modifier.

In one embodiment, the friction modifier includes a reaction product of an isomerized alkenyl substituted succinic anhydride and a polyamine as described in U.S. Pat. No. 5,840,663 in column 2, lines 18 to 43. Specific embodiments of the friction modifier described in U.S. Pat. No. 5,840,663 are further disclosed in column 3, line 23 to column 4, line 35. Preparative examples are further disclosed in column 4, line 45 to column 5, line 37 of U.S. Pat. No. 5,840,663.

In one embodiment, the friction modifier includes an alkylphosphonate mono- or di-ester sold commercially by Rhodia under the trademark Duraphos® DMODP.

The condensation of a fatty acid and a polyamine typically result in the formation of at least one compound chosen from hydrocarbyl amides, hydrocarbyl imidazolines and mixtures thereof. In one embodiment, the condensation products are hydrocarbyl imidazolines. In one embodiment, the condensation products are hydrocarbyl amides. In one embodiment, the condensation products are mixtures of hydrocarbyl imidazolines and hydrocarbyl amides. Typically, the condensation product is a mixture of hydrocarbyl imidazolines and hydrocarbyl amides.

The fatty acid may be derived from a hydrocarbyl carboxylic acid. The hydrocarbyl group may be alkyl, cycloalkyl, or aryl, although alkyl is typical, and the hydrocarbyl groups may be linear or branched. Typically, the fatty acid contains 8 or more, 10 or more, more 13 or 14 or more carbon atoms (including the carbon of the carboxy group). Typically, the fatty acid contains 8 to 30, 12 to 24, or 16 to 18 carbon atoms. Other suitable carboxylic acids may include the polycarboxylic acids or carboxylic acids or anhydrides having from 2 to 4 carbonyl groups, typically 2. The polycarboxylic acids may include succinic acids and anhydrides and Diels-Alder reaction products of unsaturated monocarboxylic acids with unsaturated carboxylic acids (such as acrylic, methacrylic, maleic, fumaric, crotonic and itaconic acids). The fatty carboxylic acids include fatty monocarboxylic acids containing 8 to 30, 10 to 26, or 12 to 24 carbon atoms.

Examples of suitable fatty acids may include caprylic acid, capric acid, lauric acid, myristic acid, palmitic acid, stearic acid, eicosic acid and, tall oil acids. In one embodiment the fatty acid is stearic acid, which may be used alone or in combination with other fatty acids.

One or both friction modifiers may in one embodiment be nitrogen-containing compounds, typically both friction modifiers are nitrogen-containing.

In one embodiment, one of friction modifiers is the condensation product of a fatty acid with C8 to C24 atoms, and a polyalkylene polyamine, and in particular, the product of isostearic acid with tetraethylenepentamine.

The phosphorus-containing compound may be a non-ionic phosphorus compound.

In one embodiment, the phosphorus-containing compounds comprise two or more (possibly up to four) non-ionic phosphorus compounds. Typically, the non-ionic phosphorus compound may have an oxidation of +3 or +5. The different embodiments comprise phosphite ester, phosphate esters, or mixtures thereof.

In one embodiment, the phosphorus-containing compound comprises a non-ionic phosphorus compound (a $C_{4-6}$ hydrocarbyl phosphite) and an amine salt of a phosphorus acid or ester.

The phosphorus-containing compound comprises a non-ionic phosphorus compound that is a $C_{4-6}$ hydrocarbyl phosphite, or mixtures thereof. The $C_{4-6}$ hydrocarbyl phosphite includes those represented by the formula:

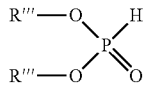

wherein each R''' may be independently hydrogen or a hydrocarbyl group having 4 to 6 carbon atoms, typically 4 carbon atoms, with the proviso that at least one of the R''' groups is hydrocarbyl. Typically the $C_{4-6}$ hydrocarbyl phosphite comprises dibutyl phosphite.

The $C_{4-6}$ hydrocarbyl phosphite may deliver at least 175 ppm, or at least 200 ppm of the total amount of phosphorus delivered by the phosphorus-containing compounds.

The $C_{4-6}$ hydrocarbyl phosphite may deliver at least 45 wt %, or 50 wt % to 100 wt %, or 50 wt % to 90 wt % or 60 wt % to 80 wt % of the total amount of phosphorus from the phosphorus-containing compound.

The phosphorus-containing compounds may comprise a second phosphite whose formula is similar to that disclosed above, except R''' may contain 2 to 40, 8 to 24 or 11 to 20 carbon atoms, with the proviso that the second phosphite is not a $C_{4-6}$ hydrocarbyl phosphite. Examples of suitable hydrocarbyl groups include propyl, dodecyl, butadecyl, hexadecyl, octadecyl, propenyl, dodecenyl, butadecenyl, hexadeencyl, or octadecenylgroups.

As used herein, the term "alk(en)yl" is intended to include moieties that have an alkyl and/or alkenyl group.

In one embodiment, the phosphorus-containing compounds include a mixture of a $C_{4-6}$ hydrocarbyl phosphite (typically dibutyl phosphite) and a $C_{12-18}$ alk(en)yl hydrogen phosphite and optionally phosphoric acid. In different embodiments the phosphoric acid is present or absent.

In one embodiment, the phosphorus-containing compounds include a mixture of a $C_{4-6}$ hydrocarbyl phosphite (typically dibutyl phosphite) and a $C_{16-18}$ alk(en)yl hydrogen phosphite. The alk(en)yl hydrogen phosphite be may an alkyl hydrogen phosphite, and alkenyl hydrogen phosphite, or a mixture of alkenyl hydrogen phosphite and alkyl hydrogen phosphite. In one embodiment the alk(en)yl hydrogen phosphite be may a mixture of alkenyl hydrogen phosphite and alkyl hydrogen phosphite and optionally phosphoric acid. The phosphoric acid may be present or absent.

In one embodiment, the phosphorus-containing compounds include a mixture of a $C_{4-6}$ hydrocarbyl phosphite (typically dibutyl phosphite) and a $C_{11-14}$ alk(en)yl hydrogen phosphite. The alk(en)yl hydrogen phosphite may be an alkyl hydrogen phosphite, and alkenyl hydrogen phosphite, or a mixture of alkenyl hydrogen phosphite and alkyl hydrogen phosphite. In one embodiment, the alk(en)yl hydrogen phosphite may be a mixture of alkenyl hydrogen phosphite and alkyl hydrogen phosphite and optionally phosphoric acid.

In one embodiment, the phosphorus-containing compounds include a mixture of a $C_{4-6}$ hydrocarbyl phosphite (typically dibutyl phosphite) and phosphoric acid.

The lubricant composition in one embodiment includes a package that comprises a phosphorus-containing compound and a non-ionic phosphorus compound that is a hydrocarbyl phosphite.

In one embodiment, the lubricant composition further comprises a $C_{8-20}$ hydrocarbyl phosphite, or a $C_{12-18}$ hydrocarbyl phosphite, or $C_{16-18}$ hydrocarbyl phosphite.

In on embodiment, the amine salt of a phosphorus acid (i.e., an amine salt of a hydrocarbon ester of phosphoric acid different from the salt of the present invention). The amine salt of a phosphorus acid may be derived from an amine salt of a phosphate. The amine salt of the phosphorus acid may be represented by the formula:

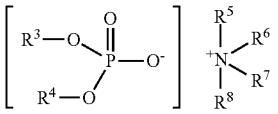

wherein $R^3$ and $R^4$ may be independently hydrogen or hydrocarbon typically containing 4 to 40, or 6 to 30, or 6 to 18, or 8 to 18 carbon atoms, with the proviso that at least one is a hydrocarbon group; and $R^5$, $R^6$, $R^7$ and $R^8$ may be independently hydrogen or a hydrocarbyl group, with the proviso that at least one is a hydrocarbyl group.

The hydrocarbon groups of $R^3$ and/or $R^4$ may be linear, branched, or cyclic.

Examples of a hydrocarbon group for $R^3$ and/or $R^4$ include straight-chain or branched alkyl groups include methyl, ethyl, propyl, butyl, pentyl, hexyl, heptyl, octyl, nonyl, decyl, undecyl, dodecyl, tridecyl, tetradecyl, pentadecyl, hexadecyl, heptadecyl and octadecyl.

Examples of a cyclic hydrocarbon group for $R^3$ and/or $R^4$ include cyclopentyl, cyclohexyl, cycloheptyl, methylcyclopentyl, dimethylcyclopentyl, methylcyclopentyl, dimethylcyclopentyl, methylethylcyclopentyl, diethylcyclopentyl, methylcyclohexyl, dimethylcyclohexyl, methylethylcyclohexyl, diethylcyclohexyl, methylcycloheptyl, dimethylcycloheptyl, methylethylcycloheptyl, and diethylcycloheptyl.

In one embodiment, the phosphate may be an amine salt of a mixture of monoalkyl and dialkyl phosphoric acid esters. The monoalkyl and dialkyl groups may be linear or branched.

The amine salt of a phosphorus acid may be derived from an amine such as a primary amine, a secondary amine, a tertiary amine, or mixtures thereof. The amine may be aliphatic, or cyclic, aromatic or non-aromatic, typically aliphatic. In one embodiment, the amine includes an aliphatic amine such as a tertiary-aliphatic primary amine.

Examples of suitable primary amines include ethylamine, propylamine, butylamine, 2-ethylhexylamine, bis-(2-ethylhexyl)amine, octylamine, and dodecyl-amine, as well as such fatty amines as n-octylamine, n-decylamine, n-dodecylamine, n-tetradecylamine, n-hexadecylamine, n-octadecylamine and oleyamine. Other useful fatty amines include commercially available fatty amines such as "Armeen®" amines (products available from Akzo Chemicals, Chicago, Ill.), such as Armeen C, Armeen O, Armeen OL, Armeen T, Armeen HT, Armeen S and Armeen SD, wherein the letter designation relates to the fatty group, such as coco, oleyl, tallow, or stearyl groups.

Examples of suitable secondary amines include dimethylamine, diethylamine, dipropylamine, dibutylamine, diamylamine, dihexylamine, diheptylamine, methylethylamine, ethylbutylamine, N-methyl-1-amino-cyclohexane, Armeen® 2C and ethylamylamine. The secondary amines may be cyclic amines such as piperidine, piperazine and morpholine.

Examples of tertiary amines include tri-n-butylamine, tri-n-octylamine, tri-decylamine, tri-laurylamine, tri-hexadecylamine, and dimethyloleylamine (Armeen® DMOD).

In one embodiment, the amines are in the form of a mixture. Examples of suitable mixtures of amines include (i) a tertiary alkyl primary amine with 11 to 14 carbon atoms, (ii) a tertiary alkyl primary amine with 14 to 18 carbon atoms, or (iii) a tertiary alkyl primary amine with 18 to 22 carbon atoms. Other examples of tertiary alkyl primary amines include tert-butylamine, tert-hexylamine, tert-octylamine (such as 1,1-dimethylhexylamine), tert-decylamine (such as 1,1-dimethyloctylamine), tertdodecylamine, tert-tetradecylamine, tert-hexadecylamine, tert-octadecylamine, tert-tetracosanylamine, and tert-octacosanylamine.

In one embodiment, a useful mixture of amines is "Primene® 81R" or "Primene® JMT." Primene® 81R and Primene® JMT (both produced and sold by Rohm & Haas) are mixtures of C11 to C14 tertiary alkyl primary amines and C18 to C22 tertiary alkyl primary amines respectively.

The amine salt of a phosphorus acid may be prepared as is described in U.S. Pat. No. 6,468,946. Column 10, lines 15 to 63 describes phosphoric acid esters formed by reaction of phosphorus compounds, followed by reaction with an amine to form an amine salt of a phosphate hydrocarbon ester. Column 10, line 64, to column 12, line 23, describes preparative examples of reactions between phosphorus pentoxide with an alcohol (having 4 to 13 carbon atoms), followed by a reaction with an amine (typically Primene®81-R) to form an amine salt of a phosphate hydrocarbon ester.

In one embodiment, the lubricant composition includes an amine antioxidant. The amine antioxidant may be a phenyl-α-naphthylamine (PANA) or a hydrocarbyl substituted diphenylamine, or mixtures thereof. The hydrocarbyl substituted diphenylamine may include mono- or di-$C_4$ to $C_{16}$-, or $C_6$ to $C_{12}$-, or $C_9$-alkyl diphenylamine. For example the hydrocarbyl substituted diphenylamine may be octyl diphenylamine, or di-octyl diphenylamine, dinonyl diphenylamine, typically dinonyl diphenylamine.

When present, the amine antioxidant may be present at 0.2 wt % to 1.2 wt %, or 0.3 wt % to 1.0 wt %, or 0.4 wt % to 0.9 wt % or 0.5 wt % to 0.8 wt %, of the lubricant composition.

The lubricant composition be optionally include at least one other antioxidant that is known and includes sulphurised olefins, hindered phenols, molybdenum dithiocarbamates, and mixtures thereof.

The hindered phenol antioxidant often contains a secondary butyl and/or a tertiary butyl group as a sterically hindering group. The phenol group is often further substituted with a hydrocarbyl group and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, or 4-dodecyl-2,6-di-tert-butylphenol. In one embodiment, the hindered phenol antioxidant may be an ester and may include, e.g., Irganox™ L-135 from Ciba, or butyl 3-(3,5-di-tert-butyl-4-hydroxyphenyl)propanoate.

If present, the secondary antioxidant may be present at 0.1 wt % to 1 wt %, or 0.2 wt % to 0.9 wt % or 0.1 wt % to 0.4 wt %, or 0.4 wt % to 1.0 wt %, of the lubricant composition.

Farm Tractor

In one embodiment, the invention includes a lubricant composition comprising:

an oil of lubricating viscosity, 0.01 wt % to 15 wt % (or 0.05 to 10 wt %, or 0.1 wt % to 5 wt %, or 0.2 to 1 wt %) of a (thio)phosphoric acid salt of an N-hydrocarbyl-substituted gamma- (γ-) or delta- (δ-) amino(thio)ester, a dispersant typically present at 0.1 to 3 wt %, or 0.1 to 2.5 wt %, or 0.2 to 2 wt %, a phosphorus-containing antiwear agent different from the salt typically delivering 200 to 1500 ppm, 500 to 1300 ppm, 700 to 1300 ppm, a sulphur-containing extreme pressure agent typically present at 0.05 to 1.0 wt %, 0.1 to 0.7 wt %, 0.15 to 0.5 wt %, a sulphur-containing corrosion inhibitor typically present at 0.1 to 0.5 wt %, or 0.15 to 0.35 wt %, 0.15 to 0.3 wt %, and a calcium-containing detergent, typically present in an amount to deliver 100 to 3000 ppm, or 200 to 2000 ppm, or 300 to 900 ppm calcium.

In one embodiment, the invention includes a method of lubricating a farm tractor transmission comprising supplying to the farm tractor transmission a lubricant composition comprising:

an oil of lubricating viscosity, 0.01 wt % to 15 wt % (or 0.05 to 10 wt %, or 0.1 wt % to 5 wt %, or 0.2 to 1 wt %) of a (thio)phosphoric acid salt of an N-hydrocarbyl-substituted gamma- (γ-) or delta- (δ-) amino(thio)ester, a dispersant typically present at 0.1 to 3 wt %, or 0.1 to 2.5 wt %, or 0.2 to 2 wt %, a phosphorus-containing antiwear agent different from the salt typically delivering 200 to 1500 ppm, 500 to 1300 ppm, 700 to 1300 ppm, a sulphur-containing extreme pressure agent typically present at 0.05 to 1.0 wt %, 0.1 to 0.7 wt %, 0.15 to 0.5 wt %, a sulphur-containing corrosion inhibitor typically present at 0.1 to 0.5 wt %, or 0.15 to 0.35 wt %, 0.15 to 0.3 wt %, and a calcium-containing detergent, typically present in an amount to deliver 100 to 3000 ppm, or 200 to 2000 ppm, or 300 to 900 ppm calcium The farm tractor transmission lubricated typically has a wet-brake, a transmission, a hydraulic, a final drive, a power take-off system. These parts are typically lubricated by a single lubricant supplied from a common sump. The transmission may be a manual transmission or an automatic transmission.

The calcium-containing detergent may be an overbased detergent, a non-overbased detergent, or mixtures thereof. Typically, the detergent may be overbased.

The preparation of the calcium-containing detergent is known in the art. Patents describing the preparation of overbased calcium-containing detergents include U.S. Pat. Nos. 2,501,731; 2,616,905; 2,616,911; 2,616,925; 2,777,874; 3,256,186; 3,384,585; 3,365,396; 3,320,162; 3,318,809; 3,488,284; and 3,629,109.

As used herein the TBN values quoted and associated range of TBN is on "an as is basis," i.e., containing conventional amounts of diluent oil. Conventional amounts of diluent oil typically range from 30 wt % to 60 wt % (often 40 wt % to 55 wt %) of the detergent component.

A more detailed description of the expressions "metal ratio", TBN and "soap content" are known to a person skilled in the art and explained in standard textbook entitled "Chemistry and Technology of Lubricants", Third Edition, Edited by R. M. Mortier and S. T. Orszulik, Copyright 2010, pages 219 to 220 under the sub-heading 7.2.5. Detergent Classification.

The calcium-containing detergent may be a non-overbased detergent (may also be referred to as a neutral detergent). The TBN of a non-overbased may be 20 to less than 200, or 30 to 100, or 35 to 50 mg KOH/g. The TBN of a non-overbased calcium-containing detergent may also be 20 to 175, or 30 to 100 mg KOH/g. When a non-overbased calcium-containing detergent is prepared from a strong acid such as a hydrocarbyl-substituted sulphonic acid, the TBN may be lower (for example 0 to 50 mg KOH/g, or 10 to 20 mg KOH/g).

The calcium-containing detergent may be an overbased detergent, which may have a TBN of greater than 200 mg KOH/g (typically 250 to 600, or 300 to 500 mg KOH/g).

The calcium-containing detergent may be formed by the reaction of a basic calcium compound and an acidic detergent substrate. The acidic detergent substrate may include an alkyl phenol, an aldehyde-coupled alkyl phenol, a sulphurised alkyl phenol, an alkyl aromatic sulphonic acid (such as, alkyl naphthalene sulphonic acid, alkyl toluene sulphonic acid or alkyl benzene sulphonic acid), an aliphatic carboxylic acid, a calixarene, a salixarene, an alkyl salicylic acid, or mixtures thereof.

The metal basic compound is used to supply basicity to the detergent. The basic calcium compound is a compound of a hydroxide or oxide of the metal.

The oxides and/or hydroxides may be used alone or in combination. The oxides or hydroxides may be hydrated or dehydrated, although hydrated is typical. In one embodiment the basic calcium compound may be calcium hydroxide, which may be used alone or mixtures thereof with other metal basic compounds. Calcium hydroxide is often referred to as lime. In one embodiment the metal basic compound may be calcium oxide which may be used alone or mixtures thereof with other metal basic compounds.

Collectively, when the alkyl phenol, the aldehyde-coupled alkyl phenol, and the sulphurised alkyl phenol are used to prepare a calcium-containing detergent, the detergent may be referred to as a calcium phenate. The calcium phenate may be an alkyl phenate, an aldehyde-coupled alkyl phenate, a sulphurised alkyl phenate, or mixtures thereof.

The TBN of a calcium phenate may vary from less 200, or 30 to 175 typically 150 to 175) mg KOH/g for a neutral phenate to 200 or more to 500, or 210 to 400 (typically 230 to 270) mg KOH/g for an overbased phenate.

The alkyl group of a phenate (i.e., an alkyl phenate) may contain 4 to 80, or 6 to 45, or 8 to 20, or 9 to 15 carbon atoms.

In one embodiment, the calcium-containing detergent may be a sulphonate, or mixtures thereof. The sulphonate may be prepared from a mono- or di-hydrocarbyl-substituted benzene (or naphthalene, indenyl, indanyl, or bicyclopentadienyl) sulphonic acid, wherein the hydrocarbyl group may contain 6 to 40, or 8 to 35 or 9 to 30 carbon atoms.

The hydrocarbyl group may be derived from polypropylene or a linear or branched alkyl group containing at least 10 carbon atoms. Examples of a suitable alkyl group include branched and/or linear decyl, undecyl, dodecyl, tridecyl, tetradecyl, pentadecyl, hexadecyl, heptadecyl, octadecyl, octadecenyl, nonodecyl, eicosyl, un-eicosyl, do-eicosyl, tri-eicosyl, tetra-eicosyl, penta-eicosyl, hexa-eicosyl or mixtures thereof.

In one embodiment, the hydrocarbyl-substituted sulphonic acid may include polypropene benzenesulphonic acid and/or $C_{16}$-$C_{24}$ alkyl benzenesulphonic acid, or mixtures thereof.

In one embodiment, a calcium sulphonate detergent may be a predominantly linear alkylbenzene sulphonate detergent having a metal ratio of at least 8 as is described in paragraphs [0026] to [0037] of US Patent Application 2005065045 (and granted as U.S. Pat. No. 7,407,919). In some embodiments, the linear alkyl group may be attached to the benzene ring anywhere along the linear chain of the alkyl group, but often in the 2, 3 or 4 position of the linear chain, and in some instances predominantly in the 2 position.

When neutral or slightly basic, a calcium sulphonate detergent may have TBN of less than 100, or less than 75, typically 20 to 50 mg KOH/g, or 0 to 20 mg KOH/g.

When overbased, a calcium sulphonate detergent may have a TBN greater than 200, or 300 to 550, or 350 to 450 mg KOH/g.

The detergent may be borated or non-borated.

Chemical structures for sulphonates, and phenates detergents are known to a person skilled in the art. The standard textbook entitled "Chemistry and Technology of Lubricants", Third Edition, Edited by R. M. Mortier and S. T. Orszulik, Copyright 2010, pages 220 to 223 under the sub-heading 7.2.6 provide general disclosures of said detergents and their structures.

In one embodiment, the calcium-containing detergent may be an overbased calcium sulphonate, an overbased calcium phenate, or mixtures thereof. Typically the detergent may be an overbased calcium sulphonate.

In one embodiment, the calcium-containing detergent may be in a mixture with a having zinc-, barium-, sodium-, or magnesium-containing detergent. The zinc-, barium-, sodium-, or magnesium-containing detergent is also well known in the art and described in the same references describing a calcium-containing detergent. The TBN and metal ratios may however, differ slightly. The zinc-, barium-, sodium-, or magnesium-containing detergent may be a phenate, a sulphur-containing phenate, sulphonate, salixarate or salicylate. Typically, a zinc-, barium-, sodium-, or magnesium-containing detergent may be a magnesium phenate, a magnesium sulphur-containing phenate, or a magnesium sulphonate.

The dispersant is described above.

In one embodiment, the dispersant may be a mixture comprising:

(i) a non-borated dispersant that comprises a polyisobutylene succinimide, wherein the polyisobutylene used to prepare the non-borated dispersant has a number average molecular weight of 550 to 1150, or 750 to 1150, or 900 to 1000 (often commercially available with a number average molecular weight of about 950); and (ii) a borated dispersant that comprises a polyisobutylene succinimide, wherein the polyisobutylene used to prepare the non-borated dispersant has a number average molecular weight of 550 to 1150, or 750 to 1150, or 900 to 1000 (often commercially available with a number average molecular weight of about 950).

In one embodiment, the dispersant may be a mixture comprising:

(a) a non-borated dispersant that comprises a polyisobutylene succinimide, wherein the polyisobutylene used to prepare the non-borated dispersant has a number average molecular weight of 550 to 1150, or 750 to 1150, or 900 to 1000 (often commercially available with a number average molecular weight of about 950); and (b) the borated dispersant may also be a product prepared by heating together:

(i) a dispersant substrate;

(ii) 2,5-dimercapto-1,3,4-thiadiazole or a hydrocarbyl-substituted 2,5-di-mercapto-1,3,4-thiadiazole, or oligomers thereof;

(iii) a borating agent; and (iv) optionally a dicarboxylic acid of an aromatic compound chosen from 1,3 diacids and 1,4 diacids; or (v) optionally a phosphorus acid compound, said heating being sufficient to provide a product of (i), (ii), (iii) and optionally (iv) or (v), which is soluble in an oil of lubricating viscosity.

The phosphorus-containing antiwear agent may include zinc dialkyldithiophosphate, a non-ionic phosphorus compound, which may be a hydrocarbyl phosphite; (i) a non-ionic phosphorus compound, which may be a hydrocarbyl phosphite; or (ii) an amine salt of a phosphorus compound, or mixtures thereof.

In one embodiment, the lubricant composition disclosed herein contains no zinc dialkyldithiophosphate.

In one embodiment, the lubricant composition disclosed herein contains zinc dialkyldithiophosphate.

The phosphorus-containing compound may be a non-ionic phosphorus compound.

In one embodiment, the phosphorus-containing compounds comprise two or more (possibly up to four) non-ionic phosphorus compounds. Typically, the non-ionic phosphorus compound may have an oxidation of +3 or +5. The different embodiments comprise phosphite ester, phosphate esters, or mixtures thereof.

In one embodiment, the phosphorus-containing compound comprises a non-ionic phosphorus compound (a $C_{4-6}$ hydrocarbyl phosphite) and an amine salt of a phosphorus acid or ester.

The phosphorus-containing compound comprises a non-ionic phosphorus compound that is a $C_{4-6}$ hydrocarbyl phosphite, or mixtures thereof. The $C_{4-6}$ hydrocarbyl phosphite includes those represented by the formula:

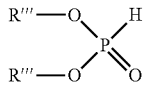

wherein each R''' may be independently hydrogen or a hydrocarbyl group having 4 to 6 carbon atoms, typically 4 carbon atoms, with the proviso that at least one of the R''' groups is hydrocarbyl. Typically, the $C_{4-6}$ hydrocarbyl phosphite comprises dibutyl phosphite.

The $C_{4-6}$ hydrocarbyl phosphite may deliver at least 175 ppm, or at least 200 ppm of the total amount of phosphorus delivered by the phosphorus-containing compounds.

The $C_{4-6}$ hydrocarbyl phosphite may deliver at least 45 wt %, or 50 wt % to 100 wt %, or 50 wt % to 90 wt % or 60 wt % to 80 wt % of the total amount of phosphorus from the phosphorus-containing compound.

The phosphorus-containing compounds may comprise a second phosphite whose formula is similar to that disclosed above, except R''' may contain 2 to 40, 8 to 24 or 11 to 20 carbon atoms, with the proviso that the second phosphite is not a $C_{4-6}$ hydrocarbyl phosphite. Examples of suitable hydrocarbyl groups include propyl, dodecyl, butadecyl, hexadecyl, octadecyl, propenyl, dodecenyl, butadecenyl, hexadeencyl, or octadecenylgroups.

As used herein, the term "alk(en)yl" is intended to include moieties that have an alkyl and/or alkenyl group.

In one embodiment, the phosphorus-containing compounds include a mixture of a $C_{4-6}$ hydrocarbyl phosphite (typically dibutyl phosphite) and a $C_{12-18}$ alk(en)yl hydrogen phosphite and optionally phosphoric acid. In different embodiments the phosphoric acid is present or absent.

In one embodiment, the phosphorus-containing compounds include a mixture of a $C_{4-6}$ hydrocarbyl phosphite (typically dibutyl phosphite) and a $C_{16-18}$ alk(en)yl hydrogen phosphite. The alk(en)yl hydrogen phosphite may be an alkyl hydrogen phosphite, and alkenyl hydrogen phosphite, or a mixture of alkenyl hydrogen phosphite and alkyl hydrogen phosphite. In one embodiment the alk(en)yl hydrogen phosphite be may a mixture of alkenyl hydrogen phosphite and alkyl hydrogen phosphite and optionally phosphoric acid. The phosphoric acid may be present or absent.

In one embodiment, the phosphorus-containing compounds include a mixture of a $C_{4-6}$ hydrocarbyl phosphite (typically dibutyl phosphite) and a $C_{11-14}$ alk(en)yl hydrogen phosphite. The alk(en)yl hydrogen phosphite may be an alkyl hydrogen phosphite, and alkenyl hydrogen phosphite, or a mixture of alkenyl hydrogen phosphite and alkyl hydrogen phosphite. In one embodiment, the alk(en)yl hydrogen phosphite may be a mixture of alkenyl hydrogen phosphite and alkyl hydrogen phosphite and optionally phosphoric acid.

In one embodiment, the phosphorus-containing compounds include a mixture of a $C_{4-6}$ hydrocarbyl phosphite (typically dibutyl phosphite) and phosphoric acid.

The lubricant composition in one embodiment includes a package that comprises a phosphorus-containing compound and a non-ionic phosphorus compound that is a hydrocarbyl phosphite.

In one embodiment, the lubricant composition further comprises a $C_{8-20}$ hydrocarbyl phosphite, or a $C_{12-18}$ hydrocarbyl phosphite, or $C_{16-18}$ hydrocarbyl phosphite.

In on embodiment, the amine salt of a phosphorus acid (i.e., an amine salt of a hydrocarbon ester of phosphoric acid different from the salt of the present invention). The amine salt of a phosphorus acid may be derived from an amine salt of a phosphate. The amine salt of the phosphorus acid may be represented by the formula:

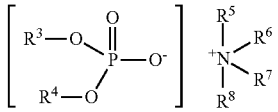

wherein $R^3$ and $R^4$ may be independently hydrogen or hydrocarbon typically containing 4 to 40, or 6 to 30, or 6 to 18, or 8 to 18 carbon atoms, with the proviso that at least one is a hydrocarbon group; and $R^5$, $R^6$, $R^7$ and $R^8$ may be independently hydrogen or a hydrocarbyl group, with the proviso that at least one is a hydrocarbyl group.

The hydrocarbon groups of $R^3$ and/or $R^4$ may be linear, branched, or cyclic.

Examples of a hydrocarbon group for $R^3$ and/or $R^4$ include straight-chain or branched alkyl groups include methyl, ethyl, propyl, butyl, pentyl, hexyl, heptyl, octyl, nonyl, decyl, undecyl, dodecyl, tridecyl, tetradecyl, pentadecyl, hexadecyl, heptadecyl and octadecyl.

Examples of a cyclic hydrocarbon group for $R^3$ and/or $R^4$ include cyclopentyl, cyclohexyl, cycloheptyl, methylcyclopentyl, dimethylcyclopentyl, methylcyclopentyl, dimethylcyclopentyl, methylethylcyclopentyl, diethylcyclopentyl, methylcyclohexyl, dimethylcyclohexyl, methylethylcyclohexyl, diethylcyclohexyl, methylcycloheptyl, dimethylcycloheptyl, methylethylcycloheptyl, and diethylcycloheptyl.

In one embodiment, the phosphate may be an amine salt of a mixture of monoalkyl and dialkyl phosphoric acid esters. The monoalkyl and dialkyl groups may be linear or branched.

The amine salt of a phosphorus acid may be derived from an amine such as a primary amine, a secondary amine, a tertiary amine, or mixtures thereof. The amine may be aliphatic, or cyclic, aromatic or non-aromatic, typically aliphatic. In one embodiment, the amine includes an aliphatic amine such as a tertiary-aliphatic primary amine.

Examples of suitable primary amines include ethylamine, propylamine, butylamine, 2-ethylhexylamine, bis-(2-ethylhexyl)amine, octylamine, and dodecyl-amine, as well as such fatty amines as n-octylamine, n-decylamine, n-dodecylamine, n-tetradecylamine, n-hexadecylamine, n-octadecylamine and oleyamine. Other useful fatty amines include commercially available fatty amines such as "Armeen®" amines (products available from Akzo Chemicals, Chicago, Ill.), such as Armeen C, Armeen O, Armeen OL, Armeen T, Armeen HT, Armeen S and Armeen SD, wherein the letter designation relates to the fatty group, such as coco, oleyl, tallow, or stearyl groups.

Examples of suitable secondary amines include dimethylamine, diethylamine, dipropylamine, dibutylamine, diamylamine, dihexylamine, diheptylamine, methylethylamine, ethylbutylamine, N-methyl-1-amino-cyclohexane, Armeen® 2C and ethylamylamine. The secondary amines may be cyclic amines such as piperidine, piperazine and morpholine.

Examples of tertiary amines include tri-n-butylamine, tri-n-octylamine, tri-decylamine, tri-laurylamine, tri-hexadecylamine, and dimethyloleylamine (Armeen® DMOD).

In one embodiment, the amines are in the form of a mixture. Examples of suitable mixtures of amines include (i) a tertiary alkyl primary amine with 11 to 14 carbon atoms, (ii) a tertiary alkyl primary amine with 14 to 18 carbon atoms, or (iii) a tertiary alkyl primary amine with 18 to 22 carbon atoms. Other examples of tertiary alkyl primary amines include tert-butylamine, tert-hexylamine, tert-octylamine (such as 1,1-dimethylhexylamine), tert-decylamine (such as 1,1-dimethyloctylamine), tertdodecylamine, tert-tetradecylamine, tert-hexadecylamine, tert-octadecylamine, tert-tetracosanylamine, and tert-octacosanylamine.

In one embodiment, a useful mixture of amines is "Primene® 81R" or "Primene® JMT." Primene® 81R and Primene® JMT (both produced and sold by Rohm & Haas) are mixtures of C11 to C14 tertiary alkyl primary amines and C18 to C22 tertiary alkyl primary amines respectively.

The amine salt of a phosphorus acid may be prepared as is described in U.S. Pat. No. 6,468,946. Column 10, lines 15 to 63 describes phosphoric acid esters formed by reaction of phosphorus compounds, followed by reaction with an amine to form an amine salt of a phosphate hydrocarbon ester. Column 10, line 64, to column 12, line 23, describes preparative examples of reactions between phosphorus pentoxide with an alcohol (having 4 to 13 carbon atoms), followed by a reaction with an amine (typically Primene®81-R) to form an amine salt of a phosphate hydrocarbon ester.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include: hydrocarbon substituents, including aliphatic, alicyclic, and aromatic substituents; substituted hydrocarbon substituents, that is, substituents containing non-hydrocarbon groups which, in the context of this invention, do not alter the predominantly hydrocarbon nature of the substituent; and hetero substituents, that is, substituents which similarly have a predominantly hydrocarbon character but contain other than carbon in a ring or chain. A more detailed definition of the term "hydrocarbyl substituent" or "hydrocarbyl group" is described in paragraphs [0118] to [0119] of International Publication WO2008147704, or a similar definition in paragraphs [0137] to [0141] of published application US 2010-0197536.

The sulphur-containing extreme pressure agent may be an olefin sulphide, or mixtures thereof. The olefin sulphide may include a polysulphide or a sulphurised olefin such as sulphurised isobutylene, or mixtures thereof.

In one embodiment, the olefin sulphide includes a polysulphide.

In one embodiment, the olefin sulphide includes sulphurized isobutylene.

In one embodiment, the olefin sulphide includes a mixture of a sulphurised isobutylene and a polysulphide.

In one embodiment, at least 50 wt % of the polysulphide molecules are a mixture of tri- or tetra-sulphides. In other embodiments, at least 55 wt %, or at least 60 wt % of the polysulphide molecules are a mixture of tri- or tetra-sulphides.

The polysulphide includes a sulphurised organic polysulphide from oils, fatty acids or ester, olefins or polyolefins.

Oils which may be sulfurized include natural or synthetic oils such as mineral oils, lard oil, carboxylate esters derived from aliphatic alcohols and fatty acids or aliphatic carboxylic acids (e.g., myristyl oleate and oleyl oleate), and synthetic unsaturated esters or glycerides.

Fatty acids include those that contain 8 to 30, or 12 to 24 carbon atoms. Examples of fatty acids include oleic, linoleic, linolenic, and tall oil. Sulphurised fatty acid esters prepared from mixed unsaturated fatty acid esters such as are obtained from animal fats and vegetable oils, including tall oil, linseed oil, soybean oil, rapeseed oil, and fish oil.

The polysulphide includes olefins derived from a wide range of alkenes. The alkenes typically have one or more double bonds. The olefins in one embodiment contain 3 to 30 carbon atoms. In other embodiments, olefins contain 3 to 16, or 3 to 9 carbon atoms. In one embodiment, the sulphurised olefin includes an olefin derived from propylene, isobutylene, pentene or mixtures thereof.

In one embodiment, the polysulphide comprises a polyolefin derived from polymerizing by known techniques, an olefin as described above.

In one embodiment, the polysulphide includes dibutyl tetrasulphide, sulphurised methyl ester of oleic acid, sulphurised alkylphenol, sulphurised dipentene, sulphurised dicyclopentadiene, sulphurised terpene, and sulphurised Diels-Alder adducts.

The lubricant may also include a sulphur-containing corrosion inhibitor. The sulphur-containing corrosion inhibitor may be a thiadiazole compound, or mixtures thereof. The thiadiazole compound may include mono- or di-hydrocarbyl substituted 2,5-dimercapto-1,3,4-thiadiazole compounds. Examples of a thiadiazole include 2,5-dimercapto-1,3,4-thiadiazole, or oligomers thereof, a hydrocarbyl-substituted 2,5-dimercapto-1,3,4-thiadiazole, a hydrocarbylthio-substituted 2,5-dimercapto-1,3,4-thiadiazole, or oligomers thereof. The oligomers of hydrocarbyl-substituted 2,5-dimercapto-1,3,4-thiadiazole typically form by forming a sulphur-sulphur bond between 2,5-dimercapto-1,3,4-thiadiazole units to form oligomers of two or more of said thiadiazole units. These thiadiazole compounds may also be used in the post treatment of dispersants as mentioned below in the formation of a dimercaptothiadiazole derivative of a polyisobutylene succinimide.

Examples of a suitable thiadiazole compound include at least one of a dimercaptothiadiazole, 2,5-dimercapto-[1,3,4]-thiadiazole, 3,5-dimercapto-[1,2,4]-thiadiazole, 3,4-dimercapto-[1,2,5]-thiadiazole, or 4-5-dimercapto-[1,2,3]-thiadiazole. Typically, readily available materials such as 2,5-dimercapto-1,3,4-thiadiazole or a hydrocarbyl-substituted 2,5-dimercapto-1,3,4-thiadiazole or a hydrocarbylthio-substituted 2,5-dimercapto-1,3,4-thiadiazole are commonly utilized.

INDUSTRIAL APPLICATIONS

In other embodiments, the lubricant comprising an oil of lubricating viscosity and 0.001 wt % to 15 wt % of a (thio)phosphoric acid salt of an N-hydrocarbyl-substituted gamma- (γ-) or delta- (δ-)amino(thio)ester may be used in industrial applications. The (thio)phosphoric acid salt may be used in industrial lubricant compositions, such as greases, metal working fluids, industrial gear lubricants, hydraulics oils, turbine oils, circulation oils, or refrigerants. Such lubricant compositions are well known in the art.

In one embodiment, lubricant may be used in a grease. The grease may have a composition comprising an oil of lubricating viscosity, a grease thickener, and 0.001 wt % to 15 wt % of a (thio)phosphoric acid salt of an N-hydrocarbyl-substituted gamma- (γ-) or delta-amino(thio)ester. In other embodiments, the (thio)phosphoric acid salt may be present in the lubricant at 0.01 wt % to 5 wt % or 0.002 to 2 wt %, based on a total weight of the lubricant composition.

In one embodiment, the grease may also be a sulphonate grease. Such greases are known in the art. In another embodiment, the sulphonate grease may be a calcium sulphonate grease prepared from overbasing a neutral calcium sulphonate to form amorphous calcium carbonate and subsequently converting it into either calcite, or vaterite or mixtures thereof.

The grease thickener may be any grease thickener known in the art. Suitable grease thickeners include, but are not limited to, metal salts of a carboxylic acid, metal soap grease thickeners, mixed alkali soaps, complex soaps, non-soap grease thickeners, metal salts of such acid-functionalized oils, polyurea and diurea grease thickeners, or calcium sulphonate grease thickeners. Other suitable grease thickeners include, polymer thickening agents, such as polytetrafluoroethylene, polystyrenes, and olefin polymers. Inorganic grease thickeners may also be used. Exemplary inorganic thickeners include clays, organo-clays, silicas, calcium carbonates, carbon black, pigments or copper phthalocyanine. Further thickeners include urea derivatives, such as polyuria or a diurea. Specific examples of a grease include those summarized in the following table:

Grease Additive Package Compositions*

| | Embodiments (wt %) | |
|---|---|---|
| Function/Component | Multi-functional | High Temp-Long Life |
| Salt of the invention | 20-30 | 0.1 to 5.0 |
| Antioxidant | 10 to 20 | 25.0-60.0 |
| Dispersant | 0.50 to 5.0 | — |
| Metal Deactivator | 1.0 to 8.0 | — |
| Antiwear Agent | — | 5.0 to 15.0 |
| Extreme Pressure Agent | 45.0 to 65.0 | 0.1 to 10.0 |
| Rust inhibitor | 1.0 to 5.0 | 30.0 to 40.0 |
| Diluent Oil | Balance to 100% | Balance to 100% |

*The grease additive package is treated at 2 wt % to 5 wt % of a grease composition.

The following examples provide illustrations of the invention. These examples are non-exhaustive and are not intended to limit the scope of the invention.

EXAMPLES

Preparative Amine 1 (AM1): Dibutyl itaconate (100 g) and methanol (39.7 g) are charged to a 3-neck vessel fitted with a condenser, magnetic stirrer, nitrogen inlet, and thermocouple. The mixture is stirred and 45 parts by weight of α-methylbenzylamine is added dropwise over about 45 minutes, during which time the temperature of the mixture is maintained at about 24-27° C. The mixture is then heated to about 50° C. and stirred for approximately 20 hours, and thereafter the methanol is removed by rotary vacuum drying under high vacuum, maintaining the temperature below 40° C. The product is believed to be dibutyl 2-(((α-methylbenzyl)amino)methyl)succinate, 140.7 parts by weight.

Preparative Amine 2 (AM2): Bis(2-ethylhexyl)itaconate (47.0 g), methanol (100 g), and 5.0 g of a Zr based catalyst are charged to a 250 mL 3-neck flack fitted with a condenser, magnetic stirrer, nitrogen inlet, and thermocouple. (The Zr catalyst is prepared by combining an aqueous solution of 33.5 g $ZrOCl_2$ with 66.5 g montmorillonite clay with heating followed by drying.) The mixture is stirred at room temperature and 16.3 g of 2-ethylhexylamine is added dropwise over 15 minutes (or alternatively, 3-4 minutes), during which time the temperature of the mixture is 18-27° C. (alternatively, up to 30° C. or 33° C.). The mixture is stirred for an additional 5 hours, then filtered to remove the catalyst. Methanol is removed from the filtrate by rotary vacuum drying under high vacuum, maintaining the temperature below 25° C. The product is believed to be bis(2-ethylhexyl) 2-(((2-ethylhexyl)amino)methyl) succinate, 49.5 g.

Preparative Amine 3 (AM3): Bis(2-ethylhexyl)itaconate (150 g) and 2-ethylhexanol (30 g) are charged to a 250 mL 3-neck flack fitted with a condenser, magnetic stirrer, nitrogen inlet, and thermocouple. The mixture is stirred at room temperature and then 107.3 g of oleylamine is added dropwise over 1 hour, during which time the temperature of the mixture is 20-25° C. The mixture is then heated to 30° C. and stirred for an additional 2.5 hours, then filtered to remove the catalyst. The product is believed to be bis(2-ethylhexyl)2-((oleyl amino)methyl) succinate containing 2-ethylhexanol, 278 g.

Preparative Amine 4 (AM4): Bis(oleyl)itaconate (250 g) and butanol (32.5 g) are charged to a 250 mL 3-neck flack fitted with a condenser, magnetic stirrer, nitrogen inlet, and thermocouple. The mixture is stirred at room temperature and 43.3 g of α-methylbenzylamine is added dropwise over 1 hour, during which time the temperature of the mixture is maintained at 20-25° C. The mixture is then heated to 50° C. and stirred for 10 hours. Methanol is removed from by rotary vacuum drying under high vacuum, maintaining the temperature below 25° C. The product is believed to be bis (oleyl)2-(((α-methylbenzyl)amino)methyl) succinate, 255 g.

Preparative Amine 5 (AM5): Bis(2-ethylhexyl)itaconate (461.7 g), methanol (150 g), and 6.3 g of a Zr based catalyst are charged to a 250 mL 3-neck flack fitted with a condenser, magnetic stirrer, nitrogen inlet, and thermocouple. (The Zr catalyst is prepared by combining an aqueous solution of 33.5 g $ZrOCl_2$ with 66.5 g montmorillonite clay with heating followed by drying.) The mixture is stirred at room temperature and 146.9 g of 2,4,4-trimethylpentan-2-amine is added dropwise over approximately 1 hour, during which time the temperature of the mixture is 20-25° C. The mixture is heated to 30° C. and stirred for an additional 6 hours, then heated to 66° C. and heated for a further 11 hours, then filtered to remove the catalyst. Methanol is removed from the filtrate by rotary vacuum drying under high vacuum, maintaining the temperature below 25° C. The product is believed to be bis(2-ethylhexyl)2-((2,4,4-trimethylpentan-2-amino) methyl)succinate, 575.9 g.

Preparative Amine 6 (AM6): Bis(2-ethylhexyl)itaconate (270.6 g), methanol (160 g), and 6 g of a Zr based catalyst are charged to a 250 mL 3-neck flack fitted with a condenser, magnetic stirrer, nitrogen inlet, and thermocouple. (The Zr catalyst is prepared by combining an aqueous solution of 33.5 g $ZrOCl_2$ with 66.5 g montmorillonite clay with heating followed by drying.) The mixture is stirred at room temperature and 77.6 g of tertiary butylamine is added dropwise over approximately 1 hour, during which time the temperature of the mixture is 14-20° C. The mixture is heated to 30° C. and stirred for a 12 hours, then filtered to remove the catalyst. Methanol is removed from the filtrate by rotary vacuum drying under high vacuum, maintaining the temperature below 25° C. The product is believed to be bis(2-ethylhexyl)2-((2-methypropan-2-amino)methyl) succinate, 286.7 g.

Preparative Amine 7-9 (AM7-9)

Preparative Amine 7 (AM7)—Reaction product of 2-ethylhexylamine and itaconic acid di-oleylester.

Preparation Amine 8 (AM8)—Reaction product of 2,4,4-trimethylpentan-2-amine with itaconic acid di-n-butylester.

Preparation Amine 9 (AM9)—Reaction product of tert-butylamine with itaconic acid di-n-butylester.

Preparation Amine 10-15 (AM-10-15): The procedures of Preparation Amine 1-6 may be repeated replacing the dibutyl itaconates with dibutyl 2-methylenepentanedioate, the bis(2-ethylhexyl)itaconate with bis(2-ethylhexyl)2-methylene pentanedioate, or the bis(oleyl)itaconates with bis(oleyl) 2-methylene pentanedioate.

Preparative Amine 10 (AM10)—Reaction product of 1-phenylethanamine with dibutyl 2-methylenepentanedioate.

Preparative Amine 11 (AM11)—Reaction product of 2-ethylhexylamine and bis(2-ethylhexyl)2-methylene pentanedioate.

Preparative Amine 12 (AM12)—Reaction product of oleylamine and bis(2-ethylhexyl)2-methylene pentanedioate.

Preparative Amine 13 (AM13)—Reaction product of 2-ethylhexylamine and bis(oleyl)2-methylene pentanedioate.

Preparative Amine 14 (AM14)—Reaction product of 1-phenylethanamine with bis(oleyl)2-methylene pentanedioate.

Preparation Amine 15 (AM15)—Reaction product of 2,4,4-trimethylpentan-2-amine with dibutyl 2-methylenepentanedioate.

Preparation Amine 16-21 (AM16-21): The procedures of Preparation Amine 1-6 may be repeated replacing the dibutyl itaconates with tributyl but-3-ene-1,2,3-tricarboxylate, the bis(2-ethylhexyl)itaconate with tris(2-ethylhexyl) but-3-ene-1,2,3-tricarboxylate, or the bis(oleyl)itaconates with tris (oleyl) but-3-ene-1,2,3-tricarboxylate.

Preparative Amine 16 (AM16)—Reaction product of 1-phenylethanamine with tributyl but-3-ene-1,2,3-tricarboxylate.

Preparative Amine 17 (AM17)—Reaction product of 2-ethylhexylamine and tris(2-ethylhexyl) but-3-ene-1,2,3-tricarboxylate.

Preparative Amine 18 (AM18)—Reaction product of oleylamine and tris(2-ethylhexyl) but-3-ene-1,2,3-tricarboxylate.

Preparative Amine 19 (AM19)—Reaction product of 2-ethylhexylamine and with tris(oleyl) but-3-ene-1,2,3-tricarboxylate.

Preparative Amine 20 (AM20)—Reaction product of 1-phenylethanamine with tris(oleyl) but-3-ene-1,2,3-tricarboxylate.

Preparation Amine 21 (AM21)—Reaction product of 2,4,4-trimethylpentan-2-amine with tributyl but-3-ene-1,2,3-tricarboxylate.

Preparation Amine 22 (AM22)—Reaction product of α-methylbenzylamine with 2-ethylhexyl itaconate.

Preparation Amine 23 (AM23)—Reaction product of α-methylbenzylamine with 4-methyl-2-pentanol itaconate.

General Procedure for Formation of Phosphate Acid Esters

Alcohol is charged to a dried multi-necked flange flask fitted with a condenser, an overhead mechanical stirrer, nitrogen inlet, and thermocouple. The flask is heated to 70° C. and then phosphorus pentoxide is added portion wise, maintaining the temperature at 70 to 80° C. The mixture is then heated to 90° C. and stirred for an additional 3 to 20 hours. The molar ratio of the alcohol to phosphorus pentoxide ($P_2O_5$) may be 4:1 to 2.5:1 that is for every phosphorus there is typically 2 to 1.25 equivalents alcohol.

2-ethylhexanol (636.8 g) and 1,2-propanediol (67.7 g) are charged to a dried 2 L multi-necked flange flask fitted with a condenser, overhead mechanical stirrer, nitrogen inlet, and thermocouple. The flask is heated to 70° C. and then phosphorus pentoxide (273.4 g) is added portion wise over approximately 1.5 hours, maintain the temperature at 70 to 80° C. The mixture is then heated to 90° C. and stirred for an additional 12 to 15 hours.

2-ethylhexanol (2512 g) is charged to a dried 5 L multi-necked flange flask fitted with a condenser, overhead mechanical stirrer, nitrogen inlet, and thermocouple. The flask is heated to 70° C. and then phosphorus pentoxide (887 g) is added portion wise over approximately 3 hours, maintain the temperature at 70 to 80° C. The mixture is then heated to 90° C. and stirred for an additional 10 to 15 hours.

General Procedure for Formation of Salts

This process is common to all preparative salts of the itaconate amines (AM1 through AM23) and protic acids. The example below is for a 2-ethylhexylphosphate salted with the alpha methylbenzylamine dibutyl itaconate adduct.

A mixture of 2-ethylhexylphosphate and bis-2-ethylhexylphosphate acid ester (225 g) are charged to a 500 ml mL 3-neck flack fitted with a condenser, magnetic stirrer, nitrogen inlet, and thermocouple. To the flask is added AM1, dibutyl 2-(((α-methylbenzyl)amino)methyl) succinate (326.95) over approximately 1 hour, during this time an exotherm of approximately 5-10° C. This process is common to all preparative itaconate amines (AM1 through AM23) and is controlled by gentle cooling to the keep the temperature of the vessel at 20-25° C. After the addition, the reaction is stirred at 25-30° C. for 2 hours.

All additional salts are made by a similar process. The materials prepared are summarized Table 1:

TABLE 1

Preparative Amine-Phosphate Salts

| | Amine | (Thio)Phosphate |
|---|---|---|
| PREP1 | AM1 | (2-ethylhexyl)phosphate (EHP) |
| PREP2 | AM2 | EHP |
| PREP3 | AM1 | (n-decyl)phosphate (DP) |
| PREP4 | AM3 | EHP |
| PREP5 | AM7 | EHP |
| PREP6 | AM5 | EHP |
| PREP7 | AM8 | EHP |
| PREP8 | AM9 | EHP |
| PREP9 | AM1 | (isooctyl)phosphate (OP) |
| PREP10 | AM1 | (isopropyl/methylamyl) phosphate (IMP) |
| PREP11 | AM1 | (isopropyl/methylamyl) dithiophosphate (IMTP) |
| PREP12 | AM6 | IMP |
| PREP19 | AM10 | EHP |
| PREP22 | AM17 | IMP |
| PREP25 | AM22 | Mixture of 1,2-propane diol and 2-ethylhexanol (mole ratio 1:5.5) phosphate |
| PREP26 | AM5 | Mixture of 1,2-propane diol and 4-methyl-2-pentanol (mole ratio 1:5.5) phosphate |
| PREP27 | AM6 | Mixture of 1,2-propane diol and 4-methyl-2-pentanol (mole ratio 1:5.5) phosphate |
| PPREP28 | AM1 | Mixture of 1,2-propane diol and 4-methyl-2-pentanol (mole ratio 1:5.5) phosphate |
| PREP29 | AM8 | Mixture of 1,2-propane diol and 4-methyl-2-pentanol (mole ratio 1:5.5) phosphate |

TABLE 1-continued

| Preparative Amine-Phosphate Salts | | |
|---|---|---|
| | Amine | (Thio)Phosphate |
| PREP30 | AM23 | Mixture of 1,2-propane diol and 2-ethylhexanol (mole ratio 1:7) phosphate |
| PREP31 | AM23 | 4-methyl-2-pentanol phosphate |
| COMP PREP25 | 2-EHA | OP |

Footnote: The phosphate product is typically in the form of a mixture of mono- and di-phosphates.

Study 1 and Study 2

Study 1 and study 2 are conducted on SAE 80W-90 fluids nominally having a kinematic viscosity of 14 cSt ($mm^2/s$) at 100° C. The fluids comprise the phosphorus additive as described to nominally deliver 500 ppm phosphorus and additionally include: sulfurized olefin: 2 wt %, polyacrylate antifoam: 0.06 wt % (69% diluent oil), oleyl amide: 0.1 wt %, oleyl amine: 0.35 wt %, poly(alkyl)methacrylate PPD: 2 wt % (50% diluent oil), and the remainder of formulation contains 600N:150N Brightstock base stocks at a 85:15 wt:wt ratio.

Study 1

The lubricants are evaluated for wear performance in a programmed temperature high frequency reciprocating rig (HFRR) available from PCS Instruments using a steel ball on steel plate. HFRR conditions for the evaluations are 100 g, 60 minute duration, 1000 micrometer stroke, 20 hertz frequency, and run at 100° C. for 60 min. Wear scar in micrometers and film formation as percent film thickness are then measured with lower wear scar values and higher film formation values indicating improved wear performance. The percent film thickness is based on the measurement of electrical potential between an upper and a lower metal test plate in the HFRR. When the film thickness is 100%, there is a high electrical potential for the full length of the 1000 micrometre stroke, suggesting no metal to metal contact. Conversely for a film thickness of 0% there is no electrical potential suggesting continual metal to metal contact between the plates. For intermediate film thicknesses, there is an electrical potential suggesting the upper and lower metal test plate have a degree of metal to metal contact as well as other areas with no metal to metal contact. The wear scar, coefficient of friction and film formation results obtained are presented in the following table:

| | Treat rate (wt %) | Average Wear Scar Dia. (μm) | Average C. of F. | Average Contact Potential (%) |
|---|---|---|---|---|
| Prep 1 | 1.13 | 167 | 0.125 | 72 |
| Prep 29 | 1.1 | 123 | 0.109 | 95 |
| Prep 28/29 | 0.55/0.6 | 127 | 0.111 | 96 |
| Prep 28 | 1.2 | 152 | 0.115 | 92 |
| Comp Prep 25 | 0.7 | 209 | 0.134 | 49 |

Study 2

Evaluation of four ball wear are run according to ASTM D4172 at 40 kg. Wear scar in millimeters is then measured with lower wear scar values indicating improved wear performance. The results obtained are:

| | Treat rate (wt %) | Average Wear Scar Dia. (mm) |
|---|---|---|
| Comp Prep 25 | 0.7 | 0.817 |
| Prep 1 | 1.13 | 0.475 |
| Prep 4 | 2.68 | 0.568 |
| Prep 2 | 1.95 | 0.605 |
| Prep 28 | 1.2 | 0.359 |
| Prep 29 | 1.1 | 0.61 |

Study 3

Study 3 is conducted on SAE 80W-90 fluids nominally having a kinematic viscosity of 14 cSt ($mm^2/s$) at 100° C. The fluids comprise the phosphorus additive as described to nominally deliver 500 ppm phosphorus and additionally include: 400 TBN calcium overbased sulfonate detergent: 0.5 wt % (42% diluent oil), sulfurized olefin: 2 wt %, polyacrylate antifoam: 0.06 wt % (69% diluent oil), oleyl amide: 0.1 wt %, oleyl amine: 0.35 wt %, poly(alkyl) methacrylate PPD: 2 wt % (50% diluent oil), and the remainder of formulation contains 600N:150N Brightstock base stocks at a 85:15 wt:wt ratio.

The lubricants are evaluated for wear performance in a programmed temperature high frequency reciprocating rig (HFRR) available from PCS Instruments using a steel ball on steel plate. HFRR conditions for the evaluations are 300 g, 60 minute duration, 1000 micrometer stroke, 20 hertz frequency, and run at 100° C. for 60 min. Wear scar in micrometers and film formation as percent film thickness are then measured with lower wear scar values and higher film formation values indicating improved wear performance.

The percent film thickness is based on the measurement of electrical potential between an upper and a lower metal test plate in the HFRR. When the film thickness is 100%, there is a high electrical potential for the full length of the 1000 micrometer stroke, suggesting no metal to metal contact. Conversely for a film thickness of 0% there is no electrical potential suggesting continual metal to metal contact between the plates. For intermediate film thicknesses, there is an electrical potential suggesting the upper and lower metal test plate have a degree of metal to metal contact as well as other areas with no metal to metal contact. The wear scar, coefficient of friction and film formation results obtained are presented in the following table:

| | Treat Rate (wt %) | Average Wear Scar Dia. (μm) | Average C. of F. | Average Contact Potential (%) |
|---|---|---|---|---|
| Prep 1 | 1.13 | 139 | 0.127 | 82 |
| Prep 29 | 1.1 | 172 | 0.127 | 79 |
| Prep 28/29 | 0.55/0.6 | 197 | 0.123 | 71 |
| Prep 28 | 1.2 | 153 | 0.124 | 79 |
| Comp Prep 25 | 0.7 | 242 | 0.126 | 8 |

Study 4

Study 4 was conducted on SAE 75W-90 fluids nominally having a kinematic viscosity 14 cSt at 100° C. The fluids comprise the phosphorus additive as described to nominally deliver 900 ppm phosphorus and additionally include substituted C9 thiadiazole: 0.2 wt %, sulfurized olefin: 4.6 wt %, oleyl imidazoline: 0.035 wt %, borated succinimide dispersant (CO:N 1:>1.6, 1.9% boron): 1 wt % (33% diluent oil), non-borated succinimide dispersant (CO:N, 0.26:1) post treated with dimercaptothiadiazole: 0.5 wt % (49% base oil), polyacrylate antifoam: 0.06 wt % (69% diluent oil), poly (alpha-olefin) (100 cSt at 100'C): 36 wt %, and the remainder of formulation is 4 cSt ($mm^2/s$) PAO.

The fluids were evaluated for wear performance in a hypoid gear durability test. The test uses a modern light duty hypoid gear rear drive axle. The test is a 2 stage steady state test typical of hypoid gear durability testing (for instance ASTM D6121). Stage 1 is a 65 minute break in stage run at high speed, low load to allow break-in of the gears before the durability stage is run. Wheel speed is controlled to 682 rpm and wheel torque is controlled to 508 Nm per wheel during the conditioning phase (ring gear torque is controlled to 1016 Nm) during the conditioning phase. Stage 2 is a 24 h durability phase to evaluate the lubricants ability to protect the gears from failure modes evaluated in accordance with ASTM D6121. Wheel speed is controlled to 124 rpm and wheel torque is controlled to 2237 Nm per wheel (ring gear torque is controlled to 4474 Nm) during the durability phase. Bulk oil temperature is measured via an immersed thermocouple and allowed to warm up unassisted during the conditioning phase and controlled at 135° C. throughout the test using spray water to the outside of the axle housing. During both phases the temperature of the axle oil sump is controlled with spray water. The speed and torques are smoothly ramped over several minutes (2-5) to conditioning and the test stages. Test components are removed and rated by a Test Monitoring Center calibrated rater. The distress ratings and consideration of pass/fail of pinion and ring gears are assessed according to API GL-5 specifications. The results obtained are:

| | Comp Prep25 | Prep25 | Prep26 | Prep27 |
|---|---|---|---|---|
| Treat Rate (wt %) | 1.17 | 2.18 | 2.1 | 2.3 |
| Pinion Rating | | | | |
| Wear | 5 | 7 | 7 | 7 |
| Rippling | 8 | 10 | 10 | 10 |
| Ridging | 5 | 9 | 10 | 10 |
| Spitting | 7 | 9.7 | 9.5 | 9.9 |
| Scoring | 10 | 10 | 10 | 10 |
| Ring Rating | | | | |
| Wear | 6 | 8 | 8 | 8 |
| Rippling | 10 | 10 | 10 | 10 |
| Ridging | 5 | 10 | 10 | 10 |
| Spitting | 10 | 10 | 9.9 | 9.9 |
| Scoring | 10 | 10 | 10 | 10 |
| Overall Analysis | Fail | Pass | Pass | Pass |

Study 5—Seals Compatibility Tests

Study 5 was conducted on lubricant compositions comprising PAO4 and PAO100 (polyalphaolefin) fluids nominally having a kinematic viscosity of 4 cSt or 100 cSt at 100° C. respectively, such as Synfluid® available from Chevron Phillips. The lubricant compositions tested are shown in Table 6 below. Lubricant components are shown in weight percent (wt %) based on a total weight of the lubricant composition.

TABLE 6

| Function/Component | | Example 6-A Inventive | Example 6-B Inventive | Example 6-C Comparative |
|---|---|---|---|---|
| Base Oils | PAO4 | 66 | 66 | 66 |
| | PAO100 | 24 | 24 | 24 |
| Dispersant Package | Borated PiB succinimide type | 0.67 | 0.67 | 0.67 |
| | PiB succinimide amide/ester with DMTD type (TBN = 4) | 0.51 | 0.51 | 0.51 |
| Extreme Pressure Package | Sulfurized olefin | 2.3 | 2.3 | 2.3 |
| | Dibutyl tetrasulphide | 2.3 | 2.3 | 2.3 |
| Antioxidant | Alkenyl imidazoline | 0.035 | 0.035 | 0.035 |
| Corrosion Inhibitor | Substituted thiadiazole | | | |
| Antifoam | Acrylate type | 0.03 | 0.03 | 0.03 |
| Inventive Antiwear Package | PREP30 | 1.88 | | |
| Inventive Antiwear Package | PREP31 | | 1.83 | |
| Comparative Antiwear package | Salt of a branched $C_8$ primary amine of iso octylphosphate | | | 1.17 |
| Diluent Oil | | Balance to 100 | Balance to 100 | Balance to 100 |

The seals compatibility of Examples 6-A through 6-C are tested according to ASTM D 5662. For the compatibility tests, three parameters are tested, the difference in volume, hardness, and tensile strength. Ideally, the effect of the lubricant compositions would have a minimal impact on these properties.

Dumbbell-shaped pieces of a fluoro-elastomeric seal material are immersed in the lubricant compositions for 240 hours at 150° C. The difference in volume between the start of test (SOT) & that at the end of test (EOT) is recorded as % volume change (ASTM D471).

The change in Shore hardness of the pieces is then measured between SOT & EOT (ASTM D2240). A negative change in hardness indicates the specimen has softened and a positive change indicates hardening.

Finally, the dumbbell-shaped pieces are placed in a tensile strength measuring machine. The ends of each piece are pulled apart until the piece ruptures and the tensile strength is measured (ASTM D412). A "fresh" piece not exposed to the lubricant compositions is used as a control. The % difference between the rupture length of the pieces exposed to the lubricant composition and the control is the rupture elongation measurement.

The results of the compatibility tests are shown in Table 7 below. As shown in the table, the comparative formulation (Example 6-C) has hardened the dumbbell (Shore hardness), which gives it a higher tensile strength, causing the elastomer to rupture much sooner under load than either of the inventive formulations (Examples 6-A and 6-B).

TABLE 7

| Compatibility Test Results | Example 6-A | Example 6-B | Example 6-C |
|---|---|---|---|
| % volume change | 2.4 | 1.9 | 1.9 |
| Shore hardness change | 0 | 1 | 8 |
| % Tensile strength change | 10.1 | 4.7 | 20.7 |
| % Elongation at rupture | −10.6 | −28.1 | −59.1 |

It is known that some of the materials described above may interact in the final formulation, so that the components of the final formulation may be different from those that are initially added. The products formed thereby, including the products formed upon employing lubricant composition of the present invention in its intended use, may not be susceptible of easy description. Nevertheless, all such modifications and reaction products are included within the scope of the present invention; the present invention encompasses lubricant composition prepared by admixing the components described above.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element may be used together with ranges or amounts for any of the other elements.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A lubricant composition comprising:

(a) an oil of lubricating viscosity;

(b) a (thio)phosphoric acid salt of an N-hydrocarbyl-substituted gamma- (γ-) or delta- (δ-) amino(thio)ester, wherein the amino group is separated from the ester group by a chain of at least 3 carbon atoms; and (c) a thiadiazole.

2. The lubricant composition of claim 1, wherein the amino(thio)ester comprises an N-hydrocarbyl-substituted gamma- amino(thio)ester.

3. The lubricant composition of claim 1, wherein the amino(thio)ester comprises an N-hydrocarbyl-substituted gamma- aminoester.

4. The lubricant composition of claim 1, wherein said chain has a hydrocarbyl branch at the 1 or 2 position, provided that when the hydrocarbyl branch is at the 1 position, it is not a tertiary group.

5. The lubricant composition of claim 1, wherein the amino(thio)ester comprises a 2-((hydrocarbyl)aminomethyl) succinic acid dihydrocarbyl ester.

6. The lubricant composition of claim 1, wherein the ester functionality comprises an alcohol-derived group which is a hydrocarbyl group having 1 to about 30 carbon atoms.

7. The lubricant composition of claim 1 wherein the ester functionality comprises an alcohol-derived group which is an ether-containing group.

8. The lubricant composition of claim 1, wherein the amino(thio)ester is an aminoester and comprises a second ester functionality, and wherein the two alcohol-derived groups of the ester functionalities are alkyl moieties which are the same or different and have 1 to about 18 carbon atoms.

9. The lubricant composition of claim 1, wherein the (thio)phosphoric acid salt of an N-hydrocarbyl-substituted amino(thio)ester is obtained/obtainable by reacting an N-hydrocarbyl-substituted amino(thio)ester with a (thio)phosphoric acid, ester, or a partial acid-ester thereof.

10. The lubricant composition of claim 9, wherein said chain has a hydrocarbyl branch at the 1 or 2 position, provided that when the hydrocarbyl branch is at the 1 position, it is not a tertiary group.

11. The lubricant composition of claim 1, wherein the oil of lubricating viscosity comprises at least one API Group I, II, III, IV, or V, lubricant or mixtures thereof.

12. The lubricant composition of claim 1 further comprising at least one of a phosphorus-containing antiwear agent comprising a non-ionic phosphorus compound; an amine salt of a phosphorus compound; a dispersant; a detergent; an olefin sulphide; a calcium-containing detergent; a friction modifier; a sulphur-containing extreme pressure agent; a sulphur-containing corrosion inhibitor; or combinations thereof.

13. The lubricant composition of claim 1 further comprising 0.05 wt % to 3 wt % of a $C_2$-$C_{18}$ di- or tri-hydrocarbyl phosphite, based on a total weight of said lubricant.

14. The lubricant composition of claim 1 further comprising an olefin sulphide.

15. The lubricant composition of claim 1 further comprising less than 300 ppm zinc based on a total weight of said lubricant.

16. A method of lubricating a manual transmission comprising supplying a lubricant composition of claim 1 to said manual transmission.

17. A method of lubricating a gear, gearbox, or axle gear comprising supplying a lubricant composition of claim 1 to said gear, gearbox, or axle.

18. A method of lubricating an automatic transmission comprising supplying a lubricant composition of claim 1 to said automatic transmission.

19. A method of lubricating a farm tractor transmission comprising supplying a lubricant composition of claim 1 to said farm tractor transmission.

20. A method of improving seals compatibility of a lubricant composition comprising adding to said lubricant composition a (thio)phosphoric acid salt of an N-hydrocarbyl-substituted gamma- (γ-) or delta- (δ-) amino(thio)ester, wherein the amino group is separated from the ester group by a chain of at least 3 carbon atoms.

21. A method of improving corrosion inhibition of a lubricant composition comprising adding to said lubricant composition a (thio)phosphoric acid salt of an N-hydrocarbyl-substituted gamma- (γ-) or delta- (δ-) amino(thio)ester, wherein the amino group is separated from the ester group by a chain of at least 3 carbon atoms.

22. A method of improving antiwear performance of a lubricant composition comprising adding to said lubricant composition a (thio)phosphoric acid salt of an N-hydrocarbyl-substituted gamma- (γ-) or delta- (δ-) amino(thio)ester, wherein the amino group is separated from the ester group by a chain of at least 3 carbon atoms.

* * * * *